US010242635B2

(12) United States Patent
Nakaya

(10) Patent No.: US 10,242,635 B2
(45) Date of Patent: Mar. 26, 2019

(54) IMAGE DISPLAY METHOD AND IMAGE DISPLAY DEVICE

(71) Applicant: LG DISPLAY CO., LTD., Seoul (KR)

(72) Inventor: Hideo Nakaya, Tokyo (JP)

(73) Assignee: LG DISPLAY CO., LTD., Seoul (KR)

( * ) Notice: Subject to any disclaimer, the term of this patent is extended or adjusted under 35 U.S.C. 154(b) by 97 days.

(21) Appl. No.: 14/976,673

(22) Filed: Dec. 21, 2015

(65) Prior Publication Data

US 2016/0180782 A1 Jun. 23, 2016

(30) Foreign Application Priority Data

Dec. 22, 2014 (JP) ..... 2014-258700
Dec. 22, 2014 (JP) ..... 2014-258727
Dec. 22, 2014 (JP) ..... 2014-258749
Dec. 22, 2014 (JP) ..... 2014-258766

(51) Int. Cl.
*G09G 3/36* (2006.01)

(52) U.S. Cl.
CPC ..... *G09G 3/3648* (2013.01); *G09G 2300/023* (2013.01); *G09G 2320/0271* (2013.01); *G09G 2320/066* (2013.01); *G09G 2340/06* (2013.01)

(58) Field of Classification Search
CPC ..... G09G 2300/023; G09G 2360/16; G09G 2320/0238; G09G 2340/06; G09G 3/3406; G06F 3/14
See application file for complete search history.

(56) References Cited

U.S. PATENT DOCUMENTS 7,348,991 B1 * 3/2008 Keating ..... G06F 3/14 345/468
7,369,284 B1 * 5/2008 Inuzuka ..... H04N 9/045 348/E9.01
2003/0020935 A1 * 1/2003 Morimatsu ..... H04N 1/52 358/1.9
2010/0020265 A1 1/2010 Senoue et al.
2010/0118006 A1 5/2010 Kimura
2012/0092385 A1 4/2012 Ikeno et al.
2013/0106923 A1 * 5/2013 Shields ..... G09G 3/3406 345/690
2013/0265320 A1 10/2013 Yamazaki et al.

FOREIGN PATENT DOCUMENTS

CN 2881703 Y 3/2007
CN 101165767 A 4/2008
CN 101263417 A 9/2008
CN 101634773 A 1/2010
CN 101739987 A 6/2010
CN 103186006 A 7/2013
JP 5088197 4/1993
JP 10-155089 A 6/1998
JP 2002-099238 A 4/2002

(Continued)

*Primary Examiner* — Sepehr Azari
(74) *Attorney, Agent, or Firm* — Dentons US LLP

(57) ABSTRACT

Disclosed is a method of displaying an image using an image display device including a front LCD panel and a rear LCD panel overlapping each other that may include displaying an RGB image in the front LCD panel; generating a black-and-white image having a luminance value adjusted by a pixel by signal-processing the RGB image, and displaying the black-and-white image in the rear LCD panel.

15 Claims, 32 Drawing Sheets

(56) References Cited

FOREIGN PATENT DOCUMENTS

| | | | |
|---|---|---|---|
| JP | 2002-165111 | A | 6/2002 |
| JP | 2006-106495 | A | 4/2006 |
| JP | 2007-213460 | A | 8/2007 |
| JP | 2007-279732 | A | 10/2007 |
| JP | 2008-019269 | | 1/2008 |
| JP | 2008-111877 | | 5/2008 |
| JP | 2008-122940 | A | 5/2008 |
| JP | 2008-191269 | A | 8/2008 |
| JP | 2009-003180 | A | 1/2009 |
| JP | 2009-124451 | A | 6/2009 |
| JP | 2010-026410 | A | 2/2010 |
| JP | 2010-113269 | A | 5/2010 |
| JP | 2013-008056 | A | 1/2013 |
| JP | 2013-231961 | A | 11/2013 |
| JP | 2014-203028 | A | 10/2014 |
| KR | 10-2009-0081804 | A | 7/2009 |
| KR | 10-2010-0119023 | A | 11/2010 |
| WO | 2005/050614 | A1 | 6/2005 |
| WO | 2007/040127 | A1 | 4/2007 |
| WO | 2007/108183 | | 9/2007 |
| WO | 2008/114521 | A1 | 9/2008 |

* cited by examiner

```
If( Xc == 1) {
   for( i = 1; i <= 8; i++) {
      if(Xi == 0)   Xi = 1;
   }
}
```

program for process of expanding high luminance region

RGB input image
final output image
color matrix conversion
LUT conversion
LUT input image
LV image(B/W):no high luminance region expansion process FIG. 11A
FIG. 11D
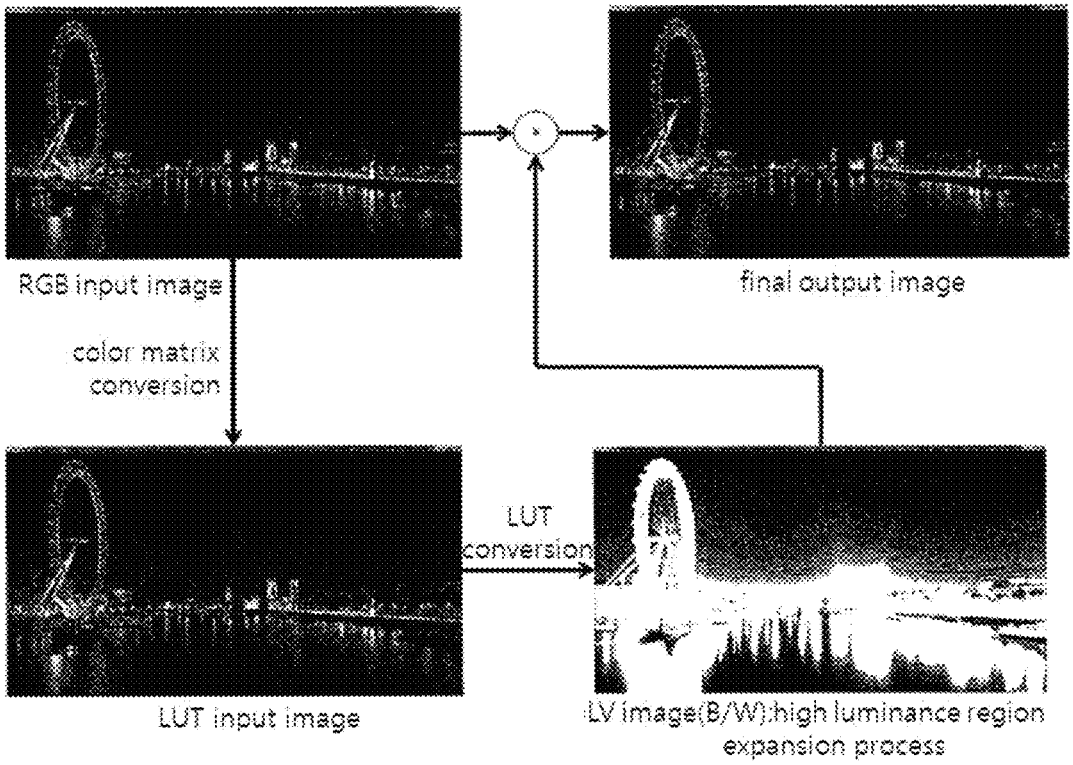
FIG. 11B
FIG. 11C
FIG. 12
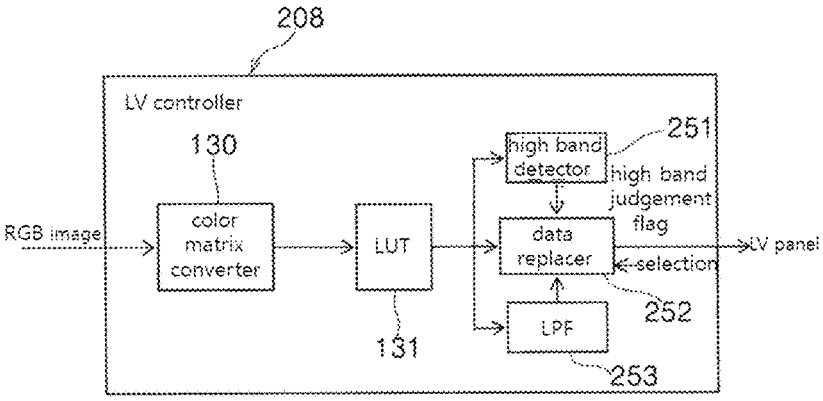

FIG. 15
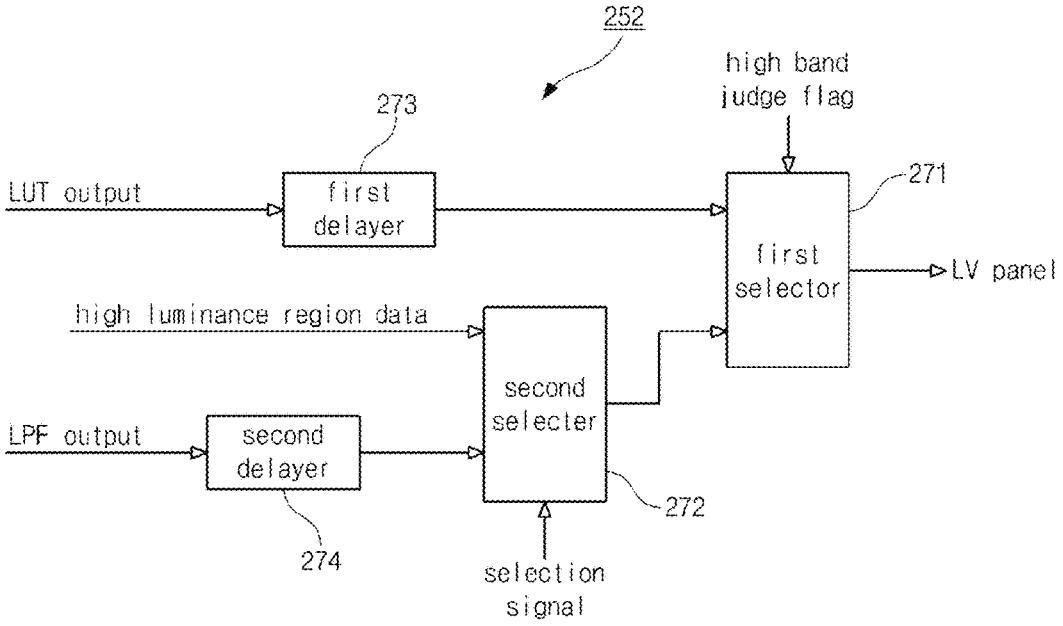
FIG. 16A
FIG. 16D
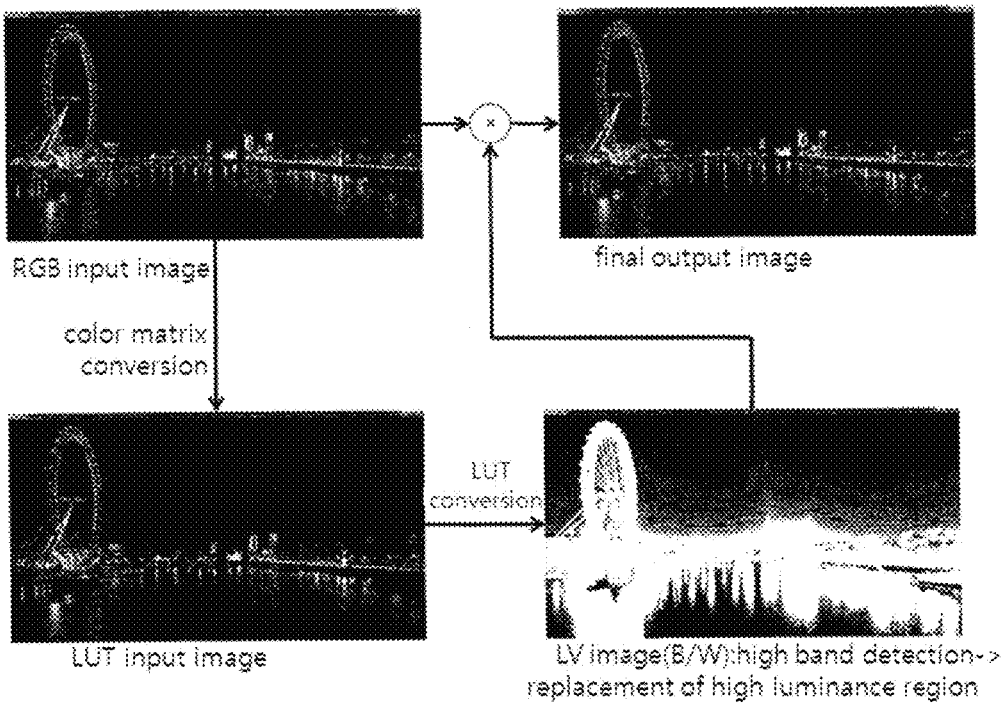
FIG. 16B
FIG. 16C

FIG. 17A
FIG. 17D
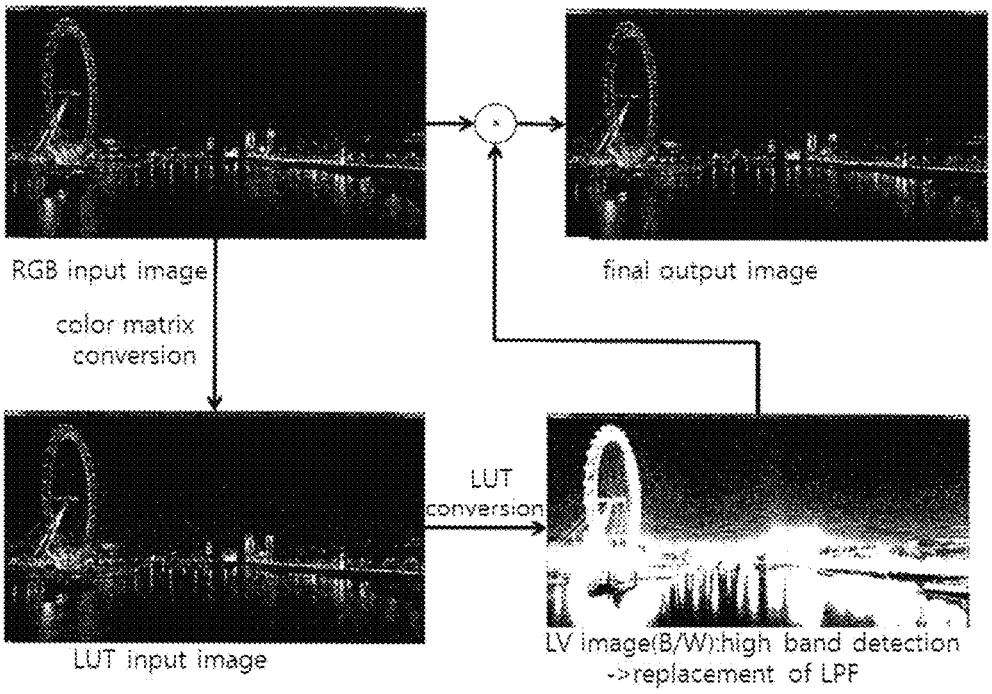
FIG. 17B
FIG. 17C
FIG. 18
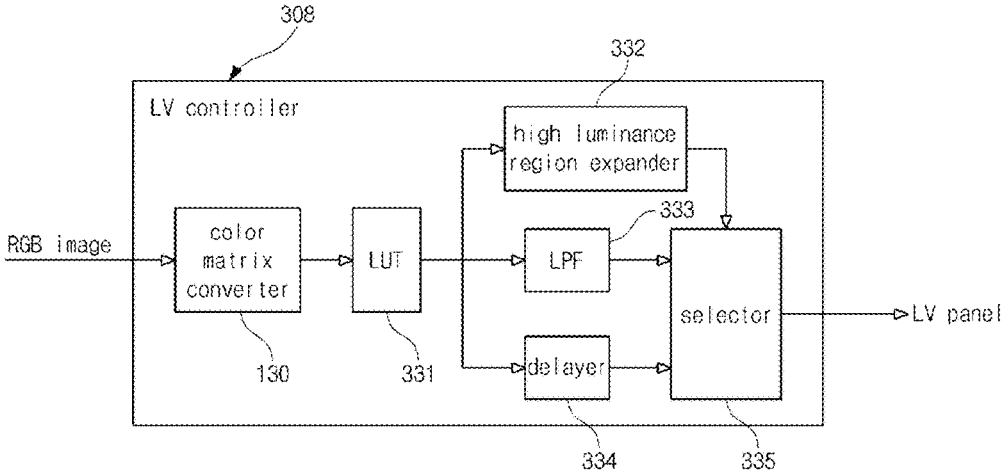

linear function curvilinear function process of expanding high luminance region

```
If( Xc == 255)  {
    for( i = 1; i <= 8; i++) {
        if(Xi != 255)    Xi = 255;
    }
}
```

program for process of expanding high luminance region

FIG. 21
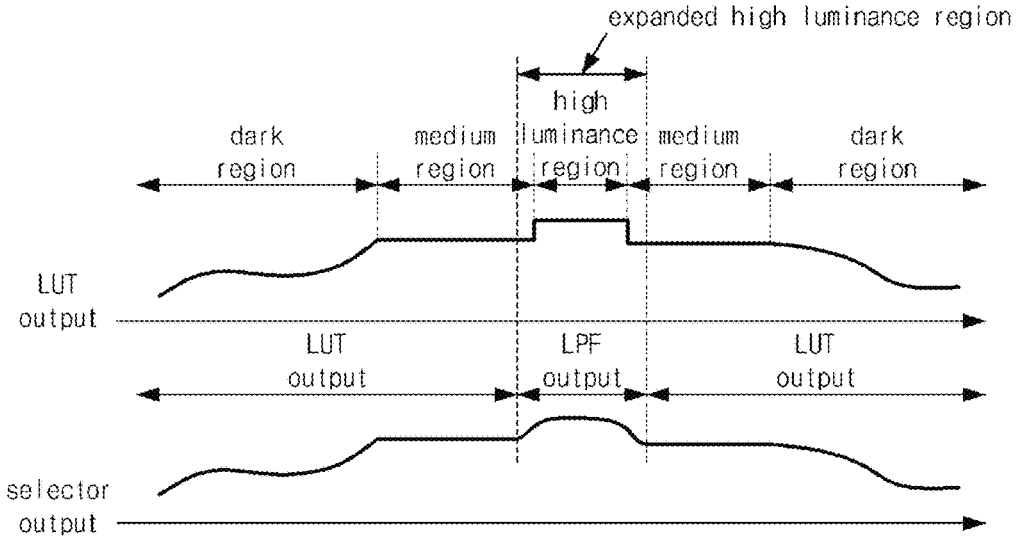
FIG. 22A
FIG. 22D
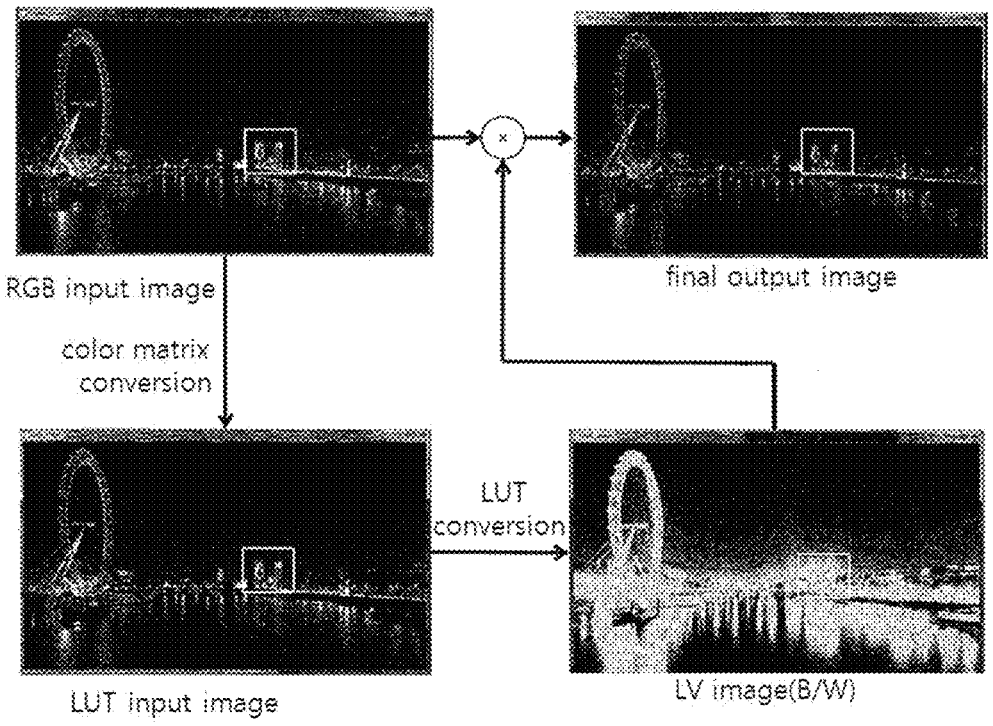
FIG. 22B
FIG. 22C

FIG. 23A
FIG. 23D
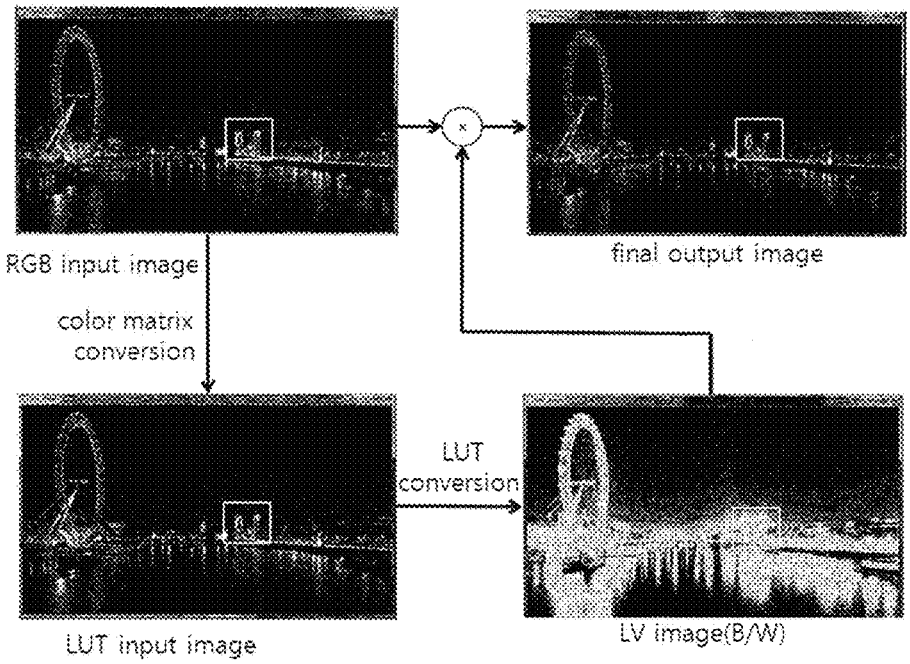
FIG. 23B
FIG. 23C
FIG. 24
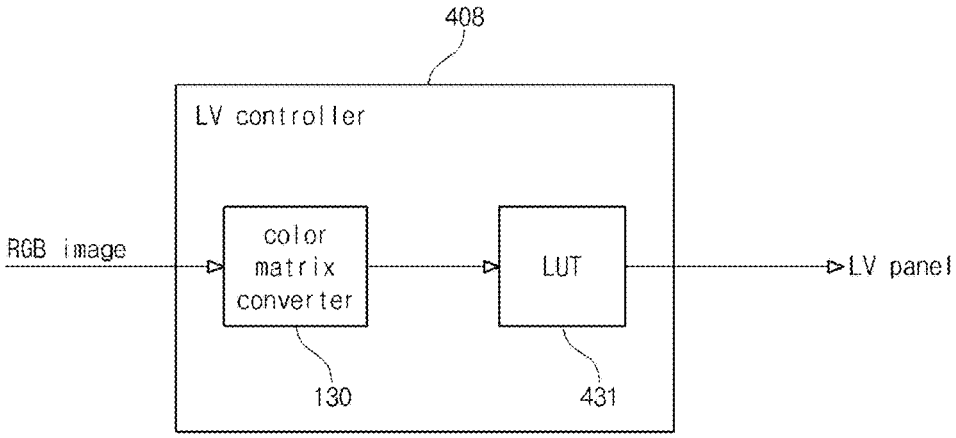

FIG. 26A

| input | measured value(%) | ideal value(%) | correction coefficient | LUT value |
|---|---|---|---|---|
| 255 | 100.00 | 100.00000 | 1.00000 | 255 |
| 239 | 86.70 | 86.71355 | 1.00016 | 255 |
| 223 | 74.50 | 74.45302 | 0.99937 | 255 |
| 207 | 63.20 | 63.20426 | 1.00007 | 255 |
| 191 | 53.00 | 52.95232 | 0.99910 | 255 |
| 175 | 43.70 | 43.68128 | 0.99957 | 255 |
| 159 | 35.40 | 35.37409 | 0.99927 | 255 |
| 143 | 28.10 | 28.01244 | 0.99688 | 254 |
| 127 | 21.60 | 21.57644 | 0.99891 | 255 |
| 111 | 16.10 | 16.04435 | 0.99654 | 254 |
| 95 | 11.50 | 11.39209 | 0.99062 | 253 |
| 79 | 7.66 | 7.59281 | 0.99120 | 253 |
| 63 | 4.66 | 4.61488 | 0.98609 | 251 |
| 47 | 2.49 | 2.42229 | 0.97281 | 248 |
| 31 | 1.04 | 0.96963 | 0.93234 | 238 |
| 15 | 0.27 | 0.19834 | 0.72719 | 185 |
| 1 | 0.08 | 0.00051 | 0.00609 | 2 |

LUT setting

| input | measured value(%) | ideal value(%) | correction coefficient | LUT value |
|---|---|---|---|---|
| 31 | 1.040 | 0.969633 | 0.932339 | 238 |
| 30 | 0.992 | 0.902149 | 0.909539 | 232 |
| 29 | 0.944 | 0.837312 | 0.887218 | 226 |
| 28 | 0.896 | 0.775103 | 0.865432 | 221 |
| 27 | 0.848 | 0.715504 | 0.844252 | 215 |
| 26 | 0.799 | 0.658496 | 0.823783 | 210 |
| 25 | 0.751 | 0.604059 | 0.804072 | 205 |
| 24 | 0.703 | 0.552174 | 0.785315 | 200 |
| 23 | 0.655 | 0.502820 | 0.767665 | 196 |
| 22 | 0.607 | 0.455975 | 0.751350 | 192 |
| 21 | 0.559 | 0.411618 | 0.736676 | 188 |
| 20 | 0.511 | 0.369724 | 0.724062 | 185 |
| 19 | 0.463 | 0.330270 | 0.714098 | 182 |
| 18 | 0.414 | 0.293232 | 0.707648 | 180 |
| 17 | 0.366 | 0.258583 | 0.706027 | 180 |
| 16 | 0.318 | 0.226295 | 0.711341 | 181 |
| 15 | 0.270 | 0.196342 | 0.727191 | 185 |

LUT setting between representative points

RGB input image
final output image
color matrix conversion
LUT conversion
LUT input image
LV image(B/W)

FIG. 29A
FIG. 29D
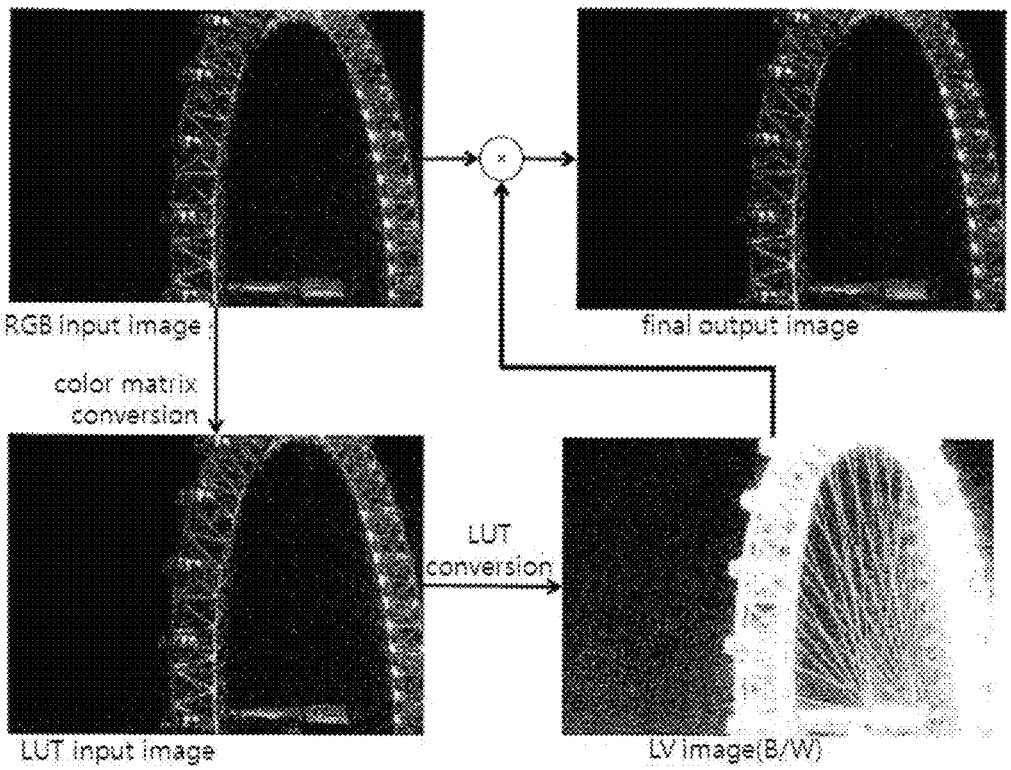
FIG. 29B
FIG. 29C
FIG. 30
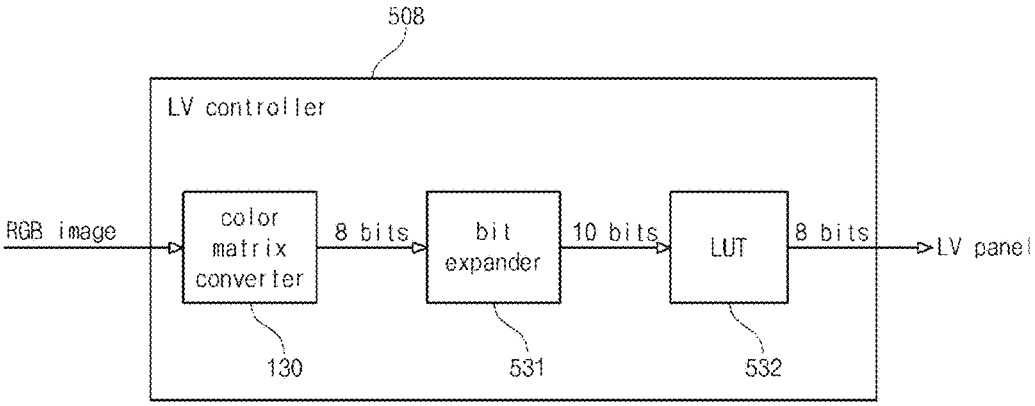

| | | |
|---|---|---|
| X1 | X2 | X3 |
| X4 | X5 | X6 |
| X7 | X8 | X9 |

object pixel and adjacent pixel

```
int   dc = 0;
for( i =1; i <= 9; i++) {
  if ( X5 < Xi )     dc += 1;
  if ( X5 > Xi )     dc -= 1;
}
X5 = X5 + dc/8.0;
```

setting expansion bit value

FIG. 33A 10 bits 8 bits

| input | measured value(%) | ideal value(%) | correction coefficient | LUT value |
|---|---|---|---|---|
| 1023 | 100.00 | 100.00000 | 1.00000 | 255 |
| 956 | 86.70 | 86.15510 | 0.99372 | 253 |
| 892 | 74.50 | 73.97352 | 0.99293 | 253 |
| 828 | 63.20 | 62.79721 | 0.99363 | 253 |
| 764 | 53.00 | 52.81130 | 0.99287 | 253 |
| 700 | 43.70 | 43.39996 | 0.99313 | 253 |
| 636 | 35.40 | 35.14627 | 0.99283 | 253 |
| 572 | 28.10 | 27.83203 | 0.99046 | 253 |
| 508 | 21.60 | 21.43748 | 0.99248 | 253 |
| 444 | 16.10 | 15.94102 | 0.99013 | 252 |
| 380 | 11.50 | 11.31873 | 0.98424 | 251 |
| 316 | 7.66 | 7.54371 | 0.98482 | 251 |
| 252 | 4.68 | 4.58516 | 0.97974 | 250 |
| 188 | 2.49 | 2.40569 | 0.96654 | 246 |
| 124 | 1.04 | 0.96339 | 0.92633 | 236 |
| 60 | 0.27 | 0.19508 | 0.72251 | 184 |
| 1 | 0.08 | 0.00202 | 0.00030 | 0 |

LUT setting

FIG. 33B 10 bits 8 bits

| input | measured value(%) | ideal value(%) | correction coefficient | LUT value |
|---|---|---|---|---|
| 124 | 1.040 | 0.96339 | 0.92633 | 236 |
| ------ | ------ | ------ | ------ | ------ |
| 120 | 0.992 | 0.89634 | 0.90357 | 230 |
| ------ | ------ | ------ | ------ | ------ |
| 116 | 0.944 | 0.83192 | 0.88127 | 225 |
| ------ | ------ | ------ | ------ | ------ |
| 112 | 0.896 | 0.77011 | 0.85950 | 219 |
| ------ | ------ | ------ | ------ | ------ |
| 108 | 0.848 | 0.71080 | 0.83832 | 214 |
| ------ | ------ | ------ | ------ | ------ |
| 104 | 0.799 | 0.65425 | 0.81884 | 209 |
| ------ | ------ | ------ | ------ | ------ |
| 100 | 0.751 | 0.60017 | 0.79916 | 204 |
| ------ | ------ | ------ | ------ | ------ |
| 96 | 0.703 | 0.54862 | 0.78040 | 199 |
| ------ | ------ | ------ | ------ | ------ |
| 92 | 0.655 | 0.49958 | 0.76272 | 194 |
| ------ | ------ | ------ | ------ | ------ |
| 88 | 0.607 | 0.45304 | 0.74636 | 190 |
| ------ | ------ | ------ | ------ | ------ |
| 84 | 0.559 | 0.40897 | 0.73160 | 187 |
| ------ | ------ | ------ | ------ | ------ |
| 80 | 0.511 | 0.36734 | 0.71887 | 183 |
| ------ | ------ | ------ | ------ | ------ |
| 76 | 0.463 | 0.32814 | 0.70873 | 181 |
| ------ | ------ | ------ | ------ | ------ |
| 72 | 0.414 | 0.29134 | 0.70373 | 179 |
| ------ | ------ | ------ | ------ | ------ |
| 68 | 0.366 | 0.25692 | 0.70196 | 179 |
| ------ | ------ | ------ | ------ | ------ |
| 64 | 0.318 | 0.22484 | 0.70704 | 180 |
| ------ | ------ | ------ | ------ | ------ |
| 60 | 0.270 | 0.19508 | 0.72251 | 184 |

LUT setting between representative points

FIG. 34
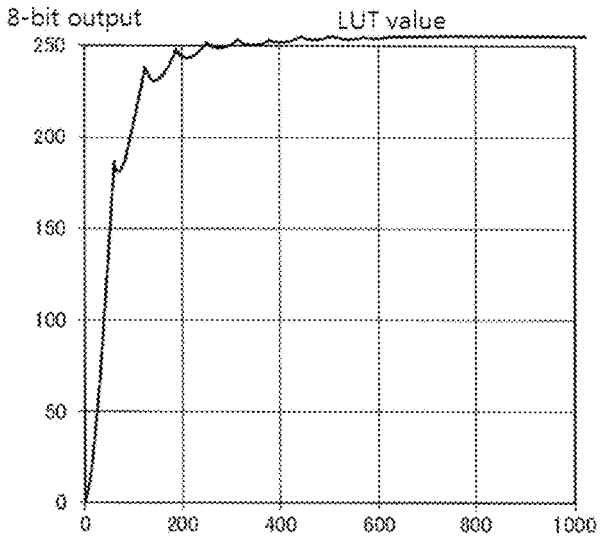
FIG. 35A
FIG. 35D
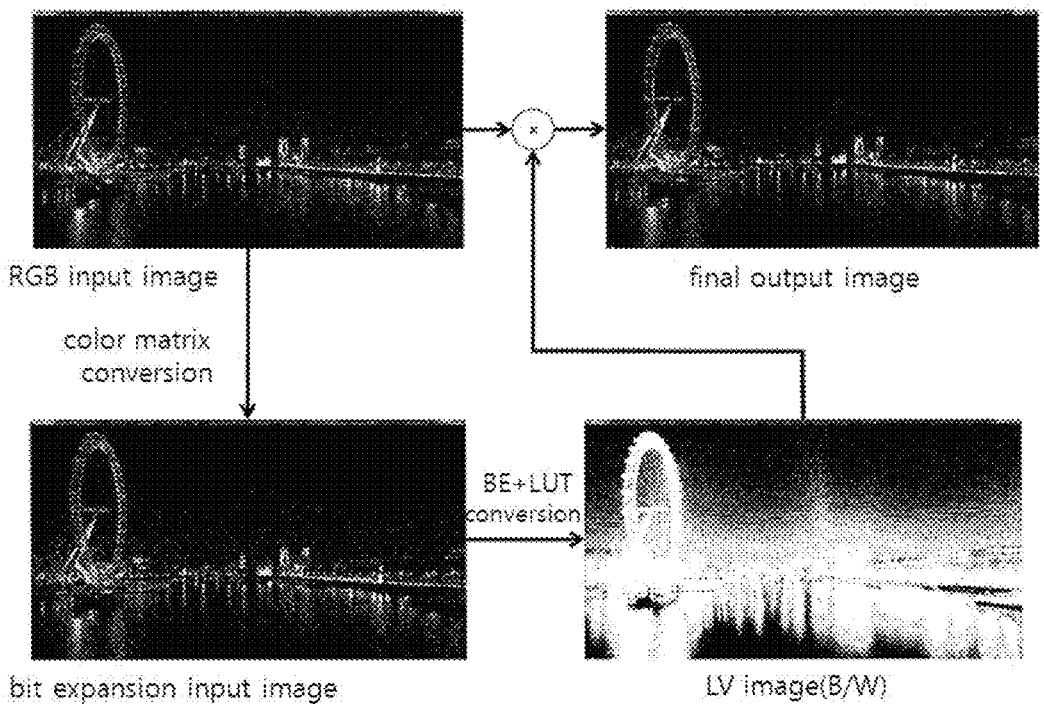
FIG. 35B
FIG. 35C

FIG. 36A
FIG. 36D
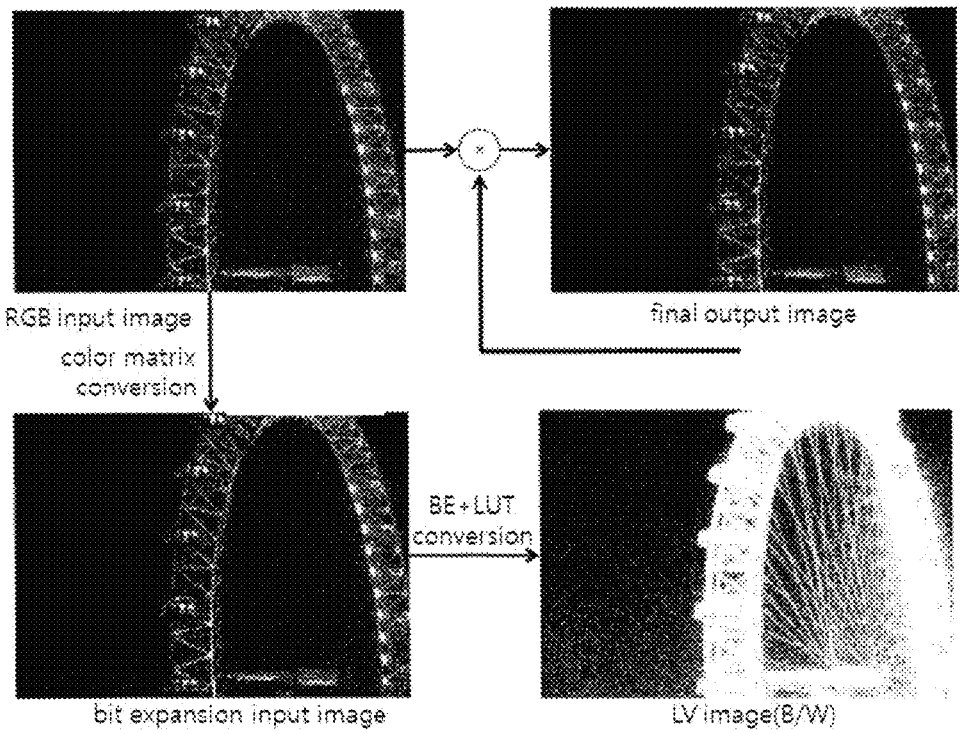
FIG. 36B
FIG. 36C
FIG. 37A
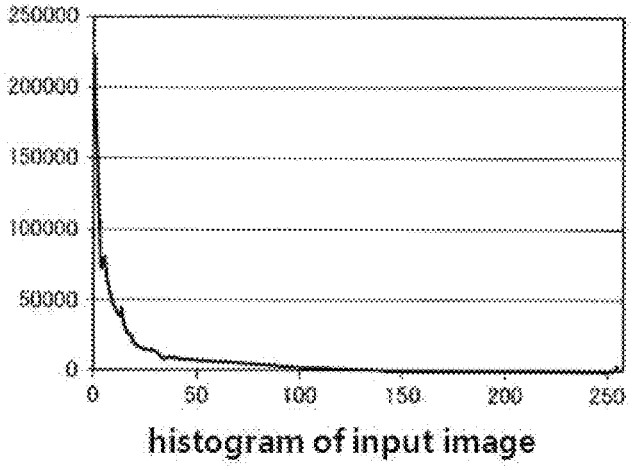

RGB input image
final output image
color matrix conversion
BE+LUT conversion
bit expansion input image
LV image(B/W)

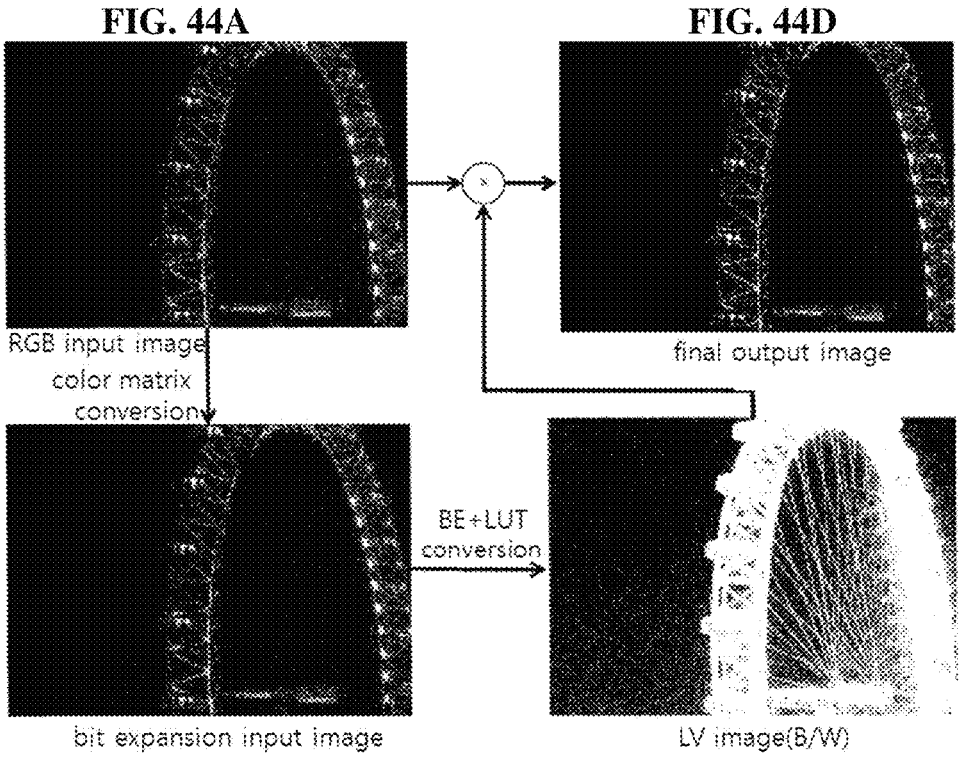
FIG. 45
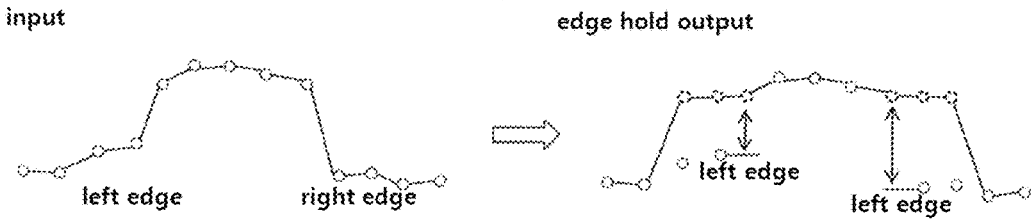

FIG. 46
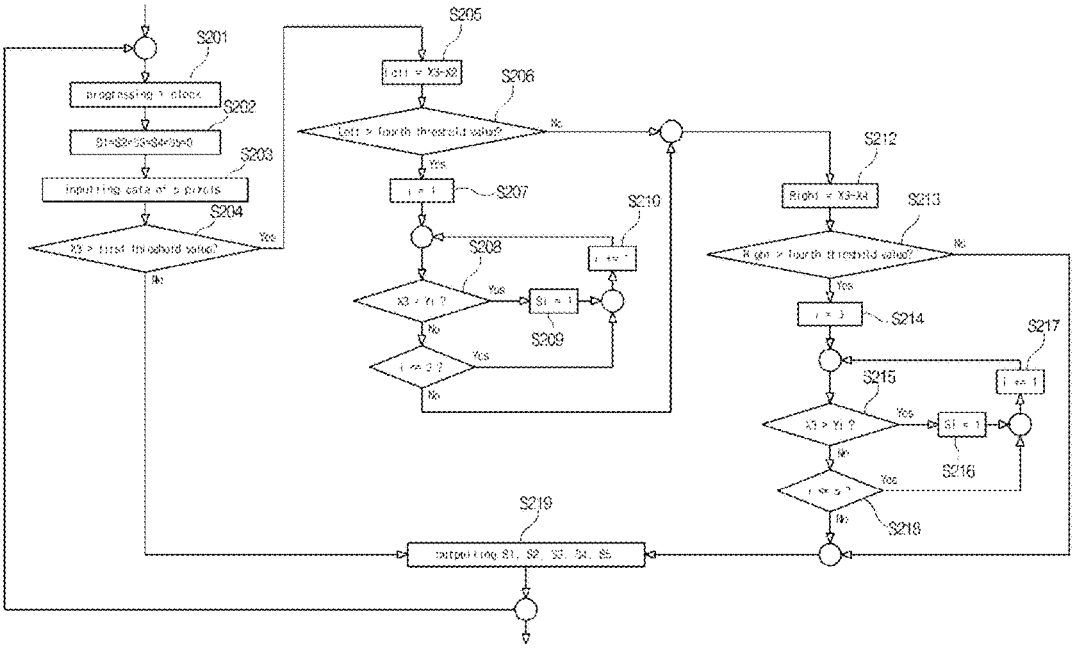
FIG. 47A
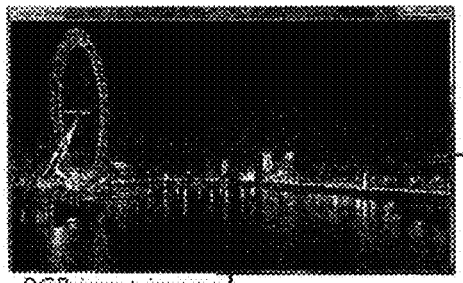
RGB input image
color matrix conversion
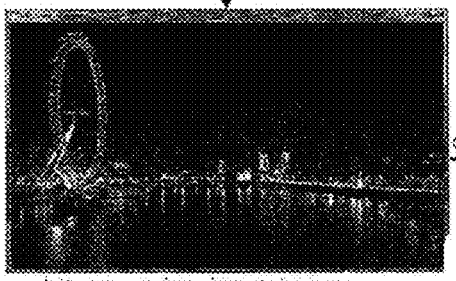
bit expansion input image
FIG. 47B
BE+LUT conversion
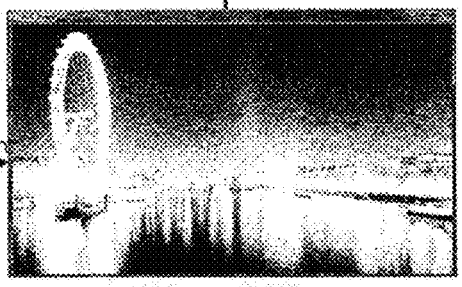
LV image(B/W)
FIG. 47C
FIG. 47D
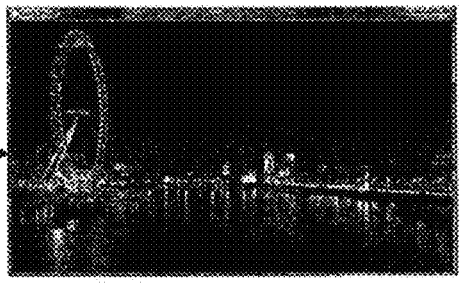
final output image

IMAGE DISPLAY METHOD AND IMAGE DISPLAY DEVICE

This application claims the benefit of Japanese Patent Application No. 2014-258700, filed on Dec. 22, 2014, Japanese Patent Application No. 2014-258727, filed on Dec. 22, 2014, Japanese Patent Application No. 2014-258749, filed on Dec. 22, 2014 and Japanese Patent Application No. 2014-258766, which are hereby incorporated by reference for all purposes as if fully set forth herein.

BACKGROUND OF THE INVENTION

Field of the Invention

The present invention relates to an image display method and an image display device.

Discussion of the Related Art

Liquid crystal display (LCD) devices, which have various advantages in mass production, driving means and quality, have been widely used as a flat display panel (FPD).

FIG. 1 is an image display device including one liquid crystal panel according to the related art.

In FIG. 1, an image display device 1 includes a main body 2 and a liquid crystal display (LCD) module 3. The main body 2 includes an image processing engine 4, and the LCD module 3 includes an interface (I/F) 5, an LCD controller 6 and an RGB panel 7.

Image data generated in the image processing engine 4 of the main body 2 is transmitted to the LCD controller 6 through the interface 5. The LCD controller 6 processes the image data received from the interface 5 and transmits the processed image data to the RGB panel 7. The RGB panel 7 displays an image corresponding to the image data received from the LCD controller 6.

In the image display device 1, gray level linearity by a naked eye is obtained by correcting the image data input to the LCD module 3 with a gamma of broken lines by a panel driver in the LCD controller 6. In addition, a light of a backlight unit passes through the RGB panel 7 to display a luminance. As a result, a gray level property of a black region is deteriorated such that the luminance of the black region increases as compared with an ideal luminance.

FIG. 2 is a graph showing an output luminance with respect to an input luminance of an image display device according to the related art.

In FIG. 2, an input of a horizontal axis and an output of a vertical axis are normalized values with a maximum luminance of 100%, and the horizontal and vertical axes are scaled logarithmically. A line 11 represents an ideal relation of input and output luminances and a line 12 represents a real relation of input and output luminances. As the relation of the input and output luminances (i.e., a gray level property) approaches an ideal value, the gray level is linearly displayed such that an image natural to an eye of a human is displayed.

As the input luminance decreases along the line 12 (as the gray level of the image data decreases), the output luminance becomes greater than the ideal value. As a result, the image by the RGB panel is displayed to have a luminance greater than the ideal value such as a white. This phenomenon may be referred to as a black lifting. When a relatively low gray level is displayed by the LCD panel, the light of the backlight unit is leaked because the light is not completely blocked in the LCD panel. The black lifting is a drawback specifically in the LCD device. A cathode ray tube (CRT) and an organic light emitting diode (OLED) panel has contrast ratios of about 10000:1 and about 1000000:1, respectively. However, the LCD panel has a contrast ratio of about 1500:1 due to the black lifting.

To improve a contrast ratio and prevent the black lifting, an image display device including two LCD panels has been suggested. For example, an image display device may be shown in Japanese Patent Publication No. H5-88197, Japanese Patent Publication No. 2008-19269, Japanese Patent Publication No. 2008-111877 and International Patent Publication No. WO 2007/108183.

When the image display device of the Japanese Patent Publication No. H5-88197 is viewed at a diagonal direction, the image of the rear LCD panel adjacent to the backlight unit is not aligned with the image of the front LCD panel adjacent to the user due to a distance between the two LCD panels. The images are out of position due to a physical parallax between the two LCD panels. Accordingly, the edge portions having a relatively great difference of luminance may be doubly shown or the images may be out of color registration.

In Japanese Patent Publication No. 2008-19269, it is not easy to realize a circuit for processing, and it is specifically hard to control a detailed portion where the delicate difference of luminance.

In the image display device of Japanese Patent Publication No. H5-88197 and Japanese Patent Publication No. 2008-111877, although the total contrast ratio is improved by using the two LCD panels, the contrast ratio for a peak values such as a point or a line of high luminance is not improved. As a result, it is hard to control the property of gray level conversion, and it is impossible to reproduce the dynamic range of the natural image.

FIG. 3 is a view showing a camera photographing and a gray level property of an image display device according to the related art.

Regarding the reproduction of the dynamic range of the natural image, as shown in FIG. 3, when the image of the image display device is taken with a camera, a middle luminance region is enlarged due to limitations at a high luminance region and a low luminance region because the camera has a lower dynamic range than an eye of a human. As a result, the image is taken such that the dynamic range of a desired portion is enlarged. When the input image is quantized with 8 bits, the high luminance region has a state where the limitation is applied because a contrast ratio of the middle luminance region is strengthened. Since the information of the high luminance region is missed during photographing, the high luminance region may not be reproducible and only the white or only the black may be displayed.

A gray level conversion based on the gamma characteristics is integrated as broken lines approximation in the image display device of the Japanese Patent Publication No. H5-88197 and the International Patent Publication No. WO 2007/108183. Accordingly, the gray level property does not have a linearity at a black region (i.e., a low luminance region). In addition, color reproducibility of a dark image is reduced, and reproduction of the image is not perfect. When a gamma is approximated by the broken lines (e.g., a gradation where a luminance value gradually increases by a predetermined increment is displayed), a relation of an input luminance and an output luminance is expressed as a straight line before and after an inflection point of the broken lines. Since a slope of the gamma is changed at the inflection point, a border line of a color is detected by an eye of a human.

Specifically, in International Patent Publication No. WO 2007/108183, it is not easy to realize a circuit for processing, and a fabrication cost increases due to a plurality of circuits according to the number of the gammas.

SUMMARY OF THE INVENTION

Accordingly, the present invention is directed to an image display method and an image display device that substantially obviate one or more of the problems due to limitations and disadvantages of the related art.

An advantage of the present invention is to provide an image display method where a black-and-white image is generated by processing an RGB image.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a method of displaying an image using an image display device including a front LCD panel and a rear LCD panel overlapping each other includes: displaying an RGB image in the front LCD panel; generating a black-and-white image having a luminance value adjusted by a pixel by signal-processing the RGB image; and displaying the black-and-white image in the rear LCD panel.

In another aspect of the present invention, an image display device including a front LCD panel and a rear LCD panel overlapping each other includes: an LCD controller signal-processing an RGB image and supplying the signal-processed RGB image to the front LCD panel; and an LV controller generating a black-and-white image having a luminance value adjusted by a pixel by signal-processing the RGB image and supplying the black-and-white image to the rear LCD panel.

In another aspect of the present invention, a method of displaying an image using an image display device including a front LCD panel and a rear LCD panel overlapping each other includes: displaying an RGB image in the front LCD panel; generating an LUT output image having a luminance value by converting a gray level of a first image based on the RGB image with a look-up table where a correlation of the luminance value before and after a gray level conversion is registered; and displaying a black-and-white image based on the LUT output image in the rear LCD panel, wherein when a luminance value of a pixel of the first image is equal to or greater than a first threshold value, the correlation is set such that the luminance value of the pixel is replaced with a first luminance value, and wherein when the luminance value of the pixel of the first image is equal to or greater than a second threshold value greater than the first threshold value, the correlation is set such that the luminance value of the pixel is replaced with a maximum luminance value.

In another aspect of the present invention, an image display device including a front LCD panel and a rear LCD panel overlapping each other includes: an LCD controller signal-processing an RGB image and supplying the signal-processed RGB image to the front LCD panel; and an LV controller including a look-up table that generates an LUT output image having a luminance value by converting a gray level of a first image based on the RGB image and supplying a black-and-white image based on the LUT output image to the rear LCD panel, a correlation of the luminance value before and after a gray level conversion registered in the look-up table, wherein when a luminance value of a pixel of the first image is equal to or greater than a first threshold value, the correlation is set such that the luminance value of the pixel is replaced with a first luminance value, and wherein when the luminance value of the pixel of the first image is equal to or greater than a second threshold value greater than the first threshold value, the correlation is set such that the luminance value of the pixel is replaced with a maximum luminance value.

In another aspect of the present invention, a method of displaying an image using an image display device including a front LCD panel and a rear LCD panel overlapping each other includes: displaying an RGB image in the front LCD panel; generating a black-and-white image having a luminance value by converting a gray level of an LUT input image based on the RGB image with a look-up table where a correlation of the luminance value before and after a gray level conversion is registered; and displaying the black-and-white image in the rear LCD panel, wherein the correlation is obtained: by calculating a correction coefficient from a measured value of an output luminance value of the rear LCD panel where a measuring point between 0 to a maximum luminance value is used as an input luminance value and an ideal value of the output luminance value where the measuring point is used as the input luminance value; and by normalizing the correction coefficient with the maximum luminance value.

In another aspect of the present invention, a method of displaying an image using an image display device including an LCD panel includes: generating an LUT output image by converting a gray level of an LUT input image based on the RGB image with a look-up table where a correlation of the luminance value before and after a gray level conversion is registered; and displaying the LUT output image in the LCD panel, wherein the correlation is obtained: by calculating a correction coefficient from a measured value of an output luminance value of the LCD panel where a measuring point between 0 to a maximum luminance value is used as an input luminance value and an ideal value of the output luminance value where the measuring point is used as the input luminance value; and by normalizing the correction coefficient with the maximum luminance value.

In another aspect of the present invention, an image display device including a front LCD panel and a rear LCD panel overlapping each other includes: an LCD controller signal-processing an RGB image and supplying the signal-processed RGB image to the front LCD panel; and an LV controller including a look-up table that generates a black-and-white image having a luminance value by converting a gray level of an LUT input image based on the RGB image and supplying the black-and-white image to the rear LCD panel, a correlation of the luminance value before and after a gray level conversion registered in the look-up table, wherein the correlation is obtained: by calculating a correction coefficient from a measured value of an output luminance value of the rear LCD panel where a measuring point between 0 to a maximum luminance value is used as an input luminance value and an ideal value of the output luminance value where the measuring point is used as the input luminance value; and by normalizing the correction coefficient with the maximum luminance value.

In another aspect of the present invention, an image display device includes: a look-up table generating an LUT output image by converting a gray level of an LUT input image based on the RGB image, a correlation of the luminance value before and after a gray level conversion registered in the look-up table where; and an LCD panel displaying the LUT output image, wherein the correlation is obtained: by calculating a correction coefficient from a measured value of an output luminance value of the LCD panel where a measuring point between 0 to a maximum luminance value is used as an input luminance value and an ideal value of the output luminance value where the measuring point is used as the input luminance value; and by normalizing the correction coefficient with the maximum luminance value.

In another aspect of the present invention, a method of displaying an image using an image display device including a front LCD panel and a rear LCD panel overlapping each other includes: displaying an RGB image in the front LCD panel; generating a high luminance region expansion image by locally signal-processing one of a peak and an edge of a high luminance region of a first image based on the RGB image and by expanding the high luminance region; and displaying a black-and-white image based on the high luminance region expansion image in the rear LCD panel.

In another aspect of the present invention, an image display device including a front LCD panel and a rear LCD panel overlapping each other includes: an LCD controller signal-processing an RGB image and supplying the signal-processed RGB image to the front LCD panel; and an LV controller including a high luminance region expander generating a high luminance region expansion image by locally signal-processing one of a peak and an edge of a high luminance region of a first image based on the RGB image and by expanding the high luminance region and supplying a black-and-white image based on the high luminance region expansion image to the rear LCD panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 11A, 11B, 11C and 11D are views showing an experimental result when a high luminance region expansion process is applied to an image display device according to a first embodiment of the present invention;

FIG. 12 is a block diagram showing an LV controller of an image display device according to a second embodiment of the present invention;

FIG. 15 is a block diagram showing a data replacer of an image display device according to a second embodiment of the present invention;

FIGS. 16A, 16B, 16C and 16D are views showing an experimental result when a high band is replaced with a high luminance region data in an image display device according to a second embodiment of the present invention;

FIGS. 17A, 17B, 17C and 17D are views showing an experimental result when a high band is replaced with an image processed by a low pass filter in an image display device according to a second embodiment of the present invention;

FIG. 18 is a block diagram showing an LV controller of an image display device according to a third embodiment of the present invention;

FIG. 21 is a view showing an operation of a selector of an image display device according to a third embodiment of the present invention;

FIGS. 22A, 22B, 22C and 22D are views showing an experimental result of an image display device according to a third embodiment of the present invention;

FIGS. 23A, 23B, 23C and 23D are views showing a magnified experimental result of an image display device according to a third embodiment of the present invention;

FIG. 24 is a block diagram showing an LV controller of an image display device according to a fourth embodiment of the present invention;

FIGS. 26A and 26B are views showing a setting of a look-up table of an image display device according to a fourth embodiment of the present invention;

FIG. 27 is a graph showing a property of a gray level conversion of an LV controller of an image display device according to a fourth embodiment of the present invention;

FIGS. 29A, 29B, 29C and 29D are views showing a magnified experimental result of an image display device according to a fourth embodiment of the present invention;

FIG. 30 is a block diagram showing an LV controller of an image display device according to a fifth embodiment of the present invention;

FIGS. 33A and 33B are views showing a setting of a look-up table of an image display device according to a fifth embodiment of the present invention;

FIG. 34 is a graph showing a property of a gray level conversion of an LV controller of an image display device according to a fifth embodiment of the present invention;

FIGS. 35A, 35B, 35C and 35D are views showing an experimental result of an image display device according to a fifth embodiment of the present invention;

FIGS. 36A, 36B, 36C and 36D are views showing a magnified experimental result of an image display device according to a fifth embodiment of the present invention;

FIGS. 37A, 37B, 37C and 37D are histograms with respect to a luminance value of an experimental result image according to fourth and fifth embodiments of the present invention;

FIGS. 44A, 44B, 44C and 44D are views showing a magnified experimental result of an image display device according to a seventh embodiment of the present invention;

FIG. 45 is a view showing an edge peak process in an image display device according to an eighth embodiment of the present invention;

FIG. 46 is a flow chart showing an edge hold process in an image display device according to an eighth embodiment of the present invention;

FIGS. 47A, 47B, 47C and 47D are views showing an experimental result of an image display device according to an eighth embodiment of the present invention.

DETAILED DESCRIPTION OF THE ILLUSTRATED EMBODIMENTS

Reference will now be made in detail to embodiments of the present invention, examples of which are illustrated in the accompanying drawings. The same reference numbers may be used throughout the drawings to refer to the same or like parts.

Figure 4:
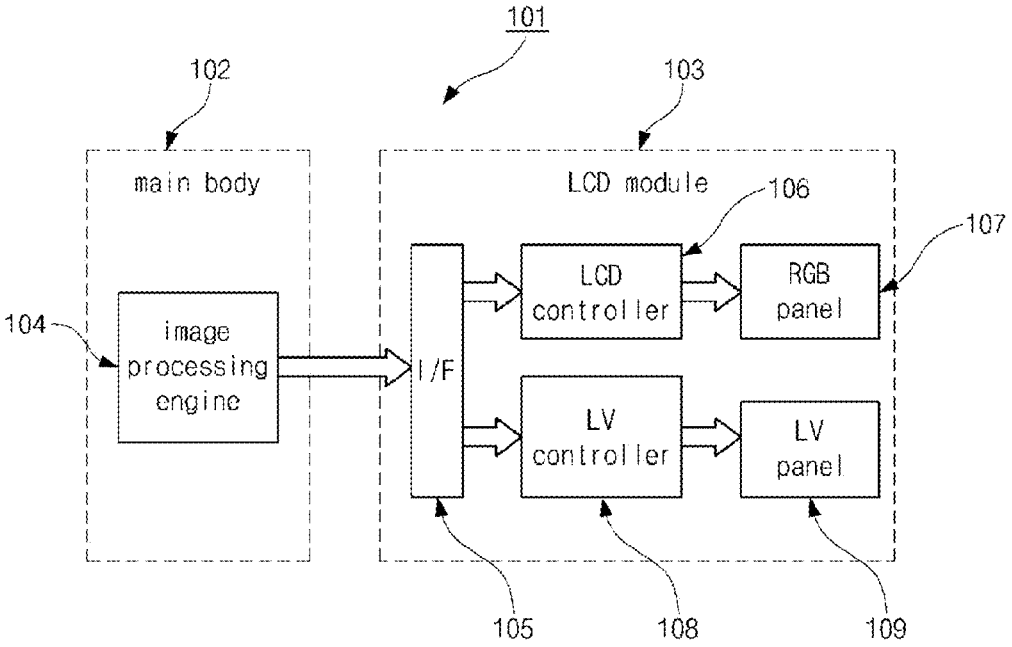
FIG. 4 is a block diagram showing an image display device according to a first embodiment of the present invention.

FIG. 4 is a block diagram showing an image display device according to a first embodiment of the present invention.

In FIG. 4, an image display device 101 includes a main body 102 and a liquid crystal display (LCD) module 103. The main body 102 includes an image processing engine 104, and the LCD module 103 includes an interface (I/F) 105, an LCD controller 106, an RGB panel 107, an LV (light valve) controller 108 and an LV panel 109.

The image processing engine 104 of the main body 102 generates an RGB image and the RGB image is transmitted to the LCD module 103.

The interface 105 receives the RGB image generated by the image processing engine 104 and transmits the RGB image to the LCD controller 106 and the LV controller 108.

The LCD controller 106 receives the RGB image from the interface 105, processes the RGB image and transmits the RGB image to the RGB panel 107.

The RGB panel 107 receives the RGB image from the LCD controller 106 and displays the RGB image.

The LV controller 108 receives the RGB image from the interface 105 and generates a gray scale image which has only light and shade of a white to a black by processing the RGB image. In addition, the LV controller 108 generates an LV image (a black-and-white image of a gray scale of an adjusted luminance) by adjusting a luminance of the gray scale image and transmits the LV image to the LV panel 109.

The LV panel 109 receives the LV image from the LV controller 108 and displays the LV image.

Figure 5:
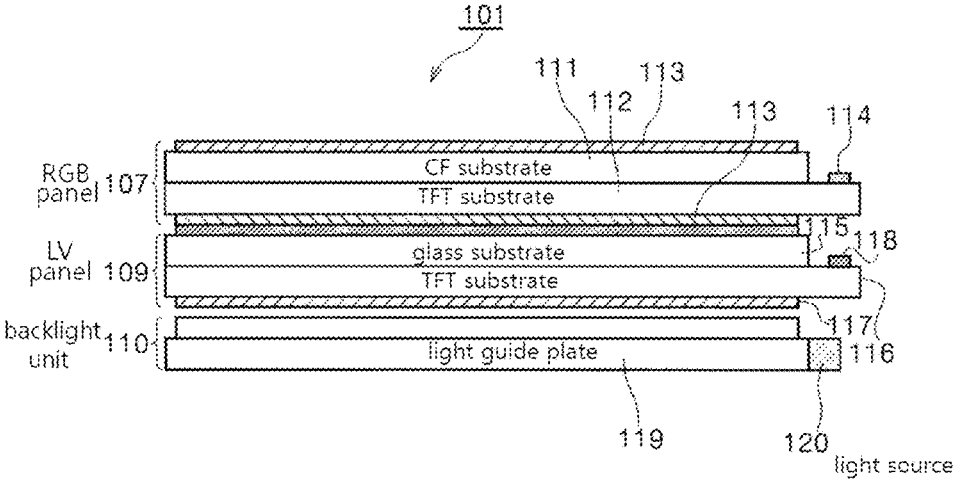
FIG. 5 is a cross-sectional view showing an image display device according to a first embodiment of the present invention.

FIG. 5 is a cross-sectional view showing an image display device according to a first embodiment of the present invention.

In FIG. 5, an image display device 101 includes an RGB panel 107, an LV panel 109 and a backlight unit 110.

The RGB panel 107 includes a CF (color filter) substrate 111, a TFT (thin film transistor) substrate 112, a polarizing film 113 and a driving integrated circuit (IC) 114. The CF substrate 111 includes a black matrix, a color filter layer of red, green and blue color filters and a common electrode. The TFT substrate 112 includes a TFT and a pixel electrode. The polarizing film 113 polarizes a light from the backlight unit. The driving IC 114 drives the TFT substrate 112 so that an RGB image processed by an LCD controller 106 (of FIG. 4) can be displayed in the RGB panel 107.

The LV panel 109 includes a glass substrate 115, a TFT substrate 116, a polarizing film 117 and a driving IC 118. Although the glass substrate 115 corresponds to the CF substrate 111 of the RGB panel 107, the glass substrate 115 does not include a black matrix and a color filter layer. As a result, the LV panel 109 displays an LV image which is a gray scale image having only light and shade of a white to a black. The TFT substrate 116 and the polarizing film 117 are the same as the TFT substrate 112 and the polarizing film 113, respectively, of the RGB panel 107. The driving IC 118 drives the TFT substrate 116 so that the LV image processed by an LV controller 108 (of FIG. 4) can be displayed in the LV panel 109.

When the RGB panel 107 and the LV panel 109 are viewed at a front direction, the RGB panel 107 and the LV panel 109 overlap each other such that a pixel of the RGB panel 107 corresponds to a pixel of the LV panel 109.

The backlight unit 110 includes a light guide plate 119 and a light source 120. The light source 120 emits a light to the light guide plate 119. The light guide plate 119 transmits the light emitted from the light source 120 to the LV panel 109 by refraction. The light emitted from the light guide plate 119 sequentially passes through the LV panel 109 and the RGB panel 107 overlapping each other and reaches an eye of a human watching the image display device 101.

Figure 6:
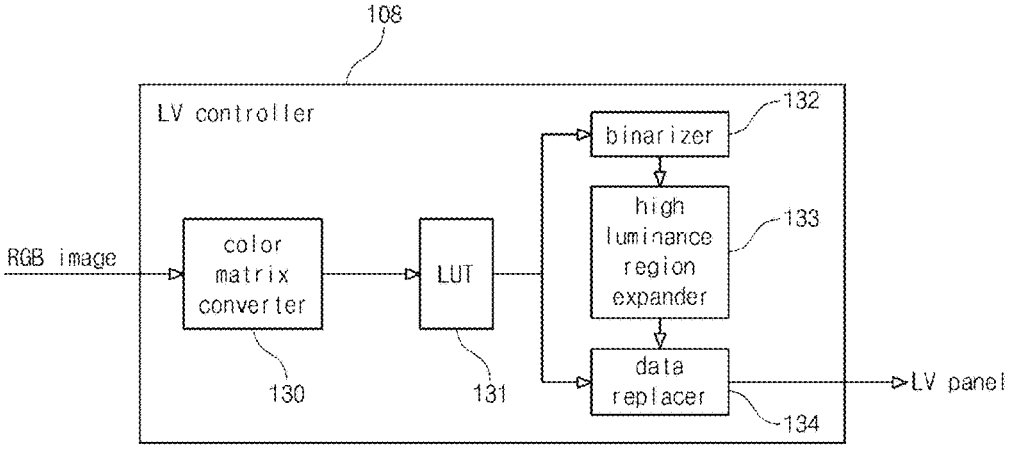
FIG. 6 is a block diagram showing an LV controller of an image display device according to a first embodiment of the present invention.

FIG. 6 is a block diagram showing an LV controller of an image display device according to a first embodiment of the present invention.

In FIG. 6, an LV controller 108 includes a color matrix converter 130, a look-up table (LUT) 131, a binarizer 132, a high luminance region expander 133 and a data replacer 134.

The color matrix converter 130 receives an RGB image from the image processing engine 104 through the interface 105 and performs a color matrix conversion for the RGB image. When luminances of red, green and blue colors are input, a luminance value Y of a gray scale is obtained according to the following equation through the color matrix conversion.

$$Y=R\times c1+G\times c2+B\times c3,$$

$$c1+c2+c3=1,$$

where c1, c2, c3 are real numbers

As a result, the color matrix converter 130 generates an LUT input image of a gray scale which has only light and shade of a white to a black from the RGB image. The color matrix converter 130 transmits the LUT input image to the look-up table 131.

Figure 1:
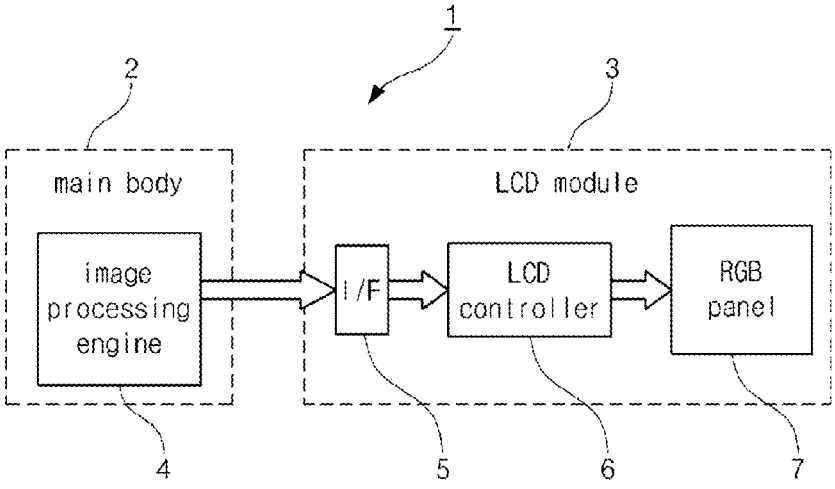
FIG. 1 related art
FIG. 1 is an image display device including one liquid crystal panel according to the related art.
Figure 2:
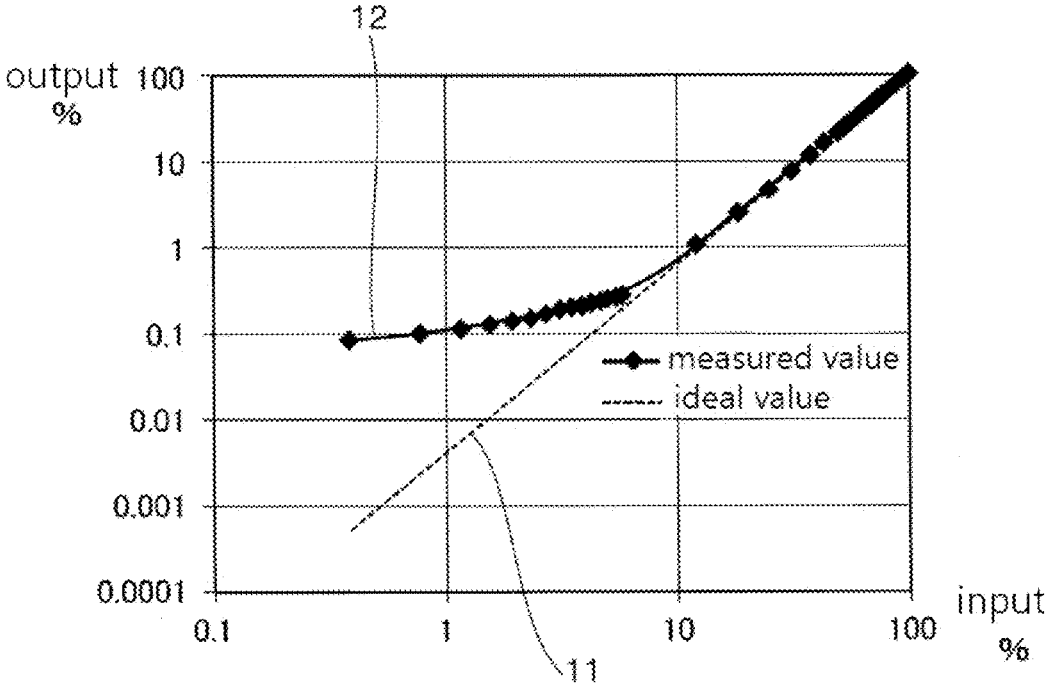
FIG. 2 related art
FIG. 2 is a graph showing an output luminance with respect to an input luminance of an image display device according to the related art.
Figure 3:
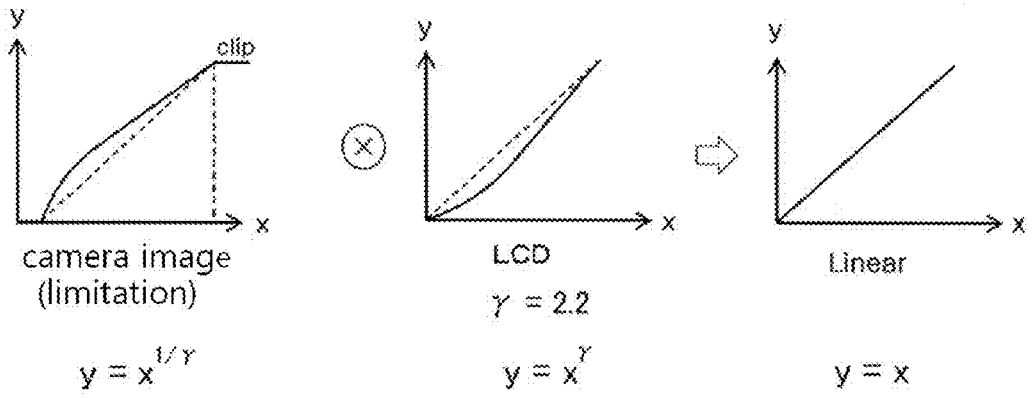
FIG. 3 related art
FIG. 3 is a view showing a camera photographing and a gray level property of an image display device according to the related art.

The look-up table 131 receives the LUT input image from the color matrix converter 130. The look-up table 131 generates an LUT output image through a gray level conversion of the LUT input image. As shown in FIG. 2, as a gray level of an image data decreases, an output luminance becomes greater than an ideal value and a displayed image becomes brighter. As a result, the real image displayed by the LCD panel has a luminance greater than an ideal value such that the real image is brightly displayed like a white. An input luminance value where the ideal value and the real value begin to be separated from each other may be set as a first threshold value.

For each pixel of the LUT input image, the look-up table 131 converts the input luminance value equal to or greater than the first threshold value into a maximum luminance value and converts the input luminance value smaller than the first threshold value into one of 0 to 'the maximum luminance value-1' according to a predetermined function. For example, when the luminance value is expressed with 8 bits, the look-up table 131 may convert the input luminance value equal to or greater than the first threshold value into 255 and may convert the input luminance value smaller than the first threshold value into one of 0 to 254.

Figure 7A:
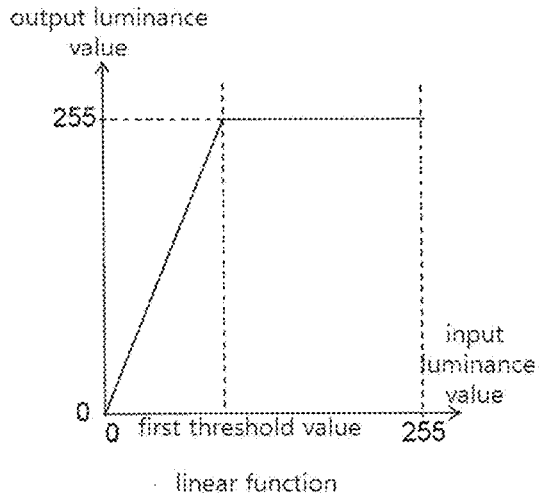
FIGS. 7A and 7B are graphs showing a property of a gray level conversion of an LV controller of an image display device according to a first embodiment of the present invention.
Figure 7B:
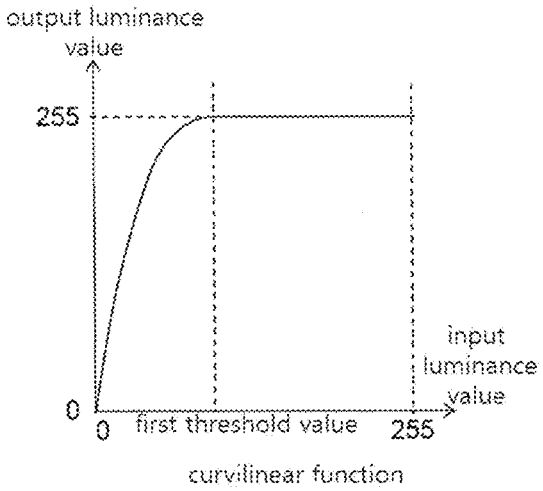

FIGS. 7A and 7B are graphs showing a property of a gray level conversion of an LV controller of an image display device according to a first embodiment of the present invention.

In FIGS. 7A and 7B, a luminance value is expressed with 8 bits. In FIG. 7A, the look-up table 131 is set such that the input luminance value equal to or greater than the first threshold value is converted into 255, and the input value smaller than the first threshold value is converted into one of 0 to 254 according to a linear function. In FIG. 7B, the look-up table 131 is set such that the input luminance value equal to or greater than the first threshold value is converted into 255, and the input value smaller than the first threshold value is converted into one of 0 to 254 according to a curvilinear function.

When the luminance value is expressed with 8 bits, 32 may be set as the first threshold value. In another embodiment any number different from 32 may be set as the first threshold value. It is possible to emphasize a gray level display of 0 to the first threshold value of the input luminance by setting most of the input luminance converted into the maximum luminance value.

In addition, a shape of the function according to which the input luminance value smaller than the first threshold value is converted into one of 0 to 'the maximum luminance value-1' is not limited to FIGS. 7A and 7B. The shape of the function may be obtained by an actual measurement of an experiment.

A correlation between the input luminance value and the output luminance value (i.e., luminance values before and after the gray level conversion) may be preliminarily registered in the look-up table 131, and an additional central processing unit (CPU) may convert the input luminance value into the output luminance value with reference to the correlation registered in the look-up table 131.

The look-up table 131 transmits the LUT output image to the binarizer 132 and the data replacer 134.

The binarizer 132 receives the LUT output image generated by the LUT 131 and generates a binary data by binarizing the luminance value of each pixel of the LUT output image. For example, when the luminance value of each pixel is equal to or greater than a threshold value (i.e., when the pixel belongs to the high luminance region (bright region)), the binarizer 132 may set a binary data value of the corresponding pixel as 1. When the luminance value of each pixel is smaller than the threshold value (i.e., when the pixel belongs to the low luminance region (dark region)), the binarizer 132 may set the binary data value of the corresponding pixel as 0. As a result, the binarizer 132 may generate the binary data from the LUT output image. The binarizer 132 transmits the binary data to the high luminance region expander 133.

The high luminance region expander 133 receives the binary data generated by the binarizer 132 and expands a high luminance region of the binary data. As a result, the pixels having the binary data of 1 and belonging to the high luminance region are expanded.

Figure 8A:
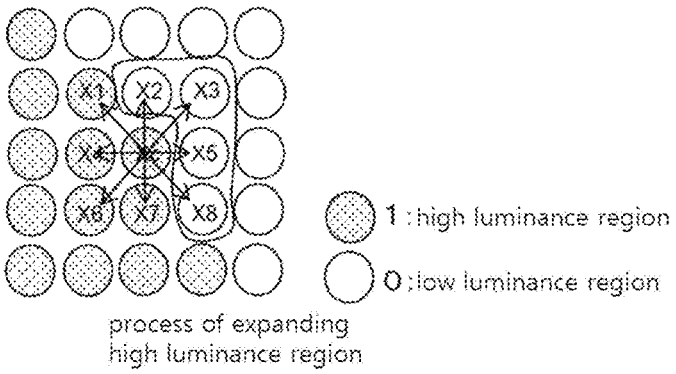
FIGS. 8A and 8B are views showing a high luminance region expansion process of an image display device according to a first embodiment of the present invention.
Figures 8B, 9:
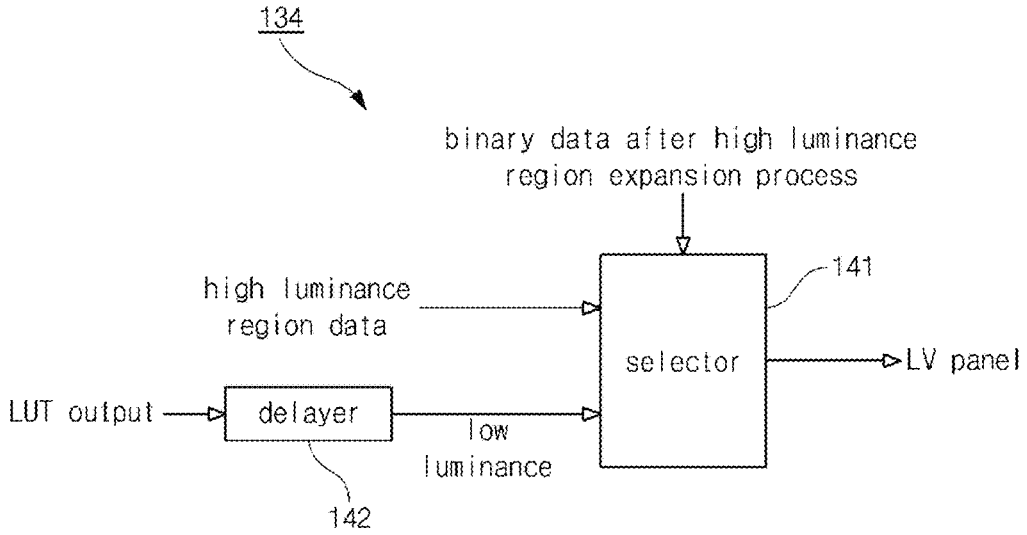
FIG. 9 is a block diagram showing a data replacer of an image display device according to a first embodiment of the present invention.

FIGS. 8A and 8B is a view showing a high luminance region expansion process of an image display device according to a first embodiment of the present invention.

FIG. 8A illustrates a high luminance region expansion process performed in the high luminance region expander 133. In FIG. 8A, a high luminance region expansion process may be performed for each binary data corresponding to each pixel. For example, a binary data corresponding to an object pixel which is presently processed may be set as Xc, and binary data corresponding to pixels adjacent to the object pixel may be set as X1 to X8 from a top left along a clockwise direction. A hatched pixel corresponds to a high luminance region, and an unhatched pixel corresponds to a low luminance region. For example, X1, X4, X6 and X7 may correspond to the high luminance region, and X2, X3, X5 and X8 may correspond to the low luminance region.

FIG. 8B shows a program illustrating a sequence of the high luminance region expansion process. In FIG. 8B, it is judged whether Xc is 1 or not (i.e., whether Xc belongs to the high luminance region or not). When Xc belongs to the high luminance region as in FIG. 8A, the binary data Xi having 0 (i.e., belonging to the low luminance region) among the binary data X1 to X8 of the adjacent pixels is changed into 1 (i.e., belong to the high luminance region). As a result, when the object pixel belongs to the high luminance region at an edge which is a border of the high and low luminance regions and the pixel adjacent to the object pixel belongs to the low luminance region, a periphery of the object pixel is changed into the high luminance region by one pixel. The high luminance region expander 133 generates a high luminance region expansion binary data from the binary data through the above-mentioned process.

In the first embodiment, the high luminance region expansion process is sequentially performed for each pixel of a horizontal line of the LUT output image. When the pixel belonging to the low luminance region is changed to belong to the high luminance region through the high luminance region expansion process, the high luminance region expansion process is not performed to the pixel changed to belong to the high luminance region by the high luminance region expansion process. The judgment of the high luminance region expansion process does not use the data having a possibility of change during or after the high luminance region expansion process but uses the binary data input to the high luminance region expander 133. As a result, a limitless expansion of the high luminance region by repetition of the high luminance region expansion process for each pixel may be prevented.

The high luminance region expander 133 transmits the high luminance region expansion binary data to the data replacer 134.

The data replacer 134 receives the high luminance region expansion binary data generated by the high luminance region expander 133 and the LUT output image outputted from the look-up table 131, and generates the LV image which is finally displayed in the LV panel 109 by replacing the luminance value of each pixel of the LUT output image with a specific value according to the high luminance region expansion binary data. The data replacer 134 transmits the LV image to the LV panel 109.

FIG. 9 is a block diagram showing a data replacer of an image display device according to a first embodiment of the present invention.

In FIG. 9, the data replacer 134 includes a selector 141 and a delayer 142. The selector 141 receives the high luminance region expansion binary data from the high luminance region expander 133. When a pixel has the high luminance region expansion binary data of 1 (i.e., when the pixel already belong to the high luminance region before the high luminance region expansion process or when the pixel belongs to the high luminance region after the high luminance region expansion process), the selector 141 replaces the luminance value of the corresponding pixel of the LUT output image with a high luminance region data (i.e., the luminance value representing the high luminance region). When the pixel has the high luminance region expansion binary data of 0 (i.e., when the pixel belongs to the low luminance region after the high luminance region expansion process), the selector 141 does not replace the luminance value of the corresponding pixel of the LUT output image. The LUT output image where the luminance value of the high luminance region expansion binary data is replaced with the high luminance region data is transmitted to the LV panel 109 as the LV image.

The delayer 142 delays a timing where the LUT output image outputted from the look-up table 131 reaches the selector 141 by a time corresponding to the binary process and the high luminance region expansion process.

A sequence of displaying an image according to the first embodiment will be illustrated hereinafter.

As shown in FIG. 4, the image processing engine 104 of the main body 102 generates the RGB image displayed by the image display device 101 and transmits the RGB image to the LCD module 103.

The LCD module 103 receives the RGB image through the interface 105, and the interface 105 transmits the RGB image to the LCD controller 106 and the LV controller 108.

The LCD controller 106 receives the RGB image from the interface 105 and processes the RGB image to transmit the RGB image to the RGB panel 107.

The RGB panel 107 displays the RGB image received from the LCD controller 106.

The LV controller 108 as the LCD controller 106 receives the RGB image from the interface 105.

The color matrix converter 130 of the LV controller 108 of FIG. 6 performs the color matrix conversion for the received RGB image and generates the LUT input image of a gray scale which has only light and shade of a white to a black to transmit the LUT input image to the look-up table 131.

The look-up table 131 receives the LUT input image from the color matrix converter 130. The correlation between luminance values before and after the gray level conversion is registered in the look-up table 131. The look-up table 131 performs the gray level conversion for each pixel of the received LUT input image to generate the LUT output image. The look-up table 131 transmits the generated LUT output image to the binarizer 132 and the data replacer 134.

The binarizer 132 receives the LUT output image generated by the look-up table 131 and generates the binary data by binarizing the luminance value of each pixel. When the luminance value of each pixel is equal to or greater than a threshold value, the binarizer 132 judges that the corresponding pixel belongs to the high luminance region and sets a binary data value of the corresponding pixel as 1. When the luminance value of each pixel is smaller than the threshold value, the binarizer 132 judges that the corresponding pixel belongs to the low luminance region and sets the binary data value of the corresponding pixel as 0. The binarizer 132 transmits the binary data to the high luminance region expander 133.

The high luminance region expander 133 receives the binary data generated by the binarizer 132 and performs the high luminance region expansion process for the binary data to generate the high luminance region expansion binary data. When the object pixel has the binary data of 1 and the adjacent pixel has the binary data of 0, the high luminance region expansion binary data is generated for each pixel by replacing the binary data value of the adjacent pixel with 1. The high luminance region expander 133 transmits the generated high luminance region expansion binary data to the selector 141 of the data replacer 134.

The selector 141 of FIG. 9 receives the high luminance region expansion binary data, the high luminance region data and the delayed LUT output image. The delayer 142 delays the timing where the LUT output image reaches the selector 141 by a time corresponding to the binary process and the high luminance region expansion process. As a result, when the selector 141 performs the luminance value replacement process for the LUT output image based on the high luminance region expansion binary data value, the arrival timing of the LUT output image is adjusted such that the LUT output image timely corresponding to the high luminance region expansion binary data is supplied as an input.

The selector 141 replaces the luminance value of each pixel of the LUT output image with a specific value according to the high luminance region expansion binary data of the corresponding pixel. When the high luminance region expansion binary data of the corresponding pixel is 1, the selector 141 generates the LV image by replacing the luminance value of the corresponding pixel of the LUT output image with the luminance value representing the high luminance region.

In the LV image, accordingly, the high luminance region data is definitely supplied to the pixel belonging to the expanded high luminance region including the pixel originally belonging to the high luminance region and the pixel judged to belong to the high luminance region after the high luminance region expansion process, and the corresponding pixel is displayed as the high luminance region in the LV panel 109.

The RGB image is simultaneously displayed in the RGB panel 107 through the LCD controller 106 as the RGB image and in the LV panel 109 through the LV controller 108 as the LV image of a gray scale which has only light and shade of a white to a black.

Since the RGB panel 107 as a front LCD panel and the LV panel 109 as a rear LCD panel overlap each other as shown in FIG. 5, the light emitted from the light source 120 through the backlight unit 110 sequentially passes the LV panel 109 where the LV image based on the RGB image is displayed and the RGB panel 107 where the RGB image is displayed to reach an eye of a human. While the light passes through the LV panel 109 and the RGB panel 107, the color and the luminance of the light are controlled by the CF substrate 111 of the RGB panel 107 and the liquid crystal layers (not shown) of each of the LV panel 109 and the RGB panel 107.

Since the luminance may be individually controlled by each of the LV panel 109 and the RGB panel 107, the contrast ratio may be minutely controlled.

The light emitting from the backlight unit 110 and reaching an eye of a human through the LV panel 109 and the RGB panel 107 has a transmittance obtained by multiplication of a transmittance of the LV panel 109 and a transmittance of the RGB panel 107. To prevent a black lifting of a dark region of an image, the look-up table 131 performs the gray level conversion for the image of a gray scale so that the transmittance of the dark region of the LV panel 109 can be reduced. As a result, a black lifting is prevented by changing the luminance value of the LV panel 109 without change of the luminance value of the RGB panel 107 displaying the RGB image.

Here, when the RGB panel 107 and the LV panel 109 are viewed at a front direction, the corresponding pixels of the RGB panel 107 and the LV panel 109 overlap each other. For example, the vertical straight line having a width of one pixel may be displayed in the image display device 101. By the binarizer 132, the pixels corresponding to the vertical straight line may be judged to belong to the high luminance region and the pixels adjacent to the vertical straight line may be judged to belong to the low luminance region. Since the high luminance region expander 133 performs the high luminance region expansion process so that the adjacent pixels can belong to the high luminance region, the pixels originally belonging to the low luminance region may be displayed as the high luminance region in the LV panel 109. When the image display device 101 is viewed at a diagonal direction instead of a front direction, the vertical straight line displayed in the RGB panel 107 overlaps the adjacent pixels of the high luminance region of the LV panel 109 which originally belongs to the low luminance region. As a result, when the image display device 101 is viewed at a diagonal direction, the vertical straight line is not displayed as a thinner line or a double line with a luminance the same as that of the front direction. In addition, the vertical straight line is normally displayed without a color distortion.

Each process, especially the high luminance region expansion process is performed for each pixel. Since the high luminance region is judged by a pixel and the high luminance region expansion process is performed based on a shape of the original image, a shape of the high luminance region after expansion may be delicately determined by reflecting the original image.

Since the rear LCD panel adjacent to the backlight unit 110 is formed as the LV panel 109, the series of the processes does not require a complicated structure and a circuit for the series of the processes has a simple structure.

In addition, the values of the look-up table 131 may be determined by off-line before the look-up table 131 is integrated and only the memory may be integrated in the image display device 101. Accordingly, the property of the gray level conversion may be easily obtained.

The LV panel 109 displays the LV image received from the LV controller 108 as shown in FIG. 5. Since the LV image is based on the image of a gray scale, the LV panel 109 does not require some elements of a typical LCD panel such as a color filter layer. Accordingly, the fabrication cost of the image display device 101 may be reduced.

FIGS. 10A, 10B, 10C and 10D are views showing an experimental result when a high luminance region expansion process is not applied to an image display device according to a first embodiment of the present invention, and FIGS. 11A, 11B, 11C and 11D are views showing an experimental result when a high luminance region expansion process is applied to an image display device according to a first embodiment of the present invention.

Figures 10A, 10B, 10C, 10D:
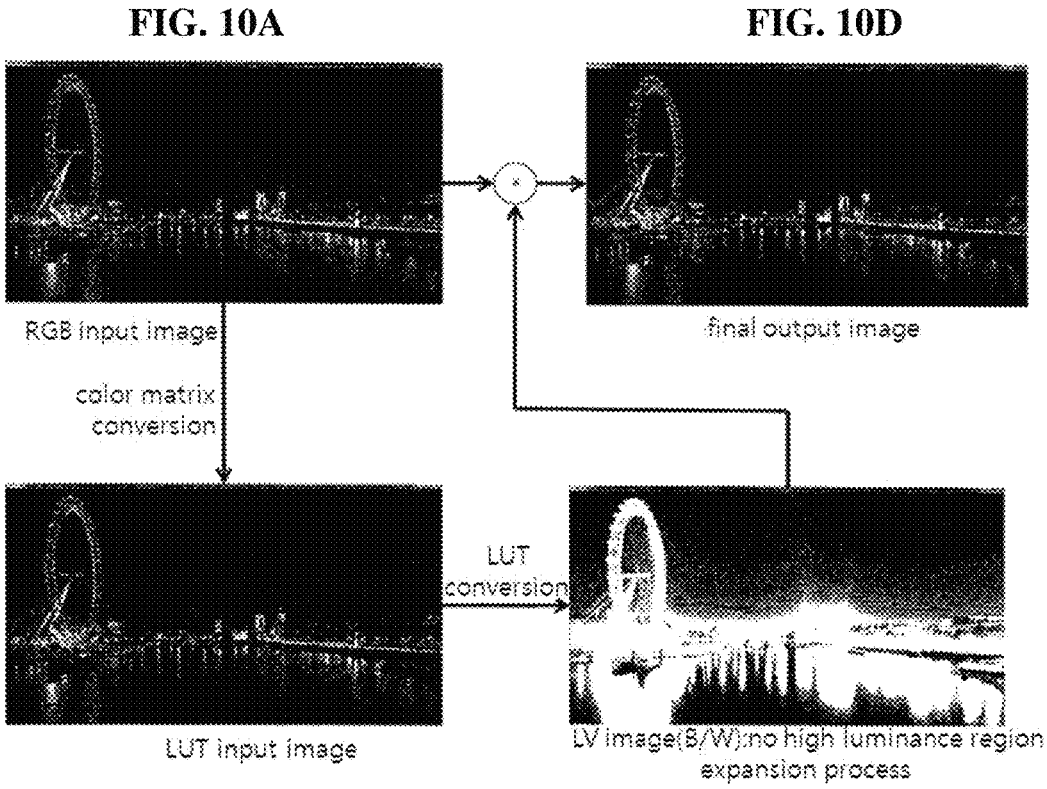
FIGS. 10A, 10B, 10C and 10D are views showing an experimental result when a high luminance region expansion process is not applied to an image display device according to a first embodiment of the present invention.

FIG. 10A shows an RGB image, FIG. 10B shows an LUT input image obtained by performing a color matrix conversion for the RGB image, FIG. 10C shows an LV image obtained by performing an additional process (a binarizing process), and FIG. 10D shows a final output image obtained by overlapping the RGB image of FIG. 10A and the LV image of FIG. 10C. In FIG. 10, a high luminance region expansion process is not performed.

FIG. 11A shows an RGB image the same as FIG. 10A, FIG. 11B shows an LUT input image obtained by performing a color matrix conversion for the RGB image, FIG. 11C shows an LV image obtained by performing an additional process (a binarizing process), and FIG. 11D shows a final output image obtained by overlapping the RGB image of FIG. 11A and the LV image of FIG. 11C. In FIGS. 11A-11D, a high luminance region expansion process is performed.

When FIGS. 10C and 11C are compared, the high luminance region expansion process has a prominent effect especially at the spoke portion of the Ferris wheel. When the final output image of FIG. 11D is viewed in a diagonal direction, a dual image and a color distortion are prevented.

In the first embodiment, the high luminance region expander 133 performs the high luminance region expansion process for the binary data. In another embodiment, a reduction process of a low luminance region may be performed for a binary data. When an object pixel has the binary data of 0 and an adjacent pixel has the binary data of 1, a low luminance region reducer may replace the binary data value of the object pixel with 1 to generate a low luminance region reduction binary data for each pixel. Similarly to the first embodiment, when the low luminance region reduction binary data is 1, the data replacer 134 may replace the luminance value of each pixel with a specific luminance value based on the low luminance reduction binary data. As a result, the same effect as that of the first embodiment using the high luminance region expander 133 may be obtained.

When the high luminance region expander 133 or the low luminance region reducer performs the high luminance region expansion process or the low luminance region reduction process for the binary data, a size of the expanded high luminance region or the reduced low luminance region may be determined as one pixel to several pixels according to a distance between the front RGB panel 107 and the rear LV panel 109 and/or a size of the image. When two LCD panels are disposed to overlap each other, a diffuser may be interposed between the two LCD panels for preventing a moiré generated by misalignment. Since the distance between the two LCD panels increases by the diffuser, a process range may be enlarged according to the increased distance.

For example, in the high luminance region expansion process, when the object pixel has the binary data of 1, the distance from the object pixel to the adjacent pixel is determined and the adjacent pixel within the determined distance having the binary data of 0 may be replaced with 1. Although the high luminance region expansion process is performed for 8 pixels adjacent to the object pixel in the first embodiment, the high luminance region expansion process may be performed for 24 pixels (further separated by 1 pixel) adjacent to the object pixel in another embodiment.

The process for each pixel may be performed in series or in parallel in each of the look-up table 131, the binarizer 132, the high luminance region expander 133 and the data replacer 134.

The process time in the LV controller 108 may be longer than the process time in the LCD controller 106. Accordingly, a delay circuit for synchronizing the display timings of the LV controller 108 and the LCD controller 106 may be added at a previous stage or a next stage of the LCD controller 106 or in the LCD controller 106.

A second embodiment of the present invention will be illustrated hereinafter. A structure of the second embodiment is the same as a structure of the first embodiment except for the LV controller 208.

FIG. 12 is a block diagram showing an LV controller of an image display device according to a second embodiment of the present invention. The structure of the image display device according to the second embodiment except the LV controller is the same as that according to the first embodiment.

In FIG. 12, an LV controller 208 detects a high band and converts a luminance of a pixel belonging to the high band. The high band corresponds to a portion where a spatial frequency of a luminance of an LUT output image of a gray scale is greater than a reference value and means a state where changes in the luminance value of the image frequently occurs. For example, an image including thin lines densely disposed may be judged as the high band.

When an image having the high band displayed by an image display device 101 using two LCD panels is viewed at a diagonal direction instead of a front direction, the thin lines may not be seen as a straight line due to a relation between adjacent thin lines or may be unnaturally seen due to a color distortion.

The LV controller 208 includes a color matrix converter 130, a look-up table (LUT) 131, a high band detector 251, a data replacer 252 and a low pass filter (LPF) 253.

The color matrix converter 130 and the look-up table 131 are the same as those of the first embodiment. The color matrix converter 130 performs a color matrix conversion to generate an LUT input image of a gray scale and transmits the LUT input image to the look-up table 131. The look-up table 131 performs a gray level conversion for the LUT input image to generate an LUT output image and transmits the LUT output image to the high band detector 251, the data replacer 252 and the low pass filter 253.

The high band detector 251 receives the LUT output image of a gray scale generated by the look-up table 131 and detects a high band. The high band corresponds to a portion where a spatial frequency of a luminance of an LUT output image of a gray scale is greater than a reference value. For example, an image such as a stripe pattern or a check pattern where pixels of a high luminance and pixels of a low luminance are mixed to have a non-uniform luminance may belong to a high band. To detect a high band, the high band detector 251 calculates a variance of a luminance of adjacent pixels of an object pixel for each pixel.

Figure 13:
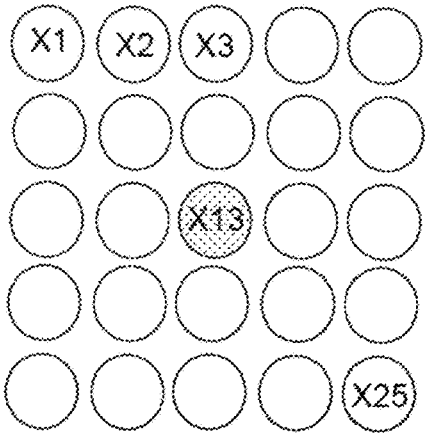
FIG. 13 is a view showing adjacent pixels of an object pixel of an image display device according to a second embodiment of the present invention.

FIG. 13 is a view showing adjacent pixels of an object pixel of an image display device according to a second embodiment of the present invention.

In FIG. 13, luminances of total 25 pixels including horizontal 5 pixels and vertical 5 pixels with respect to an object pixel X13 are used for detecting a high band.

In detection of a high band, for example, an average value and a variance value are calculated according to the following equations, where X13 represents a luminance of the object pixel X13.

Figure 14:
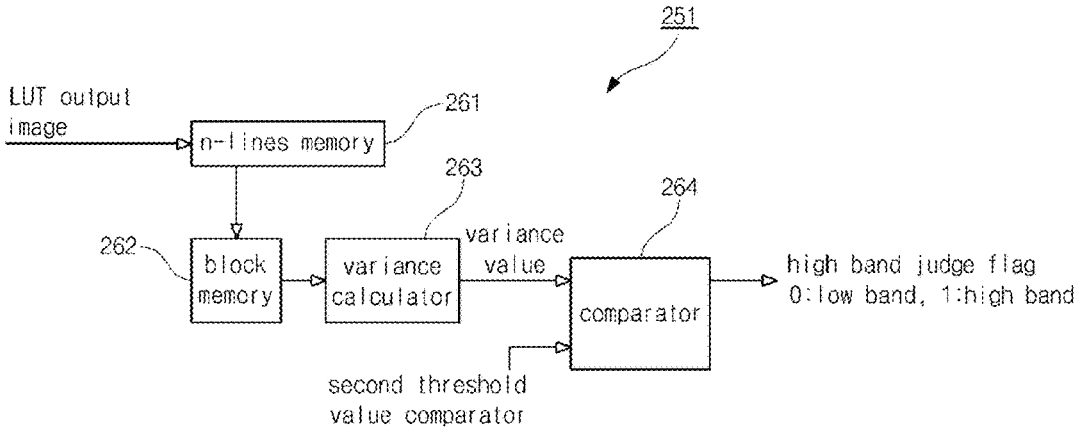
FIG. 14 is a block diagram showing a high band detector of an image display device according to a second embodiment of the present invention.

For the above-mentioned calculation, the high band detector 251 has a structure as shown in FIG. 14.

FIG. 14 is a block diagram showing a high band detector of an image display device according to a second embodiment of the present invention.

In FIG. 14, the high band detector 2251 includes an n-lines memory 261, a block memory 262, a variance calculator 263 and a comparator 264.

The n-lines memory 261 temporarily stores luminance values of pixels in n horizontal lines of an LUT output image generated by the look-up table 131. The block memory stores the luminance values of a block used for the detection of a high band among the luminance values in the n-lines memory 261. The variance calculator 263 calculates a variance value of the luminance values of the pixels adjacent to an object pixel according to the above equation with reference to the luminance values in the block memory 262.

Similarly to the second embodiment, the n-lines memory 261 and the block memory 262 may be formed in a previous stage of the binarizer 132.

The variance calculator 263 transmits the variance value for each pixel to the comparator 264.

The comparator 264 compares the variance value received from the variance calculator 263 with a second threshold value for each pixel. When the variance value is equal to or greater than the second threshold value, the corresponding pixel is judged as a high band to set a high band judge flag of the corresponding pixel as 1. When the variance value is smaller than the second threshold value, the corresponding pixel is not judged as a high band to set the high band judge flag of the corresponding pixel as 0. The comparator 264 transmits the high band judge flag to the data replacer 252.

The low pass filter 253 of FIG. 12 applies a low pass filter process to the LUT output image received from the look-up table 131 and transmits the LUT output image after application of the low pass filter process to the data replacer 252.

The data replacer 252 generates an LV image from the LUT output image received from the look-up table 131 and the LUT output image after application of the low pass filter process received from the low pass filter 253 based on the high band judge flag received from the high band detector 251.

FIG. 15 is a block diagram showing a data replacer of an image display device according to a second embodiment of the present invention.

In FIG. 15, the data replacer 252 includes a first selector 271, a second selector 272, a first delayer 273 and a second delayer 274.

The first selector 271 receives the high band judge flag from the high band detector 251, receives the LUT output image from the look-up table 131 through the first delayer 273, and receives an image displayed in case of a high band from the second selector 272. When a pixel has the high band judge flag of 1 (i.e., a periphery of the corresponding pixel is judged as a high band), the first selector 271 replaces the luminance value of the corresponding pixel of the LUT output image with a luminance value of the image displayed in case of a high band. When the pixel has the high band judge flag of 0 (i.e., when the periphery of the corresponding pixel is not judged as a high band), the first selector 271 does not replace the luminance value of the corresponding pixel of the LUT output image. The LUT output image where the luminance value corresponding to a high band is replaced by the first selector 271 is transmitted to the LV panel 109 as the LV image.

For each pixel, the second selector 272 generates a luminance value used for replacing the luminance of the corresponding pixel of the LUT output image in case of a high band by selection and transmits the luminance value to the first selector 271. For example, the second selector 272 may select an image where a high luminance region expands or a high luminance region data where a luminance value is a maximum by blurring a portion corresponding to a high band and generated from the LUT output image by the low pass filter 253. The high luminance region data may be an image where the high luminance region expands by the binarizer 132 or the high luminance region expander 133 of the first embodiment. The luminance value of outputted from the second selector 272 is determined by a selection signal input to the second selector 272. Although the selection signal has a manual conversion form in the second embodiment, the selection signal may have an automatic conversion form based on a reference judgment in another embodiment.

Similarly to the delayer 142 of the first embodiment, the first and second delayers 273 and 274 synchronizes arrival timings of data input to the first and second delayers 273 and 274.

A sequence of displaying an image according to the second embodiment will be illustrated hereinafter. Since a difference between the first and second embodiments is the LV controller 208, the LV controller 208 will be mainly illustrated.

The color matrix converter 130 of the LV controller 208 of FIG. 12 generates the LUT input image of a gray scale which has only light and shade of a white to a black by performing the color matrix conversion for the received RGB image and transmits the LUT input image to the look-up table 131.

The look-up table 131 receives the LUT input image from the color matrix converter 130. The correlation between luminance values before and after the gray level conversion is registered in the look-up table 131. The look-up table 131 performs the gray level conversion for each pixel of the received LUT input image to generate the LUT output image. The look-up table 131 transmits the generated LUT output image to the high band detector 251, the data replacer 252 and the low pass filter 253.

The n-lines memory 261 of the high band detector 251 of FIG. 14 stores the luminance values of the pixels in the n horizontal lines of the LUT output image received from the look-up table 131.

The block memory 262 cuts the luminance values of the pixels adjacent to the object pixel from the luminance values in the n-lines memory 261 as a block luminance and stores the block luminance.

The variance calculator 263 calculates the variance value of the pixels adjacent to the object pixel with reference to the block memory 262 and transmits the variance value to the comparator 264.

The comparator 264 performs a judgment whether the corresponding pixel belongs to a high band or not by comparing the variance value received from the variance calculator 263 with the second threshold value. When the variance value is equal to or greater than the second threshold value, the comparator 264 judges that the corresponding pixel belongs to a high band and sets a high band judge flag of the corresponding pixel as 1. When the variance value is smaller than the second threshold value, the comparator 264 judges that the corresponding pixel does not belong to a high band and sets the high band judge flag of the corresponding pixel as 0. The comparator 264 transmits the high band judge flag to the data replacer 252.

The low pass filter 253 of FIG. 12 receives the LUT output image from the look-up table 131, generates the LUT output image where a low pass filter process is applied, and transmits the LUT output image where the low pass filter process is applied to the data replacer 252.

The second selector 272 of the data replacer 252 of FIG. 15 selects one of the high luminance region data having a luminance corresponding to the high luminance region and the output image generated from the LUT output image by the low pass filter 253 and transmits the selected one to the first selector 271.

The first selector 271 receives LUT output image from the look-up table 131, and receives the selected data of the high luminance region data having a luminance corresponding to the high luminance region and the output image generated from the LUT output image by the low pass filter 253 from the second selector 272. When the high band flag of the corresponding pixel is 1, the first selector 271 generates the LV image by replacing the luminance value of the corresponding pixel of the LUT output image with the luminance value of the corresponding pixel of the data received from the second selector 272 and transmits the LV image to the LV panel 109.

For the pixel which is judged to belong to the high band after the detection of the high band, one of the high luminance region data or the luminance of the corresponding pixel of the image generated from the LUT output image by the low pass filter 253 may be supplied to the LV panel 109 as the LV image by performing the sequence from the detection of the high band to the generation of the LV image for each pixel and may be displayed by the LV panel 109.

In the second embodiment, an object portion for replacement of a luminance (i.e., a high band) is detected. The portion having a high spatial frequency of a luminance of the LUT output image may be removed by performing a low pass filtering for the LUT output image of the low pass filter 253. As a result, the problem that the image such as thin lines having a frequent luminance change displayed by the image display device 101 using two LCD panels is unnaturally seen when viewed at a diagonal direction may be solved by replacing the luminance of the pixel belonging to the high band with the luminance of the corresponding pixel of the LUT output image or the high luminance region data. The dual image in the high band is effectively prevented due to a natural display.

In the second embodiment, similarly to the first embodiment, since the RGB image is displayed as the RGB image in the RGB panel 107 through the LCD controller 106 and as the LV image of a gray scale having only light and shade of a white to a black in the LV panel 109 through the LV controller 208, minute control of the contrast ratio, prevention of the black lifting, simple structure of the circuit and low fabrication cost are obtained.

In the second embodiment, similarly to the first embodiment, since the processes are performed for each pixel, a shape of the high luminance region after expansion may be delicately determined by reflecting the original image.

FIGS. 16A, 16B, 16C and 16D is a view showing an experimental result when a high band is replaced with a high luminance region data in an image display device according to a second embodiment of the present invention, and FIGS. 17A, 17B, 17C and 17D are views showing an experimental result when a high band is replaced with an image processed by a low pass filter in an image display device according to a second embodiment of the present invention.

FIG. 16A shows an RGB image, FIG. 16B shows an LUT input image obtained by performing a color matrix conversion for the RGB image, FIG. 16C shows an LV image obtained by performing an additional process, and FIG. 16D shows a final output image obtained by overlapping the RGB image of FIG. 16A and the LV image of FIG. 16C. To obtain the result of FIG. 16C, the high band detection process is performed, and the second selector 272 selects the high luminance region data.

FIGS. 17A, 17B, 17C and 17D are the same as FIGS. 16A-16D except that the second selector 272 selects the image generated by performing the low pass filtering to the LUT output image.

Although the high band detector 251 uses the variance value calculated by the variance calculator 263 for detecting the high band in the second embodiment, a value such as a standard deviation and a sum of absolute values of difference between the adjacent pixels may be used as a reference value for detecting the high band in another embodiment.

Although the variance value for detecting the high band is calculated based on the total 25 pixels including the horizontal 5 pixels and the vertical 5 pixels with respect to the object pixel in the second embodiment, less pixel or more pixels may be used for calculating the variance value.

For reducing a size of a circuit, a filter having a center of 1 and a periphery of ½ may be used as the low pass filter 253.

Similarly to the first embodiment, the process for each pixel may be performed in series or in parallel. In addition, a delay circuit for synchronizing the display timings of the LV controller 108 and the LCD controller 106 may be added at a previous stage or a next stage of the LCD controller 106 or in the LCD controller 106.

A third embodiment of the present invention will be illustrated hereinafter. A structure of the second embodiment is the same as a structure of the first embodiment except for the LV controller 308.

FIG. 18 is a block diagram showing an LV controller of an image display device according to a third embodiment of the present invention.

In FIG. 18, an LV controller 308 includes a color matrix converter 130, a look-up table (LUT) 331, a high luminance region expander 333, a low pass filter (LPF) 333, a delayer 334 and a selector 335.

The color matrix converter 130 is the same as that of the first embodiment. The color matrix converter 130 performs a color matrix conversion to generate an LUT input image of a gray scale and transmits the LUT input image to the look-up table 131.

The look-up table 331 receives the LUT input image from the color matrix converter 130. The look-up table 331 generates an LUT output image through a gray level conversion of the LUT input image. As shown in FIG. 2, as a gray level of an image data decreases, an output luminance becomes greater than an ideal value and a displayed image becomes brighter. As a result, the real image displayed by the LCD panel has a luminance greater than an ideal value such that the real image is brightly displayed like a white. An input luminance value where the ideal value and the real value begin to be separated from each other may be set as a first threshold value.

In addition, a high value adjacent to a maximum of the luminance value may be set as a second threshold value. The second threshold value is used for classifying the pixel having a relatively high luminance higher than the second threshold value and the pixel having a relatively high luminance lower than the second threshold value and displaying the pixels with an emphasis on light and shade.

For each pixel of the LUT input image, the look-up table 331 converts the luminance value equal to or greater than the first threshold value into a value of the maximum of the luminance multiplied by a decimal smaller than 1. In addition, the look-up table 331 converts the luminance value equal to or greater than the second threshold value into a maximum of the luminance value. For example, when the luminance value is expressed with 8 bits, the look-up table 331 may convert the input luminance value equal to or greater than the first threshold value into a value of 255 multiplied by 0.8 and may convert the input luminance value equal to or greater than the second threshold value into 255. As a result, the look-up table 331 generates the LUT output image where the luminance is adjusted.

Figure 19A:
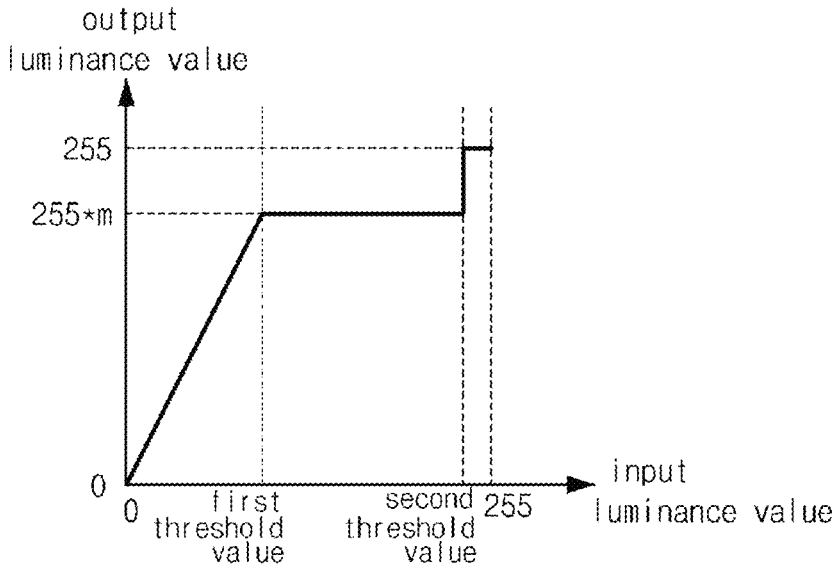
FIGS. 19A and 19B are graphics showing a property of a gray level conversion of an LV controller of an image display device according to a third embodiment of the present invention.
Figure 19B:
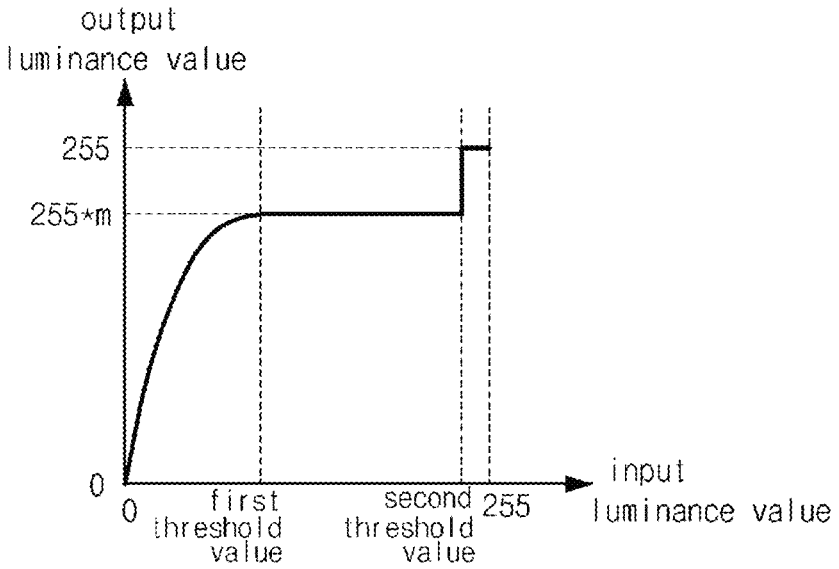

FIGS. 19A and 19B are graphs showing a property of a gray level conversion of an LV controller of an image display device according to a third embodiment of the present invention.

In FIGS. 19A and 19B, a luminance value is expressed with 8 bits. In FIG. 19A, the look-up table 331 is set such that the input luminance value equal to or greater than the first threshold value and smaller than the second threshold value is converted into 255×m (m is a decimal smaller than 1), the input luminance value equal to or greater than the second threshold value is converted into 255, and the input luminance value smaller than the first threshold value is converted into one of 0 to 255×m according to a linear function. In FIG. 7B, the look-up table 331 is set such that the input luminance value equal to or greater than the first threshold value and smaller than the second threshold value is converted into 255×m, the input luminance value equal to or greater than the second threshold value is converted into 255, and the input value smaller than the first threshold value is converted into one of 0 to 255×m according to a curvilinear function.

When the luminance value is expressed with 8 bits, 32 may be set as the first threshold value. In another embodiment any number different from 32 may be set as the first threshold value. Any value greater than the first threshold value may be set as the second threshold value. Since the second threshold value is used for classifying the high luminance region, a value close to the maximum 255 of the luminance value may be set as the second threshold value so that only the output luminance corresponding to the input luminance (i.e., the luminance of the LUT input image input to the look-up table 331) close to the maximum of the luminance value can have the maximum of the luminance value.

The look-up table 331 sets a value (e.g., 255×m of FIGS. 19A and 19B) smaller than the maximum of the luminance value as the output luminance for the pixel having the luminance corresponding to a medium region between the high and low luminance regions. Since the gray level conversion is performed by the look-up table 331 having the above-mentioned gray level conversion property, a contrast ratio of the low luminance region is emphasized and a black lifting of the low luminance region is prevented. In addition, a display capability of the high luminance region is improved.

A shape of the function according to which the input luminance value smaller than the first threshold value is converted into one of 0 to a luminance smaller than the maximum of the luminance value is not limited to FIGS. 19A and 19B. The shape of the function may be obtained by an actual measurement of an experiment.

A correlation between the input luminance value and the output luminance value (i.e., luminance values before and after the gray level conversion) may be preliminarily registered in the look-up table 331, and an additional central processing unit (CPU) may convert the input luminance value into the output luminance value with reference to the correlation registered in the look-up table 331.

The look-up table 331 transmits the LUT output image to the high luminance region expander 332, the low pass filter 333 and the delayer 334 of FIG. 18.

The high luminance region expander 332 receives the LUT output image generated by the look-up table 331 and generates a high luminance region expansion data by expanding the high luminance region of the LUT output image. For example, when the luminance value of the corresponding pixel of the LUT output image is the maximum of the luminance value and the luminance value of the adjacent pixel is not the maximum of the luminance value, the high luminance region expander 332 may convert the luminance value of the adjacent pixel into the maximum of the luminance value for each pixel to generate the high luminance region expansion data.

Figures 20A, 20B:
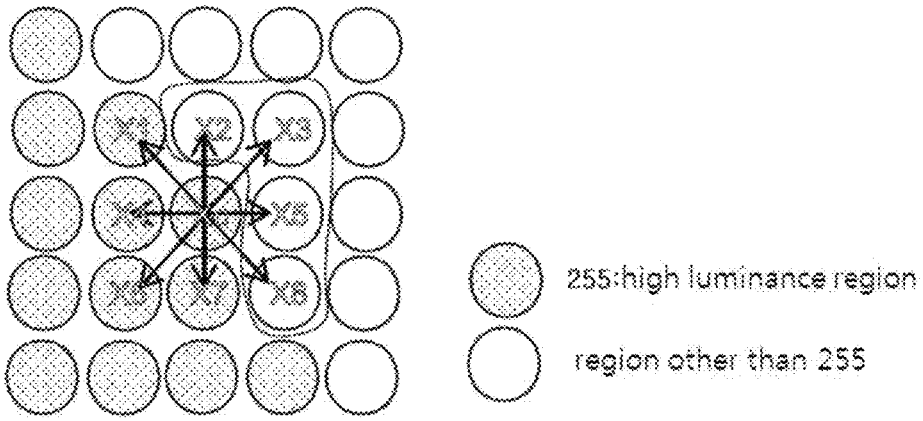
FIGS. 20A and 20B are views showing a high luminance region expansion process of an image display device according to a third embodiment of the present invention.

FIGS. 20A and 20B are views showing a high luminance region expansion process of an image display device according to a third embodiment of the present invention.

FIG. 20A illustrates a high luminance region expansion process performed in the high luminance region expander 332. In FIG. 20A, a high luminance region expansion process may be performed for each pixel of the LUT output image. For example, an object pixel (and its luminance) which is presently processed may be set as Xc, and adjacent pixels of the object pixel may be set as X1 to X8 from a top left along a clockwise direction. A hatched pixel corresponds to a high luminance region (i.e., the maximum 255 of the luminance in the LTU output image, and an unhatched pixel does not correspond to the high luminance region. For example, X1, X4, X6 and X7 may correspond to the high luminance region, and X2, X3, X5 and X8 may not correspond to the high luminance region.

FIG. 20B shows a program illustrating a sequence of the high luminance region expansion process. In FIG. 20B, it is judged whether Xc is 255 or not (i.e., whether Xc belong to the high luminance region or not). When Xc belongs to the high luminance region as in FIG. 20A, the luminance values of the adjacent pixels X1 to X8 are considered. When Xc does not belong to the high luminance region, Xc is converted into 255 such that the corresponding pixel belongs to the high luminance region. As a result, when the object pixel belongs to the high luminance region at an edge which is a boundary of the high luminance region and the pixel adjacent to the object pixel does not belong to the low luminance region, the high luminance region is enlarged by changing a periphery of the object pixel into the high luminance region by one pixel. The high luminance region expander 332 generates a high luminance region expansion data from the LUT output image through the above-mentioned process.

In the third embodiment, the high luminance region expansion process is sequentially performed for each pixel of a horizontal line of the LUT output image. When the pixel not belonging to the high luminance region is changed to belong to the high luminance region through the high luminance region expansion process, the high luminance region expansion process is not performed to the pixel changed to belong to the high luminance region by the high luminance region expansion process. The judgment of the high luminance region expansion process does not use the data having a possibility of change during or after the high luminance region expansion process but uses the LUT output image input to the high luminance region expander 332. As a result, a limitless expansion of the high luminance region by repetition of the high luminance region expansion process for each pixel may be prevented.

The high luminance region expander 332 transmits the high luminance region expansion data to the selector 335.

The low pass filter 333 of FIG. 18 receives the LUT output image from the look-up table 331 and generates an LPF applied image by applying a low pass filtering to the LUT output image. The low pass filter 333 transmits the LPF applied image to the selector 335.

The selector 335 of FIG. 18 receives the high luminance region expansion data generated by the high luminance region expander 332, the LPF applied image outputted from the low pass filter 333 and the LUT output image outputted from the look-up table 331, and selects one of the luminance of the corresponding pixel of the LUT output image and the luminance of the corresponding pixel of the LPF applied image according to the luminance of the corresponding pixel of the high luminance region expansion data for each pixel. When the luminance of the corresponding pixel of the high luminance region expansion data is the maximum of the luminance value, the selector 335 selects the luminance value of the corresponding pixel of the LPF applied image. When the luminance of the corresponding pixel of the high luminance region expansion data is not the maximum of the luminance value, the selector 335 selects the luminance value of the corresponding pixel of the LUT output image. As a result, the selector 335 determines the luminance value of each pixel. The selector 335 generates the LV image finally displayed in the LV panel 109 by combining the selected luminances for all pixels and transmits the LV image to the LV panel 109.

FIG. 21 is a view showing an operation of a selector of an image display device according to a third embodiment of the present invention.

In FIG. 21, the curve 'LUT output' shows the arrangement of the pixels of the corresponding horizontal line as a horizontal axis and the luminance value of the corresponding pixel as a vertical axis for one horizontal line of the LUT output image outputted from the look-up table 331. The curve 'selector output' shows the arrangement of the pixels of the corresponding horizontal line as a horizontal axis and the luminance value of the corresponding pixel of the LV image as a vertical axis for one horizontal line of the LV image corresponding to the horizontal line of the LUT output image.

The 'low luminance region' of the curve 'LUT output' represents a region constituted by the pixels whose luminance values of the LUT input image are between 0 and the first threshold value and are converted into one of 0 to 255×m by the look-up table 331. The 'medium region' of the curve 'LUT output' represents a region constituted by the pixels whose luminance values of the LUT input image are between the first and second threshold values and are converted into 255×m by the look-up table 331. The 'high luminance region' of the curve 'LUT output' represents a region constituted by the pixels whose luminance values of the LUT input image are between the second threshold value and 255 and are converted into 255 by the look-up table 331.

Here, the 'expanded high luminance region' of the curve 'LUT output' represents a region constituted by the pixels whose luminance value is 255 in the high luminance region expansion data due to the judgment of displaying as a high luminance by the high luminance region expander 332 and the pixels originally having the luminance of 255. Since the expanded high luminance region includes a portion which is not originally the high luminance region and is changed to be the high luminance region, the 'expanded high luminance region' of the curve 'LUT output' of FIG. 21 may have a shape including the high luminance region and a portion of the medium region.

The selector 335 selects the luminance value of the corresponding pixel of the LPF applied image for the pixels belonging to the expanded high luminance region. The selector 335 selects the luminance value of the corresponding pixel of the LUT output image for the pixels not belonging to the expanded high luminance region. The selected luminance values are combined and transmitted as the LV image to the LV panel 109. As a result, the image where the luminance value of only the pixels of the LUT output image belonging to the expanded high luminance region is converted into the luminance value of the corresponding pixels of the LPF applied image is transmitted as the LV image.

The delayer 334 delays the timing where the LUT output image outputted from the look-up table 331 reaches the selector 335 by a time corresponding to the high luminance region expansion process and the low pass filtering process.

The LV panel 109 receives the LV image, which is a black-and-white image of a gray scale having an adjusted luminance, from the selector 335 and displays the LV image.

A sequence of displaying an image according to the third embodiment will be illustrated hereinafter.

As shown in FIG. 4, the image processing engine 104 of the main body 102 generates the RGB image displayed by the image display device 101 and transmits the RGB image to the LCD module 103.

The LCD module 103 receives the RGB image through the interface 105, and the interface 105 transmits the RGB image to the LCD controller 106 and the LV controller 108.

The LCD controller 106 receives the RGB image from the interface 105 and processes the RGB image to transmit the RGB image to the RGB panel 107.

The RGB panel 107 displays the RGB image received from the LCD controller 106.

The LV controller 308 as the LCD controller 106 receives the RGB image from the interface 105.

The color matrix converter 130 of the LV controller 308 of FIG. 18 performs the color matrix conversion for the received RGB image and generates the LUT input image of a gray scale which has only light and shade of a white to a black to transmit the LUT input image to the look-up table 331.

The look-up table 331 receives the LUT input image from the color matrix converter 130. The correlation between luminance values before and after the gray level conversion is registered in the look-up table 331. The look-up table 331 performs the gray level conversion for each pixel of the received LUT input image to generate the LUT output image.

For each pixel of the LUT input image, the look-up table 331 converts the luminance value equal to or greater than the first threshold value into a value of the maximum of the luminance multiplied by a decimal smaller than 1. In addition, the look-up table 331 converts the luminance value equal to or greater than the second threshold value into a maximum of the luminance value. Further, the look-up table 331 converts the luminance value smaller than the first threshold value into one of 0 to a value of the maximum of the luminance multiplied by a decimal. For example, when the luminance value is expressed with 8 bits, the look-up table 331 may convert the input luminance value equal to or greater than the first threshold value into a value of 255 multiplied by 0.8 and may convert the input luminance value equal to or greater than the second threshold value into 255.

The look-up table 331 transmits the LUT output image to the high luminance region expander 332, the low pass filter 333 and the delayer 334.

The high luminance region expander 332 receives the LUT output image generated by the look-up table 331 and generates the high luminance region expansion data where the high luminance region expands. When the luminance value of the corresponding pixel of the LUT output image is the maximum of the luminance value and the luminance value of the adjacent pixel is not the maximum of the luminance value, the high luminance region expander 332 may convert the luminance value of the adjacent pixel into the maximum of the luminance value for each pixel to generate the high luminance region expansion data. The high luminance region expander 332 transmits the high luminance region expansion data to the selector 335.

The low pass filter 333 receives the LUT output image and generates an LPF applied image by applying a low pass filtering to the LUT output image. The low pass filter 333 transmits the LPF applied image to the selector 335.

The selector 335 receives the high luminance region expansion data, the LPF applied image and the LUT output image delayed by the delayer 334. The delayer 334 delays the timing where the LUT output image reaches the selector 335 by a time corresponding to the high luminance region expansion process and the low pass filtering process. As a result, when the selector 335 selects the luminance value based on the high luminance region expansion data, the arrival timing of the LUT output image is adjusted such that the LUT output image timely corresponding to the high luminance region expansion data is supplied as an input.

The selector 335 generates a black-and-white adjusted image by selecting one of the luminance of the corresponding pixel of the LUT output image and the luminance of the corresponding pixel of the LPF applied image according to the luminance of the corresponding pixel of the high luminance region expansion data for each pixel. When the luminance of the corresponding pixel of the high luminance region expansion data is the maximum of the luminance value, the selector 335 selects the luminance value of the corresponding pixel of the LPF applied image. When the luminance of the corresponding pixel of the high luminance region expansion data is not the maximum of the luminance value, the selector 335 selects the luminance value of the corresponding pixel of the LUT output image. As a result, the selector 335 generates the LV image.

In the LV image, the pixel belonging to the expanded high luminance region is set to have the luminance value corresponding to the LPF applied image, and the corresponding pixel is displayed as the high luminance region in the LV panel 109.

The RGB image is simultaneously displayed in the RGB panel 107 through the LCD controller 106 as the RGB image and in the LV panel 109 through the LV controller 308 as the LV image of a gray scale which has only light and shade of a white to a black.

Since the RGB panel 107 as a front LCD panel and the LV panel 109 as a rear LCD panel overlap each other as shown in FIG. 5, the light emitted from the light source 120 through the backlight unit 110 sequentially passes the LV panel 109 where the LV image based on the RGB image is displayed and the RGB panel 107 where the RGB image is displayed to reach an eye of a human. While the light passes through the LV panel 109 and the RGB panel 107, the color and the luminance of the light are controlled by the CF substrate 111 of the RGB panel 107 and the liquid crystal layers (not shown) of each of the LV panel 109 and the RGB panel 107.

Since the luminance may be individually controlled by each of the LV panel 109 and the RGB panel 107, the contrast ratio may be minutely controlled.

The light emitting from the backlight unit 110 and reaching an eye of a human through the LV panel 109 and the RGB panel 107 has a transmittance obtained by multiplication of a transmittance of the LV panel 109 and a transmittance of the RGB panel 107. To prevent a black lifting of a dark region of an image, the look-up table 331 performs the gray level conversion for the image of a gray scale so that the transmittance of the dark region of the LV panel 109 can be reduced. As a result, a black lifting is prevented by changing the luminance value of the LV panel 109 without change of the luminance value of the RGB panel 107 displaying the RGB image.

The look-up table 331 classifies the luminance of the pixel of the LUT input image into a value between 0 and 'the maximum luminance value×m', the 'the maximum luminance value×m' and 'the maximum luminance value' as shown in FIGS. 19A and 19B. As a result, the gray level conversion is performed such that the high luminance region and the medium region are classified and the high luminance region corresponding to the maximum of the luminance and the medium region are displayed with different luminances. Accordingly, a portion having a high luminance (i.e., a bright portion) is displayed with an emphasis as compared with the other portions.

In the look-up table 331, 'the maximum luminance value×m' is used as the output luminance value of the pixel belonging to the medium region, 'the maximum luminance value' is used as the output luminance value of the pixel belonging to the high luminance region, and the output luminances of the medium region and the high luminance region are not continuous. As a result, when the output of the look-up table 331 is intactly displayed in the LV panel 109, the high luminance region may outstand as compared with the other portions. In the curve 'LUT output' of FIG. 21, a rising and a falling at a border between the high luminance region and the medium region has a shape of a vertical line.

To obtain a gentle slope of the luminance at the border between the high luminance region and the medium region of the LUT output image, the low pass filtering is applied to the LUT output image. When the luminance value is expressed as a function along a horizontal line as shown in FIG. 21, a portion of the high luminance region is removed to obtain a gentle slope by applying the low pass filtering of the low pass filter 333 to the LUT output image. Specifically, an edge of the border between the high luminance region and the medium region becomes gentle and a center of the high luminance region becomes sharp to form a slope.

To display the regions other than the high luminance region with the luminance of the LUT output image, the luminance value of the LPF applied image is selected only for a portion where the high luminance region expansion data is the maximum of the luminance. As a result, since a portion other than the high luminance region is displayed without deterioration and the high luminance region is displayed with improvement, a natural image is displayed and a display of only white is prevented.

Since the rear LCD panel adjacent to the backlight unit 110 is formed as the LV panel 109, the series of the processes does not require a complicated structure and a circuit for the series of the processes has a simple structure.

In addition, the values of the look-up table 331 may be determined by off-line before the look-up table 331 is integrated and only the memory may be integrated in the image display device 101. Accordingly, the property of the gray level conversion may be easily obtained.

The LV panel 109 displays the LV image received from the LV controller 308 as shown in FIG. 5. Since the LV image is based on the image of a gray scale, the LV panel 109 does not require some elements of a typical LCD panel such as a color filter layer. Accordingly, the fabrication cost of the image display device 101 may be reduced.

FIGS. 22A, 22B, 22C and 22D are views showing an experimental result of an image display device according to a third embodiment of the present invention, and FIGS. 23A, 23B, 23C and 23D are views showing a magnified experimental result of an image display device according to a third embodiment of the present invention.

FIG. 22A shows an RGB image, FIG. 22B shows an LUT input image obtained by performing a color matrix conversion for the RGB image, FIG. 23C shows an LV image obtained by performing an additional process (a high luminance region expansion process) after performing a gray level conversion to the LUT input image by the look-up table 331, and FIG. 22D shows a final output image obtained by overlapping the RGB image of FIG. 22A and the LV image of FIG. 22C.

FIGS. 23A to 23D are magnified views of FIGS. 22A to 22D. A clock tower is shown at a central portion of FIGS. 23A to 23D. In FIG. 23A, a light of a center of the clock tower is displayed by the maximum of the luminance such that only a white is displayed. In FIG. 23D, as a result of the processes of the third embodiment, a portion corresponding to the high luminance region of the light of a center of the clock tower is displayed with an excellent gray level.

A two dimensional low pass filter may be used for the third embodiment. For example, a filter where a coefficient of all taps is 1 by a fused multiply add (FMA) of 7×7 taps may be used as the low pass filter 333. A size and a coefficient of the tap are not limited to the values of the above-mentioned filter if the filter is used as a low pass filter.

In the high luminance region expansion process, when the object pixel has the high luminance, the distance from the object pixel to the adjacent pixel is calculated. When the high luminance region expansion data of the adjacent pixel within a reference distance is not the high luminance, the luminance of the corresponding pixel may be replaced with the high luminance. Although the high luminance region expansion process is performed for 8 pixels adjacent to the object pixel in the third embodiment, the high luminance region expansion process may be performed for 24 pixels (further separated by 1 pixel) adjacent to the object pixel in another embodiment.

The process for each pixel may be performed in series or in parallel in each of the look-up table 331, the high luminance region expander 332 and the selector 335.

The process time in the LV controller 308 may be longer than the process time in the LCD controller 106. Accordingly, a delay circuit for synchronizing the display timings of the LV controller 308 and the LCD controller 106 may be added at a previous stage or a next stage of the LCD controller 106 or in the LCD controller 106.

FIG. 24 is a block diagram showing an LV controller of an image display device according to a fourth embodiment of the present invention. A structure of the fourth embodiment is the same as a structure of the first embodiment except for the LV controller 408.

In FIG. 24, an LV controller 408 includes a color matrix converter 130 and a look-up table (LUT) 431.

The color matrix converter 130 is the same as that of the first embodiment. The color matrix converter 130 performs a color matrix conversion to generate an LUT input image of a gray scale and transmits the LUT input image to the look-up table 431.

The look-up table 431 receives the LUT input image from the color matrix converter 130. The look-up table 431 performs a gray level conversion to the LUT input image and generates an LUT output image. As shown in FIG. 2, as a gray level of an image data decreases, an output luminance becomes greater than an ideal value. As a result, the real image displayed by the RGB panel has a luminance greater than an ideal value such that the real image is brightly displayed like a white.

Figure 25A:
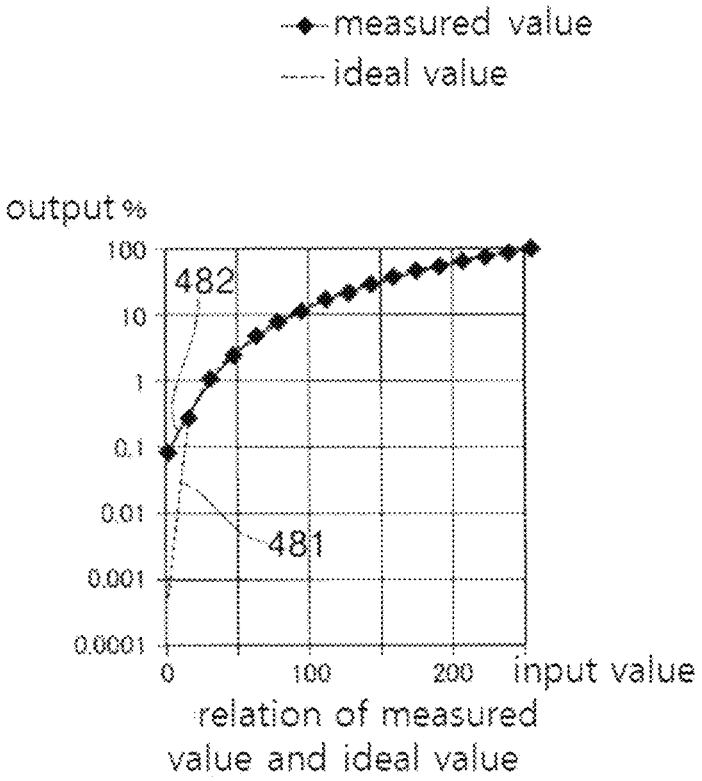
FIGS. 25A and 25B are graphs showing a property of a gray level conversion of an image display device according to a fourth embodiment of the present invention.
Figure 25B:
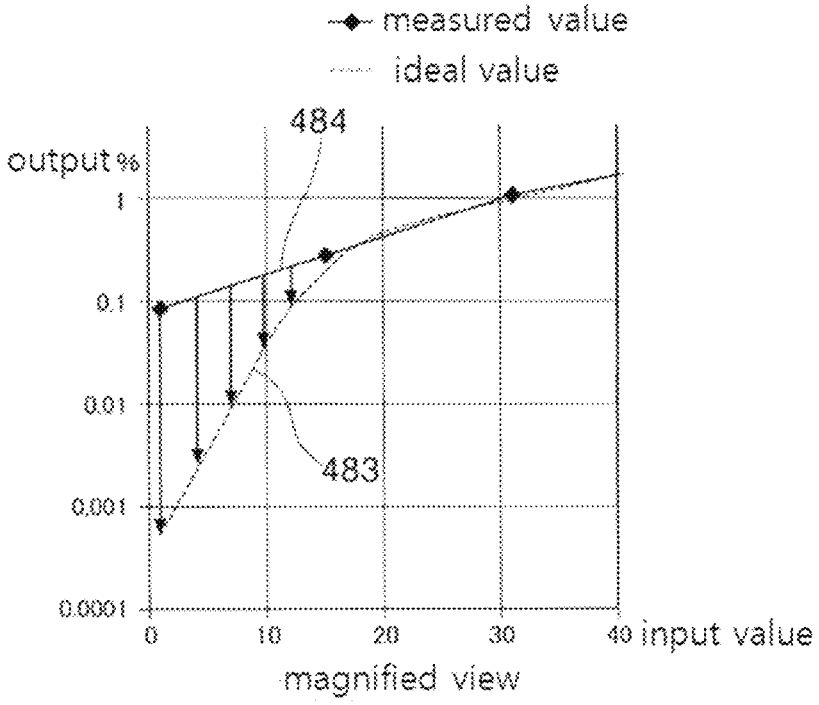

FIGS. 25A and 25B are graphs showing a property of a gray level conversion of an image display device according to a fourth embodiment of the present invention.

In FIG. 25A, a horizontal axis is scaled linearly differently from the horizontal axis of FIG. 2 scaled logarithmically. A line 481 represents an ideal relation of input and output luminances and a line 482 represents a real relation of input and output luminances of a related art image display device similarly to the lines 11 and 12 of FIG. 2. FIG. 25B is a magnified view of a portion of FIG. 25A where the lines 481 and 482 are separated and the input luminance is small. A line 483 represents an ideal relation of input and output luminances and a line 484 represents a real relation of input and output luminances of a related art image display device similarly to the lines 481 and 482 of FIG. 25A. When a pixel of an input image has an input luminance, a look-up table 431 is set to perform a gray level conversion where an output luminance value corresponding to the line 484 is corrected to an output luminance value corresponding to the line 483.

Figures 26B, 27:
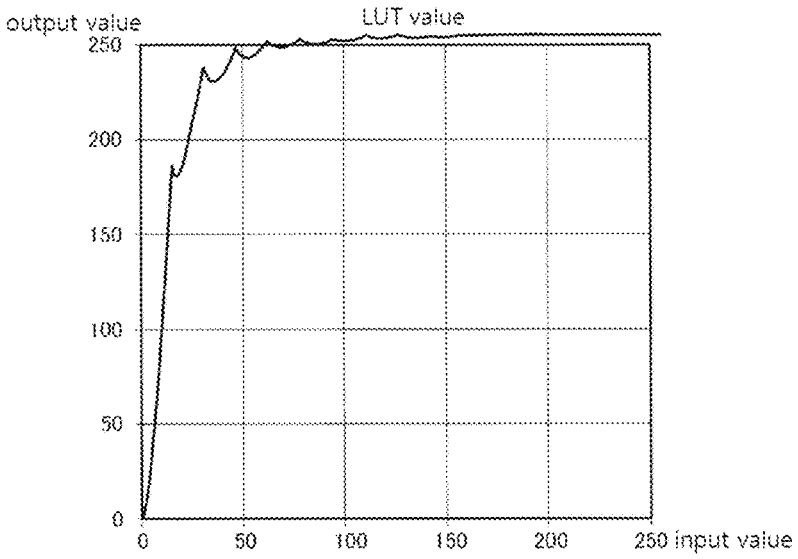

FIGS. 26A and 26B is a view showing a setting of a look-up table of an image display device according to a fourth embodiment of the present invention.

FIG. 26A shows an exemplary setting of the look-up table 431 regarding a measuring point. Here, the measuring point means an input luminance value whose corresponding output luminance is really measured through an experiment. The measuring point may have one of 0 to the maximum of the luminance value. For example, the measuring point may correspond to an inflection point in a gamma approximation by broken lines according to the related art. Although the luminance value is expressed with 8 bits and the maximum of the luminance value is 255 in the fourth embodiment, the bit number for the luminance value is not limited to 8 bits.

In FIG. 26A, values of the column 'input' of 1, 15, . . . , 255 are used as the measured value. The column 'measured value' represents the output luminance normalized by 100% when the luminance value corresponding to the measuring point is input to the LCD panel. The column 'ideal value' represents an ideal output luminance normalized by 100% when the luminance value corresponding to the measuring point is input to the LCD panel. For example, when Xn is an input luminance, an ideal value of Xn may be obtained according to the following equation.

$$\text{'Ideal value of } Xn\text{'}=(Xn/255)2.2\times100$$

In the above equation, although an exponent '2.2' is used as a gamma value of a conventional display, the exponent is not limited to '2.2.'

The column 'correction coefficient' represents a value obtained by dividing the column 'ideal value %' corresponding to each measuring point by the column 'measured value %.' The column 'LUT value' represents a value obtained by normalizing the column 'correction coefficient' corresponding to each measuring point with the maximum of the luminance (i.e., a value obtained by performing a rounding process to the column 'correction coefficient multiplied by the maximum of the luminance). The column 'LUT value' represents a value corresponding to the output luminance.

When the input luminance value corresponds to a measuring point, the correction coefficient is calculated from the measured value of the output luminance value of the LCD panel in case of the measuring point of the input luminance and the ideal value of the output luminance value in case of the measuring point of the input luminance, and the correction coefficient is normalized with the maximum of the luminance value. As a result, the 'LUT value' corresponding to the measuring point is preliminarily calculated, and a correlation of the measuring point and the 'LUT value' is registered in the look-up table 431. When a pixel of the LUT input image has a luminance corresponding to the measuring point, the 'LUT value' corresponding to the input luminance is obtained based on the correlation and the LUT output image (i.e., the LV image) is generated by using the 'LUT value' as the output luminance.

In FIG. 26A, which shows the correlation of the luminance value corresponding to the measuring point, the input luminance values exist between the discrete the column 'input' of the look-up table 431. For example, the input luminance values corresponding 2 to 14 and 16 to 30 may exist. Accordingly, the correlation of the look-up table 431 is set such that an interval between inputs in the column 'input' is 1. This setting may be performed by linearly interpolating the measured values between the adjacent measuring points and obtaining the correction coefficients as an ideal value.

For example, the output luminance values corresponding to the input luminance value between the measuring points may be calculated as follows. When Xn is an input luminance value, the measured value Yn corresponding to Xn may be calculated according to the following linear interpolation equation.

$$Y_n = \frac{Y_{max} - Y_{min}}{X_{max} - X_{min}} \times (X_n - X_{min}) + X_{min}$$

Here, Xmin is an input luminance value of a small measuring point of two measuring points having Xn as an interval value and Ymin is a measured value corresponding to the small measuring point. Xmax is an input luminance value of a great measuring point of the two measuring points having Xn as an interval value and Ymax is a measured value corresponding to the great measuring point. As a result, an increment corresponding to an interval of 1 between the input values is calculated by proportionally dividing the measured values of the two measuring points and the increments corresponding to the interval are added to the measured values so that the measured values can be linearly interpolated.

FIG. 26B shows an exemplary correlation of the look-up table 431 having the luminance values corresponding to the measuring points between two measuring points 'X15' and 'X31.' The luminance values between the two measuring points are shown in the column 'input.' Values which is obtained by normalizing the measured values calculated from the linear interpolation equation for the input luminance values between X16 to X30 when Xmin is 15 and Xmax is 31 in the linear interpolation with 100% are shown in the column 'measured value %.' The column 'ideal %' represents values which are obtained by normalizing the ideal output luminance value when the input luminance value is input to the LCD panel with 100%. The column 'ideal %' may be obtained from the equation used for the luminance value corresponding to the measuring point. The column 'correction coefficient' represents values obtained by dividing the column 'ideal %' corresponding to the input luminance value by the column 'measured value.' The column 'LUT value' represents values obtained by normalizing the column 'correction coefficient' corresponding to the input luminance value by the maximum of the luminance value. For example, the column 'LUT value' may be obtained by multiplying the column 'correction coefficient' and the maximum of the luminance value and performing a rounding process. The column 'LUT value' may correspond to the output luminance value.

When the input luminance value does not correspond to any of the measured points, the measured values of the measuring points are linearly interpolated between two measuring points having the corresponding luminance value as an interval value to obtain the values corresponding to the measured value of the corresponding input luminance value. In addition, the correction coefficients are calculated from the values corresponding to the measured value of the corresponding input luminance value and the ideal value of the corresponding input luminance value, and the correction coefficients are normalized by the maximum of the luminance value. As a result, the correlation of the input luminance value and the column 'LUT value' is registered in the look-up table 431. When the pixel of the LUT input image has a luminance value not corresponding to the measuring points, the column 'LUT value' corresponding to the input luminance value is obtained based on the correlation, and the LUT output image (i.e., the LV image) is generated by using the column 'LUT value' as an output luminance value.

A correlation between the input luminance value and the output luminance value (i.e., luminance values before and after the gray level conversion) may be preliminarily registered in the look-up table 431, and an additional central processing unit (CPU) may convert the input luminance value into the output luminance value with reference to the correlation registered in the look-up table 431.

The look-up table 431 transmits the LUT output image to the LV panel 109 as the LV image (a black-and-white image of a gray scale of an adjusted luminance).

A sequence of displaying an image according to the fourth embodiment will be illustrated hereinafter.

As shown in FIG. 4, the image processing engine 104 of the main body 102 generates the RGB image displayed by the image display device 101 and transmits the RGB image to the LCD module 103.

The LCD module 103 receives the RGB image through the interface 105, and the interface 105 transmits the RGB image to the LCD controller 106 and the LV controller 408.

The LCD controller 106 receives the RGB image from the interface 105 and processes the RGB image to transmit the RGB image to the RGB panel 107.

The RGB panel 107 displays the RGB image received from the LCD controller 106.

The LV controller 408 as the LCD controller 106 receives the RGB image from the interface 105.

The color matrix converter 130 of the LV controller 408 of FIG. 24 performs the color matrix conversion for the received RGB image and generates the LUT input image of a gray scale which has only light and shade of a white to a black to transmit the LUT input image to the look-up table 431.

The look-up table 431 receives the LUT input image from the color matrix converter 130. The correlation between luminance values before and after the gray level conversion is registered in the look-up table 431. When the input luminance value corresponds to one of the measured points, the correction coefficients are calculated from the measured value of the output luminance value of the LCD panel where the measuring point is used as the input luminance value and the ideal value of the output luminance value where the measuring point is used as the input luminance value, and the correction coefficients are normalized by the maximum of the luminance value. As a result, the 'LUT value' may be preliminarily calculated and the correlation of the measuring points and the 'LUT value' may be registered in the look-up table 431. In addition, when the input luminance value does not correspond to any of the measured points, the measured values of the measuring points are linearly interpolated between two measuring points having the corresponding luminance value as an interval value to obtain the values corresponding to the measured value of the corresponding input luminance value. Further, the correction coefficients are calculated from the values corresponding to the measured value of the corresponding input luminance value and the ideal value of the corresponding input luminance value, and the correction coefficients are normalized by the maximum of the luminance value. As a result, the 'LUT value' may be preliminarily calculated and the correlation of the input luminance value and the 'LUT value' may be registered in the look-up table 431.

The look-up table 431 performs the gray level conversion for each pixel of the received LUT input image to generate the LUT output image. The look-up table 431 transmits the LUT output image to the LV panel 109 as the LV image (i.e., a black-and-white image of a gray scale of an adjusted luminance).

The RGB image is simultaneously displayed in the RGB panel 107 through the LCD controller 106 as the RGB image and in the LV panel 109 through the LV controller 408 as the LV image of a gray scale which has only light and shade of a white to a black.

Since the RGB panel 107 as a front LCD panel and the LV panel 109 as a rear LCD panel overlap each other as shown in FIG. 5, the light emitted from the light source 120 through the backlight unit 110 sequentially passes the LV panel 109 where the LV image based on the RGB image is displayed and the RGB panel 107 where the RGB image is displayed to reach an eye of a human. While the light passes through the LV panel 109 and the RGB panel 107, the color and the luminance of the light are controlled by the CF substrate 111 of the RGB panel 107 and the liquid crystal layers (not shown) of each of the LV panel 109 and the RGB panel 107.

Since the luminance may be individually controlled by each of the LV panel 109 and the RGB panel 107, the contrast ratio may be minutely controlled.

The light emitting from the backlight unit 110 and reaching an eye of a human through the LV panel 109 and the RGB panel 107 has a transmittance obtained by multiplication of a transmittance of the LV panel 109 and a transmittance of the RGB panel 107.

FIG. 27 is a graph showing a property of a gray level conversion of an LV controller of an image display device according to a fourth embodiment of the present invention.

In FIG. 27, the input luminance values correspond to the output luminance values in the look-up table 431. The slope of the output luminance value corresponding to the relatively small input luminance value is steeper as compared with the slope of the measured values of FIG. 25 to approach the ideal value. The look-up table 431 performs the gray level conversion for the image of a gray scale so that the transmittance of the dark region of the LV panel 109 can be reduced. As a result, a black lifting is prevented by changing the luminance value of the LV panel 109 without change of the luminance value of the RGB panel 107 displaying the RGB image.

Specifically, in FIG. 27, most of the input luminance values of the measuring points corresponding to inflection points in a gamma approximation by broken lines correspond to the local maximum of the output luminance value. For example, when the input luminance value becomes greater than the inflection point, the output luminance value decreases firstly. The measured values at the input luminance value between measuring points may be calculated according to the linear interpolation equation. Since the equation for obtaining the ideal value of Xn in the portion by the linear interpolation between the measuring points includes a function having a shape inflated toward a right lower direction, the output luminance value firstly decreases after the input luminance value becomes greater than the inflection point. In FIG. 26B, the output luminance value (LUT value) corresponding to the input luminance value of 16 to 19 is smaller than output luminance value corresponding to the input luminance value of 15 which is the inflection point.

For example, when a gradation where a luminance value gradually increases is displayed, a portion corresponding to the luminance value of the inflection point of the broken lines through the gamma approximation by broken lines is shown as a border of color to a human. In the fourth embodiment, however, the look-up table 431 having the correlation of the input luminance value and the output luminance value as shown in FIG. 27 is provided. A correction curve for correction based on the gamma approximation by broken lines where the gray level property is measured in an apparatus including the gamma approximation by broken lines and is corrected to have an ideal state is registered in the look-up table 431 as the correlation. As a result, the border line may not be recognized by reducing the luminance of the pixel corresponding to the luminance value brighter than the inflection point, and the gray level property naturally shown to a human is obtained by displaying a natural gradation.

Since the rear LCD panel adjacent to the backlight unit 110 is formed as the LV panel 109, the series of the processes does not require a complicated structure and a circuit for the series of the processes has a simple structure.

In addition, the values of the look-up table 431 may be determined by off-line before the look-up table 431 is integrated and only the memory may be integrated in the image display device 101. Accordingly, the property of the gray level conversion may be easily obtained. Further, only one kind of the correlation of the input luminance value and the output luminance value is required for making the gray level conversion property close to the ideal state and only one look-up table 431 is required for forming an apparatus.

The LV panel 109 displays the LV image received from the LV controller 408 as shown in FIG. 5. Since the LV image is based on the image of a gray scale, the LV panel 109 does not require some elements of a typical LCD panel such as a color filter layer. Accordingly, the fabrication cost of the image display device 101 may be reduced.

FIGS. 28A, 28B, 28C and 28D are views showing an experimental result of an image display device according to a fourth embodiment of the present invention, and FIGS. 29A, 29B, 29C and 29D are views showing a magnified experimental result of an image display device according to a fourth embodiment of the present invention.

Figures 28A, 28B, 28C, 28D:
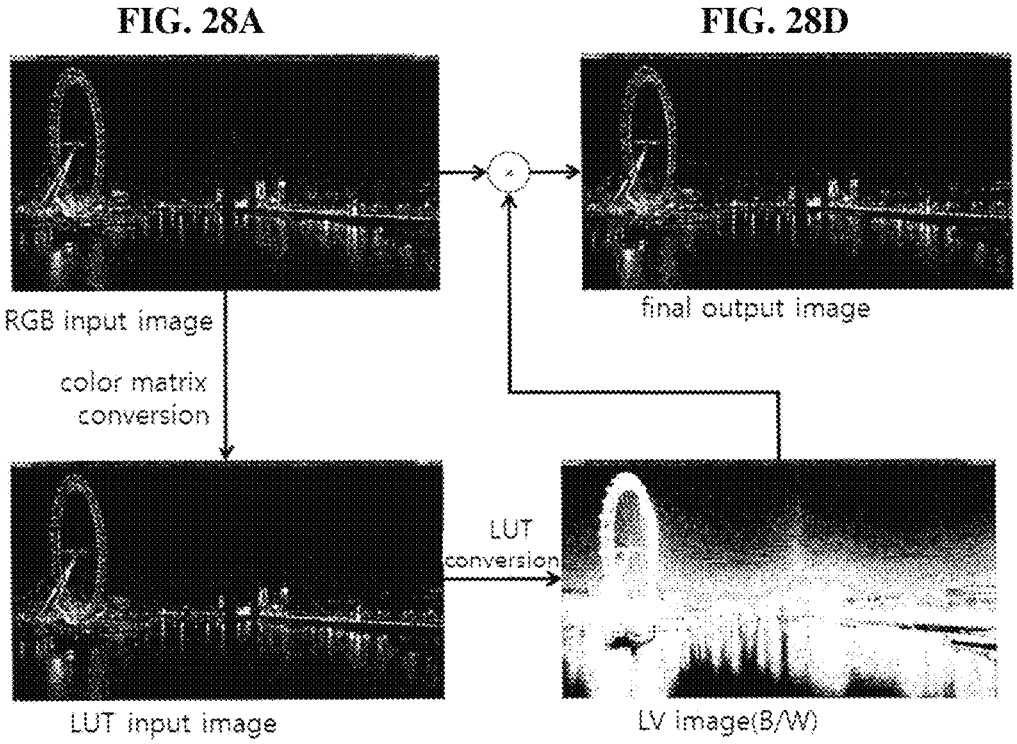
FIGS. 28A, 28B, 28C and 28D are views showing an experimental result of an image display device according to a fourth embodiment of the present invention.

FIG. 28A shows an RGB image, FIG. 28B shows an LUT input image obtained by performing a color matrix conversion for the RGB image, FIG. 28C shows an LV image obtained by performing a gray level conversion to the LUT input image by the look-up table 431, and FIG. 28D shows a final output image obtained by overlapping the RGB image of FIG. 28A and the LV image of FIG. 28C.

FIGS. 29A to 29D are magnified views of FIGS. 28A to 28D.

In the final output image, the gray level property of a black is improved and the image display having a high contrast ratio is obtained.

FIG. 30 is a block diagram showing an LV controller of an image display device according to a fifth embodiment of the present invention. A structure of the fifth embodiment is the same as a structure of the first embodiment except for the LV controller 508.

In FIG. 30, an LV controller 508 improves a gray level property by removing a situation where only a specific value is frequently as the output luminance value and using various values as the output luminance value to flatten a luminance histogram of the output luminance value. As a result, a bit expansion process is performed to the luminance value.

The LV controller 508 includes a color matrix converter 130, a bit expander 531 and a look-up table (LUT) 532.

The color matrix converter 130 is the same as that of the first embodiment. The color matrix converter 130 performs a color matrix conversion to generate a bit expansion input image of a gray scale and transmits the bit expansion input image to the bit expander 531.

The bit expander 531 receives the bit expansion input image from the color matrix converter 130. The bit expander 531 expands the luminance value of each pixel of the bit expansion input image.

Figures 31, 32A, 32B:
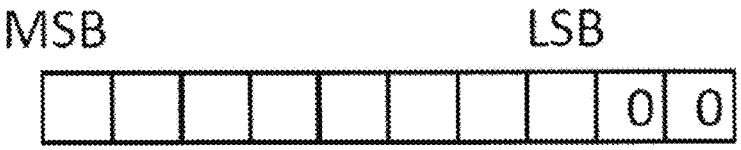
FIG. 31 is a view showing a bit expansion process according to a fifth embodiment of the present invention.
FIGS. 32A and 32B are views showing an object pixel and adjacent pixels of an image display device according to a fifth embodiment of the present invention.

FIG. 31 is a view showing a bit expansion process according to a fifth embodiment of the present invention.

In FIG. 31, an 8-bit luminance value is expanded to a 10-bit luminance value by performing a 2-bit left shift calculation to the 8 bits luminance value and by adding 2 bits as least significant bit (LSB). Although the 8-bit luminance value is expanded to the 10-bit luminance value in the fifth embodiment, the bit number of the original luminance value is not limited to 8 and the bit number of the expanded luminance value is not limited to 10. The bit number of the expanded luminance value may be determined by a trade-off between a circuit size and a product cost.

The added 2 bits may be set based on the luminance values of pixels adjacent to an object pixel for the bit expansion process.

FIGS. 32A and 32B are views showing an object pixel and adjacent pixels of an image display device according to a fifth embodiment of the present invention.

FIG. 32A shows the object pixel X5 and the adjacent pixels X1 to X4 and X6 to X9. The adjacent pixels may be similar to or relate to the object pixel. For example, when the luminance value of the object pixel is greater than the luminance value of the adjacent pixels, a function of the arrangement of the pixels as a horizontal axis and the luminance values of corresponding pixel as the vertical axis has a convex shape, and an analog value of the real luminance value of the object pixel is assumed to be smaller than a digital value of the rounded luminance value by 8-bits. As a result, an image may be naturally displayed to an eye of a human by setting a luminance value of the object pixel smaller than the digital value of the rounded luminance value by 8-bits to be close to the luminance value of the adjacent pixels. On the contrary, when the luminance value of the object pixel is smaller than the luminance value of the adjacent pixels, an image may be naturally displayed by setting a luminance value of the object pixel greater than the digital value of the rounded luminance value by 8-bits. The adjustment is performed using the expanded 2 bits.

The added 2 bits may be set as follows. FIG. 32B shows a program illustrating a sequence of the bit expansion process. After a variable dc is initialized as 0, the 8-bit luminance value of the object pixel X5 is compared with the 8-bit luminance values of the adjacent pixels X1 to X4 and X6 to X8. 1 is subtracted from the variable dc when the luminance value of the object pixel X5 is greater than the luminance value of the adjacent pixel, and 1 is added to the variable dc when the luminance value of the object pixel X5 is smaller than the luminance value of the adjacent pixel. Here, the number of the adjacent pixels compared with the object pixel is 8, and the variable dc may have a value of −8 to +8. The variable dc is normalized to have a value of −1 to +1 by dividing the variable by 8. The 2 bits below decimal point are determined by adding the normalized variable dc to the 8-bit luminance value of the object pixel. The expansion from the 8-bit luminance value to the 10-bit luminance value is completed by left shifting the luminance value where the normalized variable dc is added by 2 bits.

Since the variable dc before the normalization may have values of 16 stages of −8 to +8, the variable dc before the normalization may be expressed with 4 bits. Although the 8-bit luminance value may be expanded to a 12-bit luminance value according to the bit expansion process, the lower 2 bits are rounded in the fifth embodiment. Since the expanded bit number influences a bit width of the look-up table 532, the expanded bit number may be determined by a trade-off between a circuit size and a product cost similarly to the bit number of the luminance value.

The bit expander 531 transmits the LUT input image of the bit which is expanded by a value reflecting the order relation between the object pixel and the adjacent pixels as a weighted value to the look-up table 532.

The look-up table 532 receives the LUT input image from the bit expander 531. Basically, the look-up table 532 may be the same as the look-up table 431 of the fourth embodiment. When the input luminance value corresponds to a measuring point, the correction coefficient is calculated from the measured value of the output luminance value of the LCD panel in case of the measuring point of the input luminance and the ideal value of the output luminance value in case of the measuring point of the input luminance, and the correction coefficient is normalized with the maximum of the luminance value. As a result, the 'LUT value' corresponding to the measuring point is preliminarily calculated, and a correlation of the measuring point and the 'LUT value' is registered in the look-up table 532. When the input luminance value does not correspond to any of the measured points, the measured values of the measuring points are linearly interpolated between two measuring points having the corresponding luminance value as an interval value to obtain the values corresponding to the measured value of the corresponding input luminance value. In addition, the correction coefficients are calculated from the values corresponding to the measured value of the corresponding input luminance value and the ideal value of the corresponding input luminance value, and the correction coefficients are normalized by the maximum of the luminance value. As a result, the correlation of the input luminance value and the column 'LUT value' is registered in the look-up table 532.

FIGS. 33A and 33B are views showing a setting of a look-up table of an image display device according to a fifth embodiment of the present invention.

FIG. 33A shows an exemplary setting regarding a measuring point, and FIG. 33B shows an exemplary setting corresponding to input luminance values between measuring points. In FIG. 33A, although an 'input' is expressed as a broken line between 60 and 64, rows of the input luminance values of 61 to 63 exist and are omitted.

The input luminance value of an expanded bit such as 10 bits is input to the look-up table 532, while the input luminance value of a non-expanded bit such as 8 bits is input to the look-up table 431. Since the number of the measuring points of the look-up table 532 is the same as the number of the measuring points of the look-up table 431, a structure of the look-up table 532 regarding the input luminance value corresponding to the measuring points is the same as a structure of the look-up table 431 regarding the input luminance value corresponding to the measuring points. For example, the look-up table 532 and the look-up table 431 may have the same values of the columns 'measuring value %,' 'ideal %,' 'correction coefficient' and 'LUT value' regarding each measuring point. However, the luminance value between the measuring points may increase according to the expanded bit number. The input luminance values 15 and 31 of FIG. 26A correspond to the bit expanded input luminance values 60 and 124, respectively, of FIG. 33A. Although 15 input luminance values between the input luminance values 15 and 31 in case of no bit expansion are set in FIG. 26B, 63 input luminance values between the input luminance values 60 and 124 as a result of the bit expansion are set in FIG. 33B.

Differently from the fourth embodiment, the following equation may be used for obtaining the ideal value. 1023 represents the maximum of the luminance in case of the expanded bit number of 10.

'Ideal value of $Xn'=(Xn/1023)2.2\times100$

Although the input luminance value to the look-up table 532 is expressed with the expanded bit number (e.g., 10 bits in FIGS. 33A and 33B), the output luminance value (i.e., LUT value) from the look-up table 532 is normalized by the maximum of the bit number before the bit expansion (e.g., 255 of the maximum of 8 bits in FIGS. 33A and 33B) to constitute the LUT output image as in the look-up table 431. As a result, the processes are established and performed in each part using the output of the look-up table 532 regardless of whether the bit expansion process is performed before the look-up table 532.

The look-up table 531 transmits the LUT output image of which the gray level is converted and the luminance is adjusted to the LV panel 109.

A sequence of displaying an image according to the fifth embodiment will be illustrated hereinafter. Since a difference between the fourth and fifth embodiments is the LV controller 508, the LV controller 508 will be mainly illustrated.

The color matrix converter 130 of the LV controller 508 of FIG. 30 performs the color matrix conversion for the received RGB image and generates the bit expansion input image of a gray scale which has only light and shade of a white to a black to transmit the bit expansion input image to the bit expander 531.

The bit expander 531 receives the bit expansion input image from the color matrix converter 130. The bit expander 531 performs the bit expansion process to each pixel of the bit expansion input image to generate LUT input image. The values assigned to the expanded bits are set based on the weighted value calculated from the order relation between the object pixel and the adjacent pixels. The bit expander 531 transmits the generated LUT input image to the look-up table 532.

The look-up table 532 receives the LUT input image which is a bit expansion image data from the bit expander 531. The correlation between luminance values before and after the gray level conversion is registered in the look-up table 532. When the input luminance value corresponds to one of the measured points, the correction coefficients are calculated from the measured value of the output luminance value of the LCD panel where the measuring point is used as the input luminance value and the ideal value of the output luminance value where the measuring point is used as the input luminance value, and the correction coefficients are normalized by the maximum of the luminance value. As a result, the 'LUT value' may be preliminarily calculated and the correlation of the measuring points and the 'LUT value' may be registered in the look-up table 532. In addition, when the input luminance value does not correspond to any of the measured points, the measured values of the measuring points are linearly interpolated between two measuring points having the corresponding luminance value as an interval value to obtain the values corresponding to the measured value of the corresponding input luminance value. Further, the correction coefficients are calculated from the values corresponding to the measured value of the corresponding input luminance value and the ideal value of the corresponding input luminance value, and the correction coefficients are normalized by the maximum of the luminance value. As a result, the 'LUT value' may be preliminarily calculated and the correlation of the input luminance value and the 'LUT value' may be registered in the look-up table 532.

The look-up table 532 performs the gray level conversion for each pixel of the received LUT input image to generate the LUT output image. The look-up table 532 transmits the generated LUT output image to the LV panel 109 as the LV image (i.e., a black-and-white image of a gray scale of an adjusted luminance).

In the fifth embodiment, the luminance histogram of the output luminance value is intended to be flattened. Since some of the output luminance value is omitted due to a calculation error (i.e., rounding error) when the 'correction curve changing the gray level property' including both of the input luminance value and the output luminance value as the correlation of the look-up table of 8 bits is calculated, the luminance histogram of the output luminance value may become crude. Since the input luminance value is bit expanded and a value relating to the luminance value of the adjacent pixels is set with the expanded bit, information smaller than the bit resolution which is rounded and is not used when the original analog image signal is quantized with 8 bits is recovered. Accordingly, the luminance histogram is flattened and the gray level conversion is further flattened.

In the fifth embodiment, similarly to the fourth embodiment, since the RGB image is displayed as the RGB image in the RGB panel 107 through the LCD controller 106 and as the LV image of a gray scale having only light and shade of a white to a black in the LV panel 109 through the LV controller 508, minute control of the contrast ratio, prevention of the black lifting, simple structure of the circuit and low fabrication cost are obtained.

Similarly, since the method for setting the correlation in the look-up table 532 of the fifth embodiment is the same as the method for setting the correlation in the look-up table 431 of the fourth embodiment, the correlation of the input luminance value and the output luminance value of FIG. 34 is the same as the correlation of FIG. 27. Accordingly, as in the fourth embodiment, the gray level property naturally shown to a human is obtained in the fifth embodiment.

FIGS. 35A, 35B, 35C and 35D are views showing an experimental result of an image display device according to a fifth embodiment of the present invention, and FIGS. 36A, 36B, 36C and 36D are views showing a magnified experimental result of an image display device according to a fifth embodiment of the present invention.

FIG. 35A shows an RGB image, FIG. 35B shows a bit expansion input image obtained by performing a color matrix conversion for the RGB image, FIG. 35B shows an LV image obtained by performing a bit expansion by the bit expander and a gray level conversion to the bit expansion input image by the look-up table 532, and FIG. 35D shows a final output image obtained by overlapping the RGB image of FIG. 35A and the LV image of FIG. 35B.

FIGS. 36A to 36D are magnified views of FIGS. 35A to 35D.

In the final output image, the gray level property of a black is improved and the image display having a high contrast ratio is obtained.

FIGS. 37A, 37B, 37C and 37D are histograms with respect to a luminance value of an experimental result image according to fourth and fifth embodiments of the present invention.

Figure 37B:
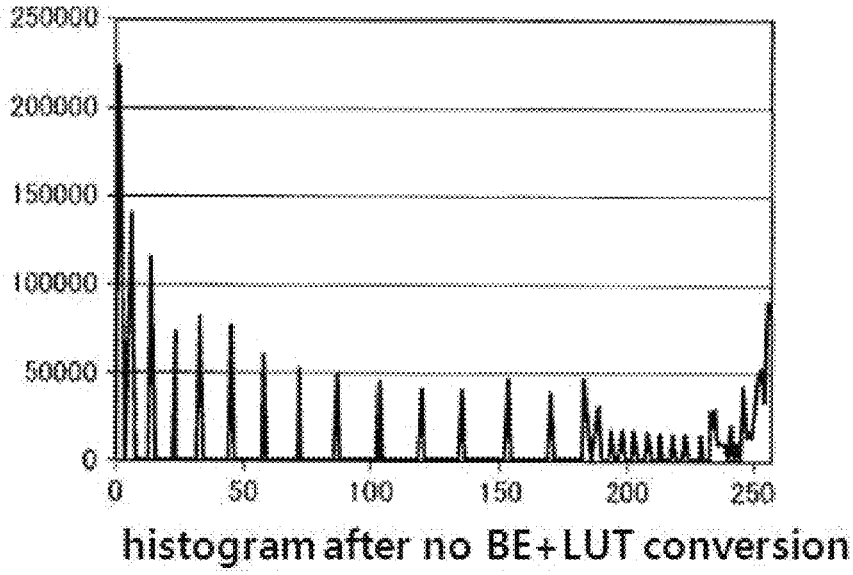
Figure 37C:
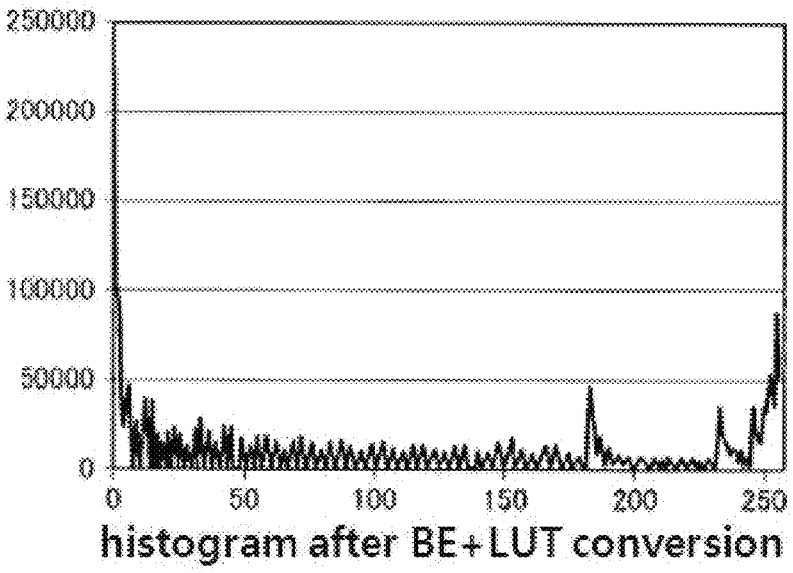

FIG. 37A shows a luminance histogram distribution of the RGB image of FIGS. 28A and 35A, FIG. 37B shows a luminance histogram distribution of the LV image of FIG. 28C where the gray level conversion is performed by the look-up table 431, FIG. 37C shows a luminance histogram distribution of the LV image of FIG. 35B where the gray level conversion is performed by the look-up table 532 after the bit expansion is performed by the bit expander 531. Since the bit expansion is not performed in FIG. 37B, there is an omission in the luminance values. In FIG. 37C where the bit expansion is performed, the omission in the luminance value is reduced and the luminance value distribution is improved as compared with FIG. 37B to be flattened.

Figure 37D:
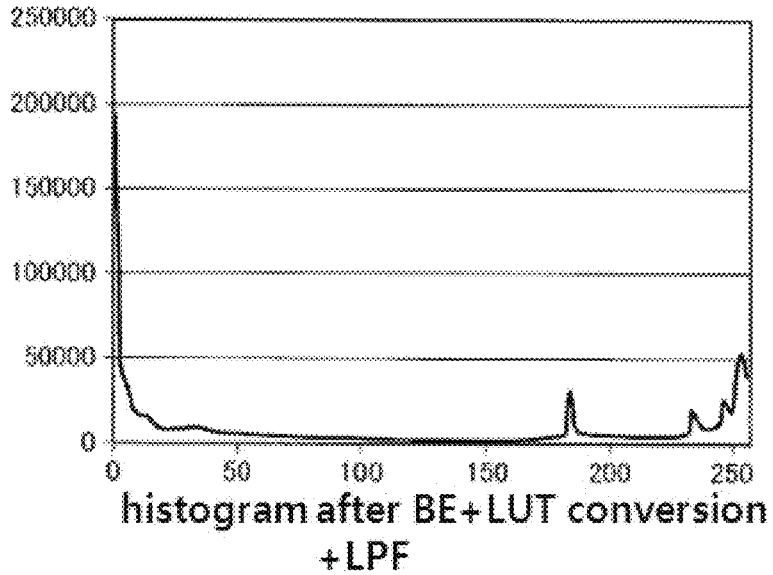

FIG. 37D shows a luminance histogram of an image where a low pass filtering is further applied to the result of FIG. 35C. As a result, more flat distribution is obtained.

In addition, a bit expansion method is not limited to the above-mentioned method and the other method may be applied to the fifth embodiment.

Figure 38:
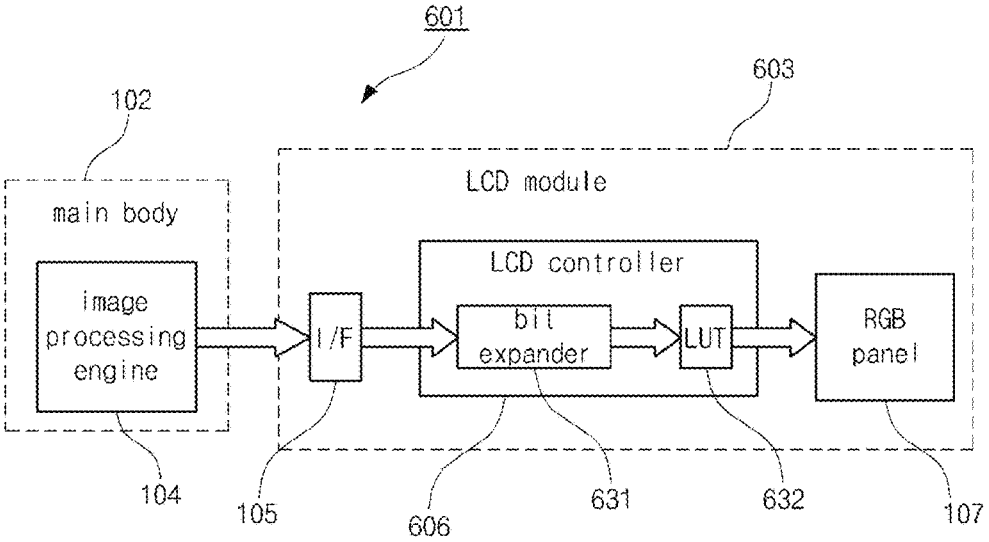
FIG. 38 is a block diagram showing an image display device according to a sixth embodiment of the present invention.

FIG. 38 is a block diagram showing an image display device according to a sixth embodiment of the present invention. A main body 102 of the image display device 601 of the sixth embodiment has the same structure as the main body 102 of the image display device 101 of the first embodiment.

An LCD module 603 of the image display device 601 of the sixth embodiment includes an interface (I/F) 105, an LCD controller 606 and an RGB panel 107. The interface 107 and the RGB panel 107 of the image display device 601 of the sixth embodiment are the same as the interface 107 and the RGB panel 107 of the image display device 101 of the first embodiment. However, differently from the third and fourth embodiments, the image display device 601 does not include an LV controller 408 and 50 and an LV panel 109. Instead, the LCD controller 606 includes a bit expander 631 and a look-up table 632. As a result, a bit expansion and a gray level conversion are performed to an RGB image displayed by the RGB panel 107.

The bit expander 631 may have the same operation as the bit expander 531 of the fifth embodiment. As a result, the bit expander 631 performs the bit expansion process to each pixel of the input image to the bit expander 631 and assigns the value based on the weighted value calculated from the order relation between the object pixel and the adjacent pixels to the expanded bits. The bit expander 631 transmits the generated LUT input image to the look-up table 632.

The look-up table 632 may have the same correlation as the look-up table 532 of the fifth embodiment. When the input luminance value corresponds to one of the measured points, the correction coefficients are calculated from the measured value of the output luminance value of the LCD panel where the measuring point is used as the input luminance value and the ideal value of the output luminance value where the measuring point is used as the input luminance value, and the correction coefficients are normalized by the maximum of the luminance value. As a result, the 'LUT value' may be preliminarily calculated and the correlation of the measuring points and the 'LUT value' may be registered in the look-up table 632. In addition, when the input luminance value does not correspond to any of the measured points, the measured values of the measuring points are linearly interpolated between two measuring points having the corresponding luminance value as an interval value to obtain the values corresponding to the measured value of the corresponding input luminance value. Further, the correction coefficients are calculated from the values corresponding to the measured value of the corresponding input luminance value and the ideal value of the corresponding input luminance value, and the correction coefficients are normalized by the maximum of the luminance value. As a result, the 'LUT value' may be preliminarily calculated and the correlation of the input luminance value and the 'LUT value' may be registered in the look-up table 632.

The difference of bit expander 631 and the look-up table 632 from the bit expander 531 and the look-up table 532 of the fifth embodiment in FIG. 30 is that the bit expander 631 and the look-up table 632 are disposed in the LCD controller 606 of the LCD module 603. While the bit expander 531 and the look-up table 532 are disposed in the LV controller 508 and process the image of a gray scale outputted from the color matrix converter 130 in the LV controller 508 in the fifth embodiment, the bit expander 631 and the look-up table 632 process the RGB image and transmits the processed RGB image to the RGB panel 107. The LCD controller 606 may be constituted such that the processes of the bit expander 631 and the look-up table 632 are performed individually to one of R, G and B of the RGB image, the luminance value selected from the R, G and B or all luminance values.

The look-up table 632 transmits the LUT output image of which the gray level is converted and the luminance is adjusted to the RGB panel 107.

A sequence of displaying an image according to the sixth embodiment will be illustrated hereinafter.

The image processing engine 104 of the main body 102 generates the RGB image displayed by the image display device 601 and transmits the RGB image to the LCD module 603.

The LCD module 603 receives the RGB image through the interface 105, and the interface 105 transmits the RGB image to the LCD controller 606.

The LCD controller 606 receives the RGB image from the interface 105 and transmits the RGB image to the bit expander 631.

The bit expander 631 receives the RGB image from the interface 105. The bit expander 631 performs the bit expansion process to each pixel of the received RGB image (e.g., all luminance values of R, G and B) to generate LUT input image. The values assigned to the expanded bits are set based on the weighted value calculated from the order relation between the object pixel and the adjacent pixels. The bit expander 631 transmits the generated LUT input image to the look-up table 632.

The look-up table 632 receives the LUT input image from the bit expander 631. The correlation between luminance values before and after the gray level conversion is registered in the look-up table 632. When the input luminance value corresponds to one of the measured points, the correction coefficients are calculated from the measured value of the output luminance value of the LCD panel where the measuring point is used as the input luminance value and the ideal value of the output luminance value where the measuring point is used as the input luminance value, and the correction coefficients are normalized by the maximum of the luminance value. As a result, the 'LUT value' may be preliminarily calculated and the correlation of the measuring points and the 'LUT value' may be registered in the look-up table 632. In addition, when the input luminance value does not correspond to any of the measured points, the measured values of the measuring points are linearly interpolated between two measuring points having the corresponding luminance value as an interval value to obtain the values corresponding to the measured value of the corresponding input luminance value. Further, the correction coefficients are calculated from the values corresponding to the measured value of the corresponding input luminance value and the ideal value of the corresponding input luminance value, and the correction coefficients are normalized by the maximum of the luminance value. As a result, the 'LUT value' may be preliminarily calculated and the correlation of the input luminance value and the 'LUT value' may be registered in the look-up table 632.

The look-up table 632 performs the gray level conversion for each pixel of the received LUT input image (e.g., all luminance values of R, G and B) and generates the gray level converted RGB image as the LUT output image. The look-up table 632 transmits the generated LUT output image to the RGB panel 107.

The RGB panel 107 displays the RGB image received from the LCD controller 606.

In the sixth embodiment, the look-up table 632 which has the same function as the look-up tables 431 and 532 of the fourth and fifth embodiments performs the gray level conversion to the RGB image without changing to a gray scale image. Accordingly, similarly to the fourth and fifth embodiments, minute control of the contrast ratio for preventing deterioration of the gamma conversion by the broken lines may be obtained and the gray level property naturally shown to a human may be obtained.

In addition, the bit expander 631 has the same function as the bit expander 531 of the fifth embodiment. Accordingly, similarly to the fifth embodiment, the gray level conversion property by the look-up table may be further flattened.

Although the RGB image is bit expanded by the bit expander 631 and is gray level converted by the look-up table 632 in the sixth embodiment, the bit expander 631 may be omitted for reducing product cost. When the bit expander 631 is omitted, the RGB image may be directly input to the look-up table 632 without the bit expansion. In addition, the look-up table 632 may have the same correlation as the look-up table 431 of the fourth embodiment for the gray level conversion.

Figure 39:
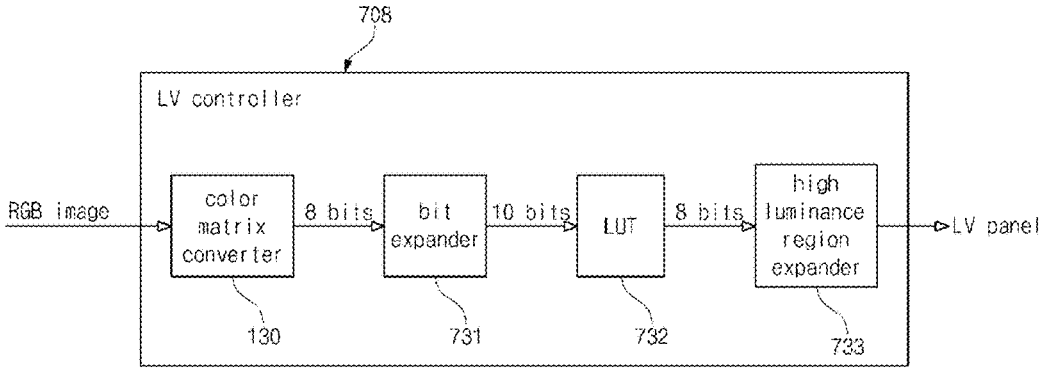
FIG. 39 is a block diagram showing an LV controller of an image display device according to a seventh embodiment of the present invention.

FIG. 39 is a block diagram showing an LV controller of an image display device according to a seventh embodiment of the present invention. A structure of the seventh embodiment is the same as a structure of the first embodiment except for the LV controller 708.

In FIG. 39, an LV controller 708 includes a color matrix converter 130, a bit expander 731, a look-up table (LUT) 732 and a high luminance region expander 733.

The color matrix converter 130 is the same as that of the first embodiment. The color matrix converter 130 performs a color matrix conversion to generate a bit expansion input image of a gray scale and transmits the bit expansion input image to the bit expander 731.

The bit expander 731 is the same as the bit expander 531 of the fifth embodiment. The bit expander 731 receives the bit expansion input image from the color matrix converter 130 and expands the luminance value of each pixel of the bit expansion input image. The bit expander 731 transmits the bit expansion image (i.e., the LUT input image) of the bit which is expanded by a value reflecting the order relation between the object pixel and the adjacent pixels as a weighted value to the look-up table 732.

The look-up table 732 is the same as the look-up table 532 of the fifth embodiment. The look-up table 732 receives the bit expansion image (i.e., the LUT input image) from the bit expander 731 and generates the LUT output image by performing the gray level conversion to the received bit expansion image. The look-up table 732 transmits the LUT output image to the high luminance region expander 733.

The high luminance region expander 733 performs a local signal process to a peak in a high luminance region of the LUT output image and generates a high luminance region expansion image by expanding the high luminance region. This process of signaling and expansion may be referred to as a peak hold process.

Figure 40:
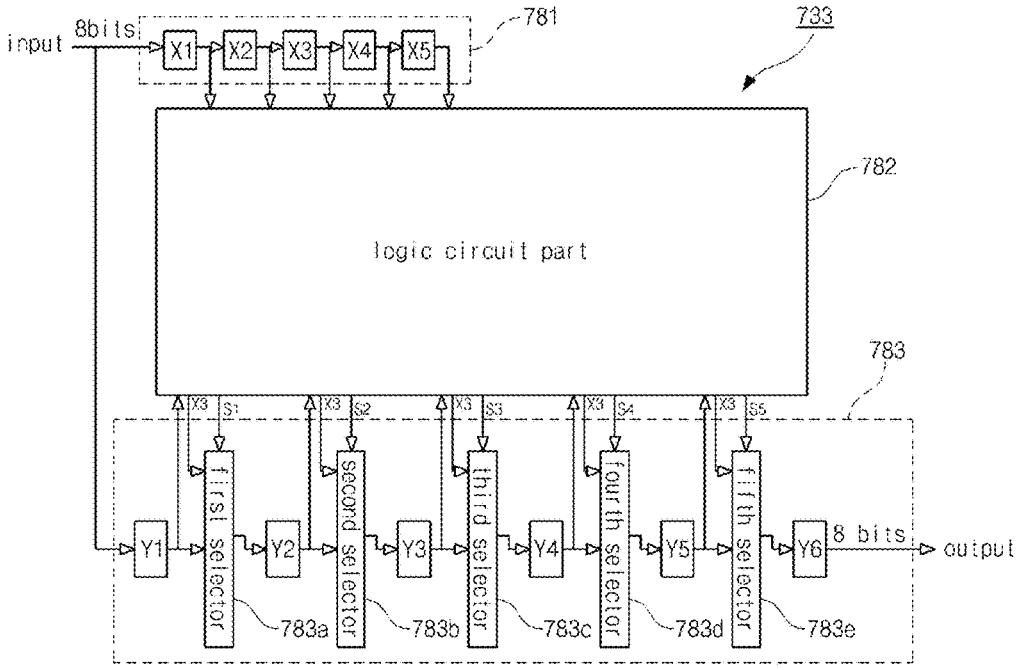
FIG. 40 is a view showing a circuit of a high luminance region expander of an image display device according to a seventh embodiment of the present invention.

FIG. 40 is a view showing a circuit of a high luminance region expander of an image display device according to a seventh embodiment of the present invention.

In FIG. 40, the high luminance region expander 733 includes a pixel storing part 781, a logic circuit part 782 and an output part 783. The pixel storing part 781 includes registers X1 to X5. The output part 783 includes registers Y1 to Y6 and first to fifth selectors 783*a* to 783*e*. Although the pixel storing part 781 includes 5 registers in the seventh embodiment, the number of registers is not limited to 5.

The pixel storing part 781 receives the LUT output image from the look-up table 732. Here, it is assumed that the luminance values of the pixels of each horizontal line of the LUT output image are sequentially received from the left-most pixel toward a left direction by one pixel. The pixel storing part 781 stores the luminance value in the register X1. The registers X1 to X5 are sequentially connected to each other such that the output of the previous register Xi is connected to the input of the next register Xi+1. When the process for one pixel is completed, each register transmits the value stored therein to the next register. When the pixel storing part 781 receives the next luminance value, the value in the register X1 is transmitted to the register X2 and the newly received luminance value is stored in the register X1. As a result, the pixel corresponding to the luminance value stored in the register X3 is the object pixel, and total 5 pixels at left and right of the object pixel (i.e., the pixels of horizontal 5 tabs with the object pixel as a center) are stored in the registers X1 to X5. When the process cycle is performed, the values in the previous registers are shifted to the next registers by one value.

The output part 738 receives the LUT output image at the same timing as the pixel storing part 781. Similarly to the pixel storing part 781, the registers are sequentially connected to each other, and each register transmits the value stored therein to the next register when the process for one pixel is completed. The difference of the output part 738 from the pixel storing part 781 is that the first to fifth selectors 783*a* to 783*e* are interposed between the previous register Yi and the next register Yi+1. The output of the previous register Yi is connected to a first input of each of the first to fifth selectors 783*a* to 783*e*, and the register X3 outputted from the logic circuit part 782 (i.e., the luminance value of the object pixel) is supplied to a second input of each of the first to fifth selectors 783*a* to 783*e*.

In addition, the selection signals S1 to S5 outputted from the logic circuit part 782 are supplied to each of the first to fifth selectors 783*a* to 783*e*. After the process for the object pixel is completed, the output part 783 selects one of the luminance value X3 of the object pixel and the value stored in the previous register Yi as a value that will be stored in each register Yi+1 at next step according to the judgment of the logic circuit part 782 (i.e., the selection signals S1 to S5). For example, when the selection signal S1 is 1, the luminance value X3 of the object pixel is selected as the next value of the next register Y2. When the selection signal S1 is 0, the value of the register Y1 is selected as the next value of the next register Y2. As a result, each of the registers Y1 to Y6 receives the same input as the pixel storing part 781 and is continuously updated by the luminance value X3 of the object pixel according to the judgment of the logic circuit part 782 to transmit the value stored therein to the next register Yi+1.

The output of the registers X1 to X5 and the output of the registers Y1 to Y5 are connected to the logic circuit part 782. The logic circuit part 782 receives the luminance values of 5 pixels from the registers X1 to X5 and receives the luminance values of 5 pixels updated through the process from the registers Y1 to Y5. Based on the inputs, the logic circuit part 782 judges whether each register need to be updated by the value of the object pixel and transmits the result of the judgment to each of the first to fifth selectors 783*a* to 783*e* of the output part 783 as the selection signals S1 to S5.

In the seventh embodiment, the high luminance region expander 733 performs the peak hold process, and the logic circuit part 782 generates the selection signals S1 to S5 for the peak hold process. In the peak hold process, when the luminance value X3 of the object pixel is the maximum or the local maximum of the luminance values stored in the registers X1 to X5, the selection signal is set as 1.

Figure 41:
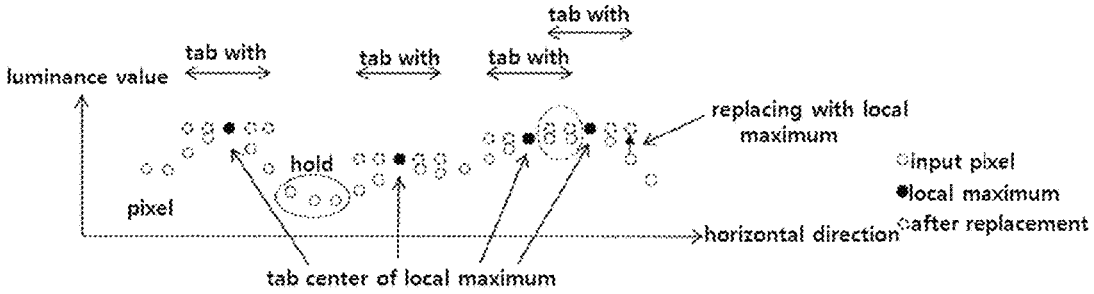
FIG. 41 is a view showing a peak hold process in an image display device according to a seventh embodiment of the present invention.

FIG. 41 is a view showing a peak hold process in an image display device according to a seventh embodiment of the present invention.

In FIG. 41, a horizontal axis represents the pixel sequentially arranged in a horizontal line, and a vertical axis represents the luminance value of each pixel. A white circle represents the original luminance value corresponding to each pixel of the LUT output image and input to the high luminance region expander 733. A black circle represents the luminance value which is the maximum or the local maximum of 5 serial pixels including the object pixel, 2 left pixels of the object pixel and 2 right pixels of the object pixel. In the peak hold process, when the object pixel corresponds to the black circle, the selection signals S1 to S5 are determined such that the luminance values of the 5 serial pixels are updated to the luminance value of the object pixel (i.e., the black circle).

When the luminance value X3 is greater than a first threshold value and a difference between the maximum and the minimum of the luminances of the 5 serial pixels including the object pixel is greater than a second threshold value, the process of the logic circuit part 782 is performed. As a result, the process is performed when the local maximum has a relatively high luminance value and the difference of the luminance of the local maximum and the luminances of the adjacent pixels is relatively great.

The output part 783 sequentially outputs the luminance values by one pixel and the luminance values outputted from the output part 783 constitute the high luminance region expansion image. The high luminance region expander 733 generates the high luminance region expansion image (i.e., the LV image (a black-and-white image of a gray scale of an adjusted luminance)) and transmits the high luminance region expansion image to the LV panel 109.

A sequence of displaying an image according to the seventh embodiment will be illustrated hereinafter.

As shown in FIG. 4, the image processing engine 104 of the main body 102 generates the RGB image displayed by the image display device 101 and transmits the RGB image to the LCD module 103.

The LCD module 103 receives the RGB image through the interface 105, and the interface 105 transmits the RGB image to the LCD controller 106 and the LV controller 708.

The LCD controller 106 receives the RGB image from the interface 105 and processes the RGB image to transmit the RGB image to the RGB panel 107.

The RGB panel 107 displays the RGB image received from the LCD controller 106.

The LV controller 708 as the LCD controller 106 receives the RGB image from the interface 105.

The color matrix converter 130 of the LV controller 708 of FIG. 39 performs the color matrix conversion for the received RGB image and generates the bit expansion input image of a gray scale which has only light and shade of a white to a black to transmit the bit expansion input image to the bit expander 731.

The bit expander 731 receives the bit expansion input image from the color matrix converter 130 and generates the bit expansion image (i.e., the LUT input image) by expanding the bit number of the luminance value of each pixel of the bit expansion input image. The values assigned to the expanded bits are set based on the weighted value calculated from the order relation between the object pixel and the adjacent pixels. The bit expander 731 transmits the LUT input image to the look-up table 732.

The look-up table 732 receives the LUT input image from the bit expander 731. The correlation between luminance values before and after the gray level conversion is registered in the look-up table 732.

The look-up table 732 performs the gray level conversion for each pixel of the received LUT input image to generate the LUT output image. The look-up table 732 transmits the LUT output image to the high luminance region expander 733.

The high luminance region expander 733 performs the local signal process to the peak in the high luminance region of the LUT output image and generates the high luminance region expansion image by expanding the high luminance region. When the luminance value of the object pixel is the maximum or the local maximum in a horizontal n tab including the object pixel, the high luminance region is expanded by replacing the luminance value of each pixel in the horizontal n tab with the luminance value of the object pixel.

The high luminance region expander 733 of FIG. 40 receives the LUT output image from the look-up table 732. The received LUT output image is input to the pixel storing part 781 and the output part 783 by one pixel. The pixel storing part 781 stores the luminance values of the pixels in the horizontal n tab of the horizontal line.

Figure 42:
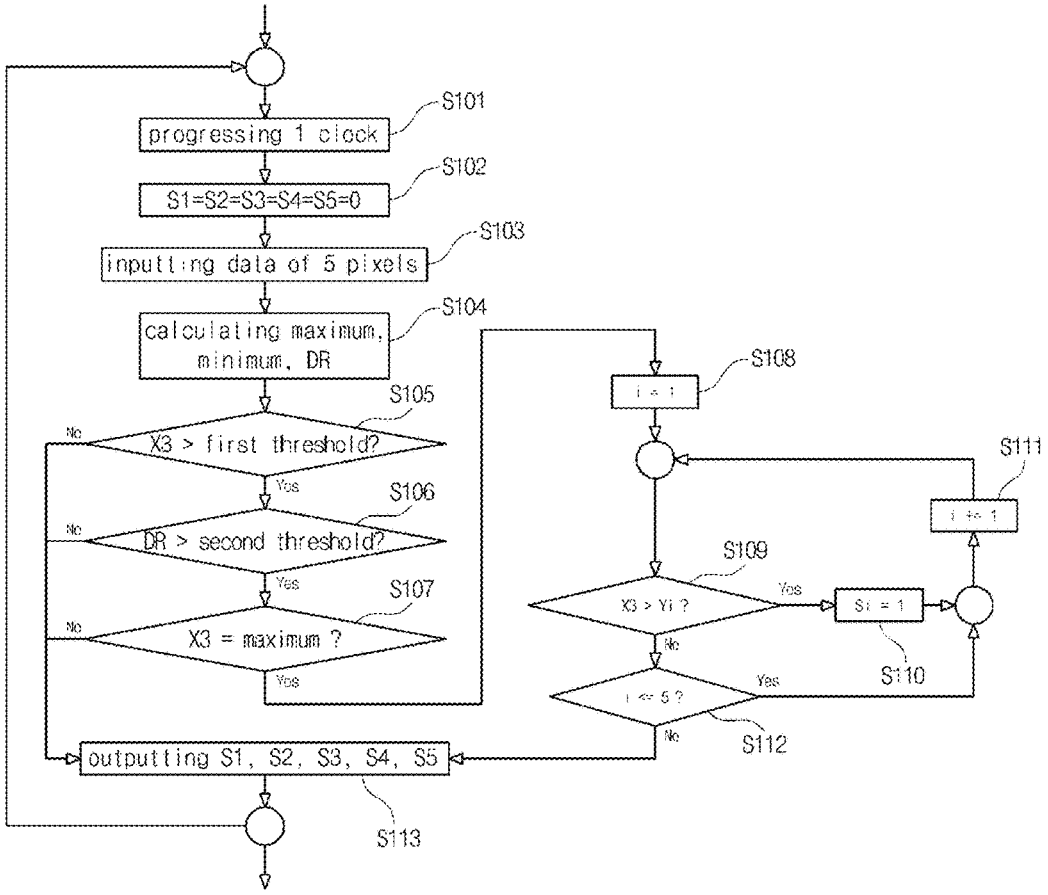
FIG. 42 is a flow chart showing a peak hold process in an image display device according to a seventh embodiment of the present invention.

FIG. 42 is a flow chart showing a peak hold process in an image display device according to a seventh embodiment of the present invention.

In FIG. 42, one clock is progressed (step S101) and each of the selection signals S1 to S5 is initialized as 0 (step S102). The logic circuit part 782 receives the luminance values of the 5 serial pixels (5 tab) from the registers X1 to X5 of the pixel storing part 781 (step S103). The logic circuit part 782 calculates the maximum and the minimum of the registers X1 to X5 and a dynamic range DR (i.e., a difference between the maximum and the minimum) (step S104).

The logic circuit part 782 judges whether the register X3 is greater than the first threshold value, whether the dynamic range DR is greater than the second threshold value and whether the register X3 is the maximum of the registers X1 to X5 (step S105). When the judgment results are true (Yes) (i.e., the luminance value X3 of the object pixel belongs to the high luminance region having a luminance brighter than a reference, the luminance value X3 of the object pixel is the maximum among the luminance values X1 to X5 of the adjacent pixels, and the luminance value X3 of the object pixel has the difference greater than a reference as compared with the luminance values X1 to X5 of the adjacent pixels), the logic circuit part 782 judges that the replacement of the luminance values X1 to X5 of the adjacent pixels with the luminance value X3 of the object pixel has a definite effect and sets the selection signals S1 to S5. When one of the judgment results is not true (No), the logic circuit part 782 outputs the selection signals S1 to S5 having the initial value of 0 of step S102. As a result, 0 is supplied to all of the first to fifth selectors 783*a* to 783*e* as the selection signals, each register Yi+1 receives the previous register Yi, and none of values is replaced with the luminance value X3 of the object pixel.

When the judgment results of the steps S105, S106 and S107 are true, the setting process of the selection signals S1 to S5 is performed. The variable i is initialized (step S108). Next, the value of the register Yi is compared with the luminance value X3 of the object pixel (step S109). When the luminance value X3 of the object pixel is greater than the register Yi, the selection signal S1 is set as 1 (step S110). Basically, each value of the registers Y is replaced with the luminance value X3 of the object pixel by setting all of the selection signals S1 to S5 as 1. However, the luminance value of the initial state of the registers Y may be already replaced as a result of the peak hold process for the object pixel in the previous process cycle. Accordingly, the condition judgment of the step S109 is performed and the value of the registers Y is not updated (i.e., the selection signal S1 is maintained as 0) when the luminance value X3 of the object pixel of the present cycle is smaller than the value of the registers which has a possibility of update. As a result, the maximum luminance value that the corresponding pixel may have is maintained.

The logic circuit part 782 increases the variable i by increment (step S111) and repeatedly performs the comparison process for the registers Y1 to Y5 and the setting process for the selection signals S1 to S5. When the comparison process for the registers Y1 to Y5 and the setting process for the selection signals S1 to S5 are completed (step S112), the logic circuit part 782 outputs the selection signals S1 to S5 to the output part 783 (step S113).

The output part 783 receives the selection signals S1 to S5 and the luminance value X3 of the object pixel, updates the values of the registers Y2 to Y6 and outputs the luminance values of the results of the peak hold process by one pixel for one cycle.

The high luminance region expander 733 transmits the output of the output part 783 to the LV panel 109 as the high luminance region expansion image (i.e., LV image (i.e., a black-and-white image of a gray scale of an adjusted luminance)).

As a result, the luminance value X3 of the object pixel is supplied to the pixel belonging to the region judged that the update of the luminance value after the peak hold process is required in the LV image, and the corresponding pixel is displayed with a brighter luminance by the luminance value X3 of the object pixel. The RGB image is simultaneously displayed in the RGB panel 107 through the LCD controller 106 as the RGB image and in the LV panel 109 through the LV controller 408 as the LV image of a gray scale which has only light and shade of a white to a black.

Since the RGB panel 107 as a front LCD panel and the LV panel 109 as a rear LCD panel overlap each other as shown in FIG. 5, the light emitted from the light source 120 through the backlight unit 110 sequentially passes the LV panel 109 where the LV image based on the RGB image is displayed and the RGB panel 107 where the RGB image is displayed to reach an eye of a human. While the light passes through the LV panel 109 and the RGB panel 107, the color and the luminance of the light are controlled by the CF substrate 111 of the RGB panel 107 and the liquid crystal layers (not shown) of each of the LV panel 109 and the RGB panel 107.

Since the luminance may be individually controlled by each of the LV panel 109 and the RGB panel 107, the contrast ratio may be minutely controlled.

The light emitting from the backlight unit 110 and reaching an eye of a human through the LV panel 109 and the RGB panel 107 has a transmittance obtained by multiplication of a transmittance of the LV panel 109 and a transmittance of the RGB panel 107.

In the seventh embodiment, since the correspondence graph of the input luminance value and the output luminance value in the look-up table 732 may be the same as FIG. 34, minute control of the contrast ratio, prevention of the black lifting, simple structure of the circuit and low fabrication cost are obtained similarly to the fifth embodiment.

Similarly, since the method for setting the correlation in the look-up table 732 of the seventh embodiment is the same as the method for setting the correlation in the look-up table 532 of the fifth embodiment, the correlation of the input luminance value and the output luminance value is the same as the correlation of FIG. 34. Accordingly, as in the fifth embodiment, the gray level property naturally shown to a human is obtained in the seventh embodiment.

FIGS. 43A, 43B, 43C and 43D are views showing an experimental result of an image display device according to a seventh embodiment of the present invention, and FIGS. 44A, 44B, 44C and 44D are views showing a magnified experimental result of an image display device according to a seventh embodiment of the present invention.

Figures 43A, 43B, 43C, 43D:
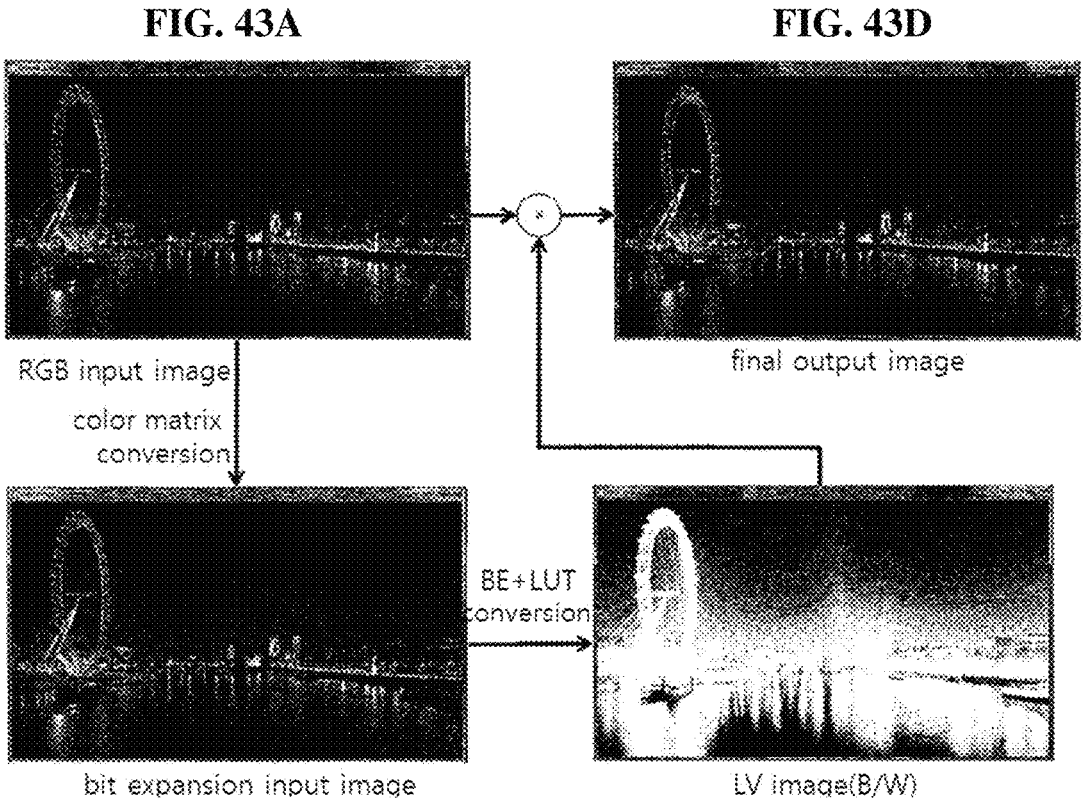
FIGS. 43A, 43B, 43C and 43D are views showing an experimental result of an image display device according to a seventh embodiment of the present invention.

FIG. 43A shows an RGB image, FIG. 43B shows a bit expansion input image obtained by performing a color matrix conversion for the RGB image, FIG. 43C shows an LV image obtained by performing a bit expansion by the bit expander and a gray level conversion and a peak hold process to the bit expansion input image by the look-up table 732, and FIG. 43D shows a final output image obtained by overlapping the RGB image of FIG. 43A and the LV image of FIG. 43C.

FIGS. 44A to 44D are magnified views of FIGS. 43A to 43D.

In the final output image, the gray level property of a black is improved and the image display having a high contrast ratio is obtained. Further, a dual image and a color distortion at an edge are prevented.

An image display device according to an eighth embodiment of the present invention will be illustrated hereinafter. A structure of the eighth embodiment is the same as a structure of the seventh embodiment except for the high luminance region expander 733.

In the high luminance region expander 733 of the eighth embodiment, an edge hold process instead of the peak hold process is performed. The high luminance region expander 733 performs the local signal process to an edge of the high luminance region of the LUT output image and generates the high luminance region expansion image by expanding the high luminance region.

Similarly to the seventh embodiment, the high luminance region expander 733 of the eighth embodiment includes the pixel storing part 781, the logic circuit part 782 and the output part 783. The pixel storing part 781 includes registers X1 to X5, and the output part 783 includes registers Y1 to Y6 and first to fifth selectors 783*a* to 783*e*.

In addition, connection and operation of the registers X1 to X5 of the pixel storing part 781 and connection and operation of the registers Y1 to Y6 and the first to fifth selectors 783*a* to 783*e* of the output part 783 of the eighth embodiment are the same as those of the seventh embodiment.

The process of the high luminance region expander 733 of the logic circuit part 782 of the eighth embodiment is different from those of the seventh embodiment. The high luminance region expander 733 performs the edge hold process and the logic circuit part 782 sets the selection signals S1 to S5 for the edge hold process. In the edge hold process, when the luminance value X3 of the object pixel is greater than the luminance value X1 and X2 in the registers (i.e., the luminance values of the pixels at left of the object pixel), 1 is set as the selection signal. In addition, when the luminance value X3 of the object pixel is greater than the luminance value X4 and X5 in the registers (i.e., the luminance values of the pixels at right of the object pixel), 1 is set as the selection signal.

FIG. 45 is a view showing an edge peak process in an image display device according to an eighth embodiment of the present invention.

In FIG. 45, a horizontal axis represents the pixel sequentially arranged in a horizontal line, and a vertical axis represents the luminance value of each pixel. A white circle represents the original luminance value corresponding to each pixel of the LUT output image and input to the high luminance region expander 733. In the edge hold process, the luminance value of the object pixel is compared with the luminance values of total 5 pixels at left and right of the object pixel. When the luminance value of the pixel at left or right of the object pixel is smaller than the luminance value of the object pixel, the selection signals S1 to S5 are set such that the luminance value of the pixel at left or right of the object pixel is updated with the luminance value of the object pixel.

When the luminance value X3 is greater than a third threshold value and a difference between the luminance value of the object pixel and the luminance value of the pixel at left or right of the object pixel is greater than a fourth threshold value, the process of the logic circuit part 782 is performed. As a result, the process is performed when the edge has a relatively high luminance value and the difference of the luminance of the edge and the luminances of the adjacent pixels is relatively great.

The output part 783 sequentially outputs the luminance values by one pixel and the luminance values outputted from the output part 783 constitute the high luminance region expansion image. The high luminance region expander 733 generates the high luminance region expansion image (i.e., the LV image (a black-and-white image of a gray scale of an adjusted luminance)) and transmits the high luminance region expansion image to the LV panel 109.

A sequence of displaying an image according to the eighth embodiment will be illustrated hereinafter. Since the difference of the eighth embodiment from the seventh embodiment is the process of the logic circuit part 782, the process of the logic circuit part 782 will be illustrated.

The high luminance region expander 733 performs the local signal process to the edge in the high luminance region of the LUT output image and generates the high luminance region expansion image by expanding the high luminance region. When the luminance value of the object pixel is greater than the luminance value of the pixel at left of the object pixel, the luminance value of the pixel at left of the object pixel is replaced with the luminance value of the object pixel. When the luminance value of the object pixel is greater than the luminance value of the pixel at right of the object pixel, the luminance value of the pixel at right of the object pixel is replaced with the luminance value of the object pixel. As a result, the high luminance region is expanded.

The high luminance region expander 733 of FIG. 40 receives the LUT output image from the look-up table 732. The received LUT output image is input to the pixel storing part 781 and the output part 783 by one pixel. The pixel storing part 781 stores the luminance values of the pixels in the horizontal n tab of the horizontal line.

FIG. 46 is a flow chart showing an edge hold process in an image display device according to an eighth embodiment of the present invention.

In FIG. 46, one clock is progressed (step S201) and each of the selection signals S1 to S5 is initialized as 0 (step S202). The logic circuit part 782 receives the luminance values of the 5 serial pixels (5 tab) from the registers X1 to X5 of the pixel storing part 781 (step S203).

The logic circuit part 782 judges whether the register X3 is greater than the third threshold value (step S204). When the judgment result is true (Yes) (i.e., the luminance value X3 of the object pixel belongs to the high luminance region having a luminance brighter than a reference), the logic circuit part 782 performs the edge hold process. When the judgment result is not true (No), the logic circuit part 782 outputs the selection signals S1 to S5 having the initial value of 0 of step S202. As a result, 0 is supplied to all of the first to fifth selectors 783*a* to 783*e* as the selection signals, each register Yi+1 receives the previous register Yi, and none of values is replaced with the luminance value X3 of the object pixel.

When the judgment result of the steps S204 is true, the logic circuit part 782 calculates the left difference Left between the luminance value X3 of the object pixel and the luminance value X2 of the left pixel (step S205) and judges whether the left difference Left is greater than the fourth threshold value (step S206). When the judgment result of step S206 is true (i.e., the left difference Left is greater than the fourth threshold value), the logic circuit part 782 performs the edge hold process to the luminance values X2 and X1 of the left pixels. When the judgment result of step S206 is not true, the logic circuit part 782 compares the luminance value X3 of the object pixel with the luminance values of the right pixels (step S212).

When the left difference Left is greater than the fourth threshold value, the variable i is initialized (step S207). Next, the value of the register Yi is compared with the luminance value X3 of the object pixel (step S208). When the luminance value X3 of the object pixel is greater than the register Yi, the selection signal S1 is set as 1 (step S209). Similarly to the step S109 of the peak hold process, the condition judgment of the step S208 is performed for preventing the replacement with a smaller value.

The logic circuit part 782 increases the variable i by increment (step S210) and repeatedly performs the comparison process for the registers Y1 and Y2 and the setting process for the selection signals S1 and S2. When the comparison process for the registers Y1 and Y2 and the setting process for the selection signals S1 and S2 are completed (step S211), the logic circuit part 782 compares the luminance value X3 of the object pixel and the luminance values of the right pixels.

In the comparison process of the luminance value X3 of the object pixel and the luminance values of the right pixels, the logic circuit part 782 calculates the right difference Right between the luminance value X3 of the object pixel and the luminance value X4 of the right pixel (step S212) and judges whether the right difference Right is greater than the fourth threshold value (step S213). When the judgment result of step S213 is true (i.e., the right difference Right is greater than the fourth threshold value), the logic circuit part 782 performs the edge hold process to the luminance values X4 and X5 of the right pixels. When the judgment result of step S206 is not true, the logic circuit part 782 transmits the selection signals S1 to S5 which are set in the comparison process of the luminance value X3 of the object pixel and the luminance values of the left pixels to the output part 783 (step S219).

When the right difference Right is greater than the fourth threshold value, the variable i is initialized as 3 (step S214). Next, the value of the register Yi is compared with the luminance value X3 of the object pixel (step S215). When the luminance value X3 of the object pixel is greater than the register Yi, the selection signal S1 is set as 1 (step S216). Similarly to the step S109 of the peak hold process, the condition judgment of the step S215 is performed for preventing the replacement with a smaller value.

The logic circuit part 782 increases the variable i by increment (step S217) and repeatedly performs the comparison process for the registers Y3 to Y5 and the setting process for the selection signals S3 to S5. When the comparison process for the registers Y3 to Y5 and the setting process for the selection signals S3 to S5 are completed (step S218), the logic circuit part 782 outputs the selection signals S1 to S5 to the output part 783 (step S219).

The output part 783 receives the selection signals S1 to S5 and the luminance value X3 of the object pixel, updates the values of the registers Y2 to Y6 and outputs the luminance values of the results of the edge hold process by one pixel for one cycle.

The high luminance region expander 733 transmits the output of the output part 783 to the LV panel 109 as the high luminance region expansion image (i.e., LV image (i.e., a black-and-white image of a gray scale of an adjusted luminance)).

As a result, the luminance value X3 of the object pixel is supplied to the pixel belonging to the region judged that the update of the luminance value after the edge hold process is required in the LV image, and the corresponding pixel is displayed with a brighter luminance by the luminance value X3 of the object pixel.

Although the edge hold process of the eighth embodiment is different from the peak hold process of the seventh embodiment, the edge hold process and the peak hold process may commonly expand the high luminance region. As a result, a dual image and a color distortion at an edge are prevented similarly to the seventh embodiment.

In principle, the peak hold process is effective to an image including only one point of a bright peak. However, when the pixels having a similar luminance value gathers, the peak hold process is not sufficient. In this case, the high luminance region may be effectively expanded by the edge hold process. The structure of the logic circuit 782 for the edge hold process is more complicated than the structure of the logic circuit 782 for the peak hold process. Accordingly, one of the peak hold process and the edge hold process may be selected by a trade-off between a product cost and a circuit performance.

Since the image display device of the eighth embodiment is the same as the image display device of the seventh embodiment except for the logic circuit 782, minute control of the contrast ratio, prevention of the black lifting, the gray level property naturally shown to a human, prevention of a dual image and a color distortion and low fabrication cost are obtained similarly to the seventh embodiment.

Figures 48A, 48B, 48C, 48D:
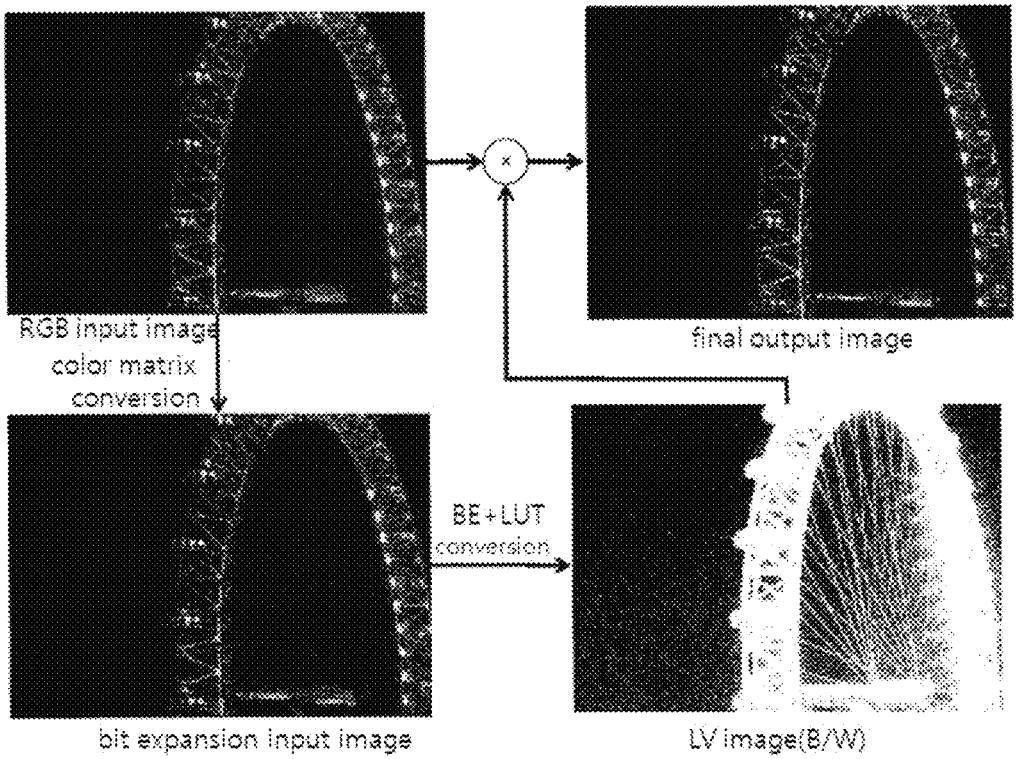
FIGS. 48A, 48B, 48C and 48D are views showing a magnified experimental result of an image display device according to an eighth embodiment of the present invention.

FIGS. 47A, 47B, 47C and 47D are views showing an experimental result of an image display device according to an eighth embodiment of the present invention, and FIG. 48 is a view showing a magnified experimental result of an image display device according to an eighth embodiment of the present invention.

FIG. 47A shows an RGB image, FIG. 47B shows a bit expansion input image obtained by performing a color matrix conversion for the RGB image, FIG. 47C shows an LV image obtained by performing a bit expansion by the bit expander and a gray level conversion and an edge hold process to the bit expansion input image by the look-up table 732, and FIG. 47D shows a final output image obtained by overlapping the RGB image of FIG. 47A and the LV image of FIG. 47C.

FIGS. 48A to 48D are magnified views of FIGS. 47A to 47D.

In the final output image, the gray level property of a black is improved and the image display having a high contrast ratio is obtained. Further, a dual image and a color distortion at an edge are prevented.

In the seventh and eighth embodiments, since a group of pixels of one horizontal line is input to the high luminance region expander 733, the peak hold process and the edge hold process are performed with reference to the luminance values of the pixels in the same horizontal line as the object pixel (i.e., the pixels adjacent to the object pixel along a horizontal direction). In another embodiment, the peak hold process and the edge hold process may be performed with reference to the luminance values of the pixels in the same vertical line as the object pixel, thereby the peak hold process and the edge hold process expanding two-dimensionally.

In another embodiment, the peak hold process and the edge hold process may be performed along the vertical direction by changing the scan direction.

In the peak hold process, when the luminance value of the object pixel is the maximum or the local maximum in a vertical n tab including the object pixel, the high luminance region may be expanded by replacing the luminance value of each pixel in the vertical n tab with the luminance value of the object pixel.

In the edge hold process, when the luminance value of the object pixel is greater than the luminance values of the upper pixels of the object pixel in a vertical n tab including the object pixel, the high luminance region may be expanded by replacing the luminance values of the upper pixels in the vertical n tab with the luminance value of the object pixel. In addition, when the luminance value of the object pixel is greater than the luminance values of the lower pixels of the object pixel in a vertical n tab including the object pixel, the high luminance region may be expanded by replacing the luminance values of the lower pixels in the vertical n tab with the luminance value of the object pixel.

In the edge hold process along the vertical direction, a dual image and a color distortion at an edge along the vertical direction may be prevented.

In the seventh and eighth embodiments, the high luminance region expander 733 receives the LUT output image from the look-up table 732 and performs the process to the LUT output image. In another embodiment, the high luminance region expander 733 may be disposed between the bit expander 731 and the look-up table 732. The high luminance region expander 733 may receive the bit expansion image from the bit expander 731 and may perform the high luminance region expansion to provide the result image to the look-up table 732. The look-up table 732 may perform the gray level conversion to generate the LUT output image and may transmit the LUT output image to the LV panel 109 as the LV image (a black-and-white image of a gray scale of an adjusted luminance). In the seventh and eighth embodiments, since the high luminance region expander 733 and the look-up table 732 perform the luminance adjustment for the image of a gray scale, the sequence of the processes of the high luminance region expander 733 and the look-up table 732 may be changed.

When the sequence of the processes is changed, the bit number of the luminance value expanded in the bit expander 731 may be reduced in the look-up table 732 after passing through the high luminance region expander 733. As a result, the circuit size of the high luminance region expander 733 which processes with the expanded bit number may increase.

To prevent increase of the circuit size, the bit expander 731 may be omitted so that the image data can be transmitted through the color matrix converter 130, the high luminance region expander 733 and the look-up table 732. The high luminance region expander 733 may receive the color matrix conversion image from the color matrix converter 130 and may perform the high luminance expansion process. The high luminance region expander 733 may transmit the result image (LUT input image) to the look-up table 732 and the look-up table 732 may perform the gray level conversion to generate the LUT output image. The look-up table 732 may transmit the LUT output image to the LV panel 109 as the LV image (a black-and-white image of a gray scale of an adjusted luminance).

Alternatively, in the structure of the LV controller 708 of FIG. 39 of the seventh and eighth embodiments, the bit expander 731 may be omitted so that the image data can be transmitted through the color matrix converter 130, the look-up table 732 and the high luminance region expander 733. The look-up table 732 may receive the color matrix conversion image from the color matrix converter 130 and may perform the gray level conversion. The look-up table 732 may transmit the result image (LUT output image) to the high luminance region expander 733 and the high luminance region expander 733 may perform the high luminance region expansion to generate the high luminance region expansion image. The high luminance region expander 733 may transmit the high luminance region expansion image to the LV panel 109 as the LV image (a black-and-white image of a gray scale of an adjusted luminance).

In the seventh and eighth embodiments, the look-up table 732 performs the gray level conversion with change of the bit number such that the input luminance value of the expanded bit number is converted to the output luminance value of the original bit number. When the bit expander 731 is omitted, the look-up table 732 may perform the gray level conversion without change of the bit number such that the input luminance value and the output luminance value have the same original bit number.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of displaying an image using an image display device including a front LCD panel and a rear LCD panel overlapping each other, comprising:

displaying an RGB image in the front LCD panel;

generating a black-and-white image having a luminance value adjusted by a pixel by signal-processing the RGB image, which includes generating an LUT input image from the RGB image through a color matrix conversion and converting a luminance value of the LUT input image expressed with N bits into a maximum luminance value ($2^N-1$) or one of 0 to 'the maximum luminance value-1 ($2^N-2$)' according to a function depending on whether or not the luminance value of the LUT input image is equal to or greater than a reference value, wherein N is an integer greater than 2, to generate an LUT output image; and displaying the black-and-white image in the rear LCD panel, wherein generating the black-and-white image comprises:

generating a binary data by binarizing a luminance value of a pixel of the LUT output image;

generating one of a high luminance region expansion binary data and a low luminance region reduction binary data by expanding a high luminance region of the binary data and by reducing a low luminance region of the binary data; and replacing the luminance value of the pixel of the LUT output image with a high luminance data representing the high luminance region when the pixel of one of the high luminance region expansion binary data and the low luminance region reduction binary data belong to the high luminance region and not replacing the luminance value of the pixel of the LUT output image when the pixel of one of the high luminance region expansion binary data and the low luminance region reduction binary data belongs to the low luminance region.

2. The method of claim 1, wherein generating the binary data comprises: setting a value corresponding to the pixel of the binary data as 1 according to a judgment that the pixel belongs to the high luminance region when the luminance value of the pixel of the LUT output image is greater than the reference value; and setting the value corresponding to the pixel of the binary data as 0 according to a judgment that the pixel belongs to the low luminance region when the luminance value of the pixel of the LUT output image is smaller than the reference value.

3. The method of claim 2, wherein generating the high luminance region expansion binary data when the high luminance region is expanded comprises: when the binary data corresponding to the pixel is 1 and the binary data of an adjacent pixel of the pixel is 0, replacing the binary data of the adjacent pixel with 1.

4. The method of claim 3, wherein when the high luminance region expansion binary data corresponding to the pixel is 1, the luminance value of the pixel of the LUT output image is replaced with the high luminance value.

5. The method of claim 2, wherein generating the low luminance region reduction binary data when the low luminance region is reduced comprises: when the binary data corresponding to the pixel is 0 and the binary data of an adjacent pixel of the pixel is 1, replacing the binary data of the pixel with 1.

6. The method of claim 1, wherein a size of one of the expanded high luminance region and the reduced low luminance region is determined by at least one of a distance between the front LCD panel and the rear LCD panel and a size of the RGB image.

7. The method of claim 1, wherein the function includes one of a linear function and a curvilinear function.

8. The method of claim 1, wherein two or more luminance values of the LUT input image are converted into the maximum luminance value ($2^N-1$).

9. The method of claim 1, wherein the luminance value of the LUT input image of 0 is converted into 0, and the luminance value of the LUT input image between 0 and the reference value are converted into one between 0 and 'the maximum luminance value ($2^N-1$)' according to the function.

10. An image display device including a front LCD panel and a rear LCD panel overlapping each other, comprising:

an LCD controller signal-processing an RGB image and supplying the signal-processed RGB image to the front LCD panel; and an LV controller generating a black-and-white image having a luminance value adjusted by a pixel by signal-processing the RGB image and supplying the black-and-white image to the rear LCD panel, wherein the LV controller further comprises:

a color matrix converter generating an LUT input image from the RGB image through a color matrix conversion;

a look-up table converting a luminance value of the LUT input image expressed with N bits into a maximum luminance value ($2^N-1$) or one of 0 to 'the maximum luminance value-1 ($2^N-2$)' according to a function depending on whether or not the luminance value of the LUT input image is equal to or greater than a reference value, wherein N is an integer greater than 2 to generate an LUT output image;

a binarizer generating a binary data by binarizing a luminance value of a pixel of the LUT output;

a region processor generating one of a high luminance region expansion binary data and a low luminance region reduction binary data by expanding a high luminance region of the binary data and by reducing a low luminance region of the binary data; and a data replacer replacing the luminance value of the pixel of the LUT output image with a high luminance data representing the high luminance region when the pixel of one of the high luminance region expansion binary data and the low luminance region reduction binary data belongs to the high luminance region and not replacing the luminance value of the pixel of the LUT output image when the pixel of one of the high luminance region expansion binary data and the low luminance region reduction binary data belongs to the low luminance region.

11. The image display device of claim 10, wherein the binarizer sets: a value corresponding to the pixel of the binary data as 1 according to a judgment that the pixel belongs to the high luminance region when the luminance value of the pixel of the LUT output image is greater than the reference value; and the value corresponding to the pixel of the binary data as 0 according to a judgment that the pixel belongs to the low luminance region when the luminance value of the pixel of the LUT output image is smaller than the reference value.

12. The image display device of claim 11, wherein when the high luminance region is expanded and when the binary data corresponding to the pixel is 1 and the binary data of an adjacent pixel of the pixel is 0, the region processor replaces the binary data of the adjacent pixel with 1.

13. The image display device of claim 12, wherein when the high luminance region expansion binary data corresponding to the pixel is 1, the data replacer replaces the luminance value of the pixel of the LUT output image with the high luminance value.

14. The image display device of claim 11, wherein when the low luminance region is reduced and when the binary data corresponding to the pixel is 0 and the binary data of an adjacent pixel of the pixel is 1, the region processor replaces the binary data of the pixel with 1.

15. The image display device of claim 10, wherein a size of one of the expanded high luminance region and the reduced low luminance region is determined by at least one of a distance between the front LCD panel and the rear LCD panel and a size of the RGB image.

* * * * *